US009003737B2

(12) United States Patent
Solomon et al.

(10) Patent No.: US 9,003,737 B2
(45) Date of Patent: Apr. 14, 2015

(54) DEMOUNTABLE WALL SYSTEM

(75) Inventors: John Vernon Solomon, Hawkstone (CA); John R. White, Barrie (CA); Forrest C. Curry, Barrie (CA); John Rydall, Oakville (CA)

(73) Assignee: Concepts to Solutions Inc. (CA)

( * ) Notice: Subject to any disclaimer, the term of this patent is extended or adjusted under 35 U.S.C. 154(b) by 0 days.

(21) Appl. No.: 13/269,177

(22) Filed: Oct. 7, 2011

(65) Prior Publication Data

US 2013/0086860 A1 Apr. 11, 2013

(51) Int. Cl.

| | |
|---|---|
| ***E04C 2/38*** | (2006.01) |
| ***E04B 2/74*** | (2006.01) |
| *E04B 2/78* | (2006.01) |
| *E04H 1/12* | (2006.01) |
| *E04B 9/06* | (2006.01) |
| *E04B 9/12* | (2006.01) |

(52) U.S. Cl.

CPC ..... *E04B 2/7453* (2013.01); *E04B 2/7455* (2013.01); *E04B 2/7818* (2013.01); *E04B 2/7827* (2013.01); *E04B 2/7854* (2013.01); *E04B 2002/7462* (2013.01); *E04B 2002/7498* (2013.01); *E04H 1/125* (2013.01); *E04B 9/064* (2013.01); *E04B 9/127* (2013.01)

(58) Field of Classification Search

None

See application file for complete search history.

(56) References Cited

U.S. PATENT DOCUMENTS

| | | | | | |
|---|---|---|---|---|---|
| 2,097,484 | A | * | 11/1937 | Winslow | 52/578 |
| 3,486,288 | A | * | 12/1969 | Pyne | 52/844 |
| 3,525,560 | A | * | 8/1970 | Mac-Farlane et al. | 312/265.3 |
| 4,361,994 | A | * | 12/1982 | Carver | 52/238.1 |
| 4,852,317 | A | * | 8/1989 | Schiavello et al. | 52/239 |
| 4,909,013 | A | | 3/1990 | Daw et al. | |
| 4,984,400 | A | | 1/1991 | Bockmiller | |
| 5,029,518 | A | | 7/1991 | Austin | |
| 5,046,791 | A | * | 9/1991 | Kooiman | 312/265.1 |
| 5,199,235 | A | | 4/1993 | Holkenbrink et al. | |
| 5,228,254 | A | | 7/1993 | Honeycutt, Jr. | |
| 5,233,803 | A | | 8/1993 | Bockmiller | |
| 5,274,975 | A | * | 1/1994 | Haag | 52/300 |
| 5,414,967 | A | | 5/1995 | Cates et al. | |
| 5,447,002 | A | | 9/1995 | Wehrmann | |
| 5,470,139 | A | * | 11/1995 | Hsiao | 312/140 |
| 5,816,003 | A | | 10/1998 | Larsson et al. | |
| 6,003,279 | A | * | 12/1999 | Schneider | 52/481.1 |
| 6,155,014 | A | | 12/2000 | Wagner | |
| 7,966,782 | B2 | * | 6/2011 | Wood | 52/220.2 |
| 8,490,364 | B2 | * | 7/2013 | Spransy | 52/772 |
| 2003/0205010 | A1 | * | 11/2003 | Anglin et al. | 52/238.1 |

* cited by examiner

*Primary Examiner* — Adriana Figueroa

(57) ABSTRACT

The present invention relates generally to modular demountable wall systems and more particularly, to a flexible and versatile demountable wall system for where control of air pressure and contaminants may be required.

10 Claims, 81 Drawing Sheets

DEMOUNTABLE WALL SYSTEM

FIELD OF THE INVENTION

The present invention relates generally to modular demountable wall systems and more particularly, to a flexible and versatile demountable wall system for where control of air pressure and contaminants may be required.

BACKGROUND OF THE INVENTION

Demountable wall systems are frequently employed for partitioning room space between an overhead and a floor. The walls can be constructed of wall panels, fabric, sheet rock, etc. which are incorporated into the frame work assembly using either a batten or rolled form snap configuration. The finished or exposed area of a wall surface includes no fasteners. Demountable wall systems can be comprised of prefabricated components including, but not limited to, a supporting framework with support or frame members generally extending vertically from floor to ceiling, wall panels, a means for attaching the panels to the framework, and various trim elements. The wall panels may be held in the framework by battens or by snap-in arrangements wherein the panels have edge flanges engaging recesses in the frame members.

Demountable wall systems may be provided as single-sided, having wall panels on only one side of the framework, or as double sided, having wall panels on both sides of the framework. In double-sided configuration, either the framing elements must have wall panel attachments on both sides, or two sets of one-sided framing elements must be used back to back.

Demountable wall systems may be used as enclosures in which a highly sanitary or an uncontaminated environment may be maintained, also know as "Cleanrooms". A "Cleanroom" is a specially designed & constructed room in which the air supply, air distribution, filtration of air supply, materials of construction, and operating procedures are regulated to control airborne particle concentrations to meet appropriate cleanliness levels. Cleanrooms have controlled environments in which variables such as the density of airborne particles per cubic meter or the temperature of the room are controlled. For example, Cleanrooms are often used in facilities for the manufacture and assembly of electronic components, or in the biological and pharmaceutical sciences. Cleanrooms are essential for these manufacturing processes, which require high degrees of cleanliness and/or precise temperature and humidity control.

The need for Cleanrooms that can control the level of contamination (e.g. particulate and/or biological, etc.) in the sub micron particle range is increasing. Typical systems have been created to meet a single use, as the requirements for use in electronics, photonics, aerospace, trace metals, pharmaceutical, and for biological safety containment. These varieties in applications require wall systems with different configurations and functional requirements.

The walls and corners of Cleanrooms should have generally flat and smooth surfaces which tend not to catch and accumulate dust and other contaminants and which will not interfere with a laminar flow of room air. The wall surfaces must be smooth and durable to facilitate cleaning. The vertical seams between panel edges should be sealable, even when one or both panel edges have been field cut. The details of the panel edge connections should not interfere with the installation of the panel in tight spaces.

Cleanrooms are classified according to the number and size of particles permitted per volume of air provided in the enclosure. A discrete-particle-counting, light-scattering instrument may be used to determine the concentration of airborne particles, equal to and larger than the specified sizes, at designated sampling locations. The ISO 14644 Standards were based on from previous US Federal Standard 209E Airborne Particulate Cleanliness Classes in Cleanrooms and Cleanzones (abbreviated as the FED-STD-209E standard), which referred to the number of particles of size 0.5 μm or larger permitted per cubic foot of air. The ISO 14644-1 Standards specify the decimal logarithm of the number of particles 0.1 μm or larger permitted per cubic meter of air. For example, an ISO class 5 Cleanroom has at most $10^5$ particles per $m^3$.

Several performance considerations are important in the design, manufacture, and installation of demountable wall systems, including such systems for use in the design, manufacture, and installation of Cleanrooms. For example, it can be desirable that the components of the wall systems have the ability to be delivered to site and with a minimum of field fabrication and installed "clean". When installed, the wall should present a smooth surface for ease of cleaning. The system should be installable in as little space as possible, as floor space costs are significant. Variations or movement in the floor or ceiling should be accommodated. As such, Cleanrooms typically require modification to meet site conditions during construction, have the ability to be relocated, and should be flexible to allow the system to be easily reconfigured to meet changes required for production and equipment changes. These changes are typically required to be made "clean" so they can be installed during or with little disruption to production.

Previously existing wall systems have failed to satisfy one or more of the above-mentioned criteria. Thus there is an unmet need for a demountable wall system that requires a minimum of field fabrication and can be built "clean", is economically manufactured, is easily installed in a minimum of space, and is suitable for use in a variety of Cleanroom configurations or as an office or lab partition and otherwise meets all the aforementioned criteria.

SUMMARY OF THE INVENTION

A demountable wall system adapted for use as part of a cleanroom structure, said system comprising: (a) a wall panel; (b) a structural member having a generally rectangular cross section defined by opposing wide sides that are wider than opposing narrow sides and adapted to receive the wall panel, a wide side having a first and second pair of releasable locking members; (c) a track member having a pair of releasable locking members and a flange member extending from a base, the flange member adapted to engage the wall panel and having a plurality of releasable locking members extending therefrom, the releasable locking members adapted for engaging a releasable locking members of the structural member to form a semi-rigid connection therewith; (d) a first batten member having a base, the base having a first portion being adapted to engage the wall panel and a second portion of the base having a pair of releasable locking members extending therefrom, the pair of releasable locking members adapted for engaging the releasable locking members of the structural member to form a semi-rigid connection therewith; (e) a second batten member having a base, a first portion of the base being adapted to engage the wall panel and having second portion of the base having a pair of releasable locking members extending therefrom, the pair of releasable locking members adapted for engaging the releasable locking members of the flange member of the track member to form a semi-rigid connection therewith; (f) a first bracket member having a base, the base having a first pair of flanges and a first pair of releasable locking members extending therefrom in a first direction and a second pair of flanges extending from the base in a second direction, the second direction opposite to the first orientation, the first pair of flanges having a second pair of releasable locking members extending therefrom, the second pair of flanges having a third pair of releasable locking members extending therefrom, at least one of the third releasable locking members adapted for engaging the releasable locking members of the track member to form a semi-rigid connection therewith, at least one of the second pair of flanges engaging the wall panel; and (g) a second bracket member having a base and a flange extending perpendicular to the base, each of the base and the flange having a pair of releasable locking members extending therefrom, at least one of the pair of releasable locking members extending from the flange adapted for engaging a releasable locking member of the structural member to form a semi-rigid connection therewith and at least one of the pair of releasable locking members extending from the base adapted for engaging the first pair of releasable locking member of the first bracket to form a semi-rigid connection therewith.

In another feature, the embodiments of the present invention are directed to the system noted above wherein the structure member further comprises a pair of releasable locking members on the narrow side and the first pair of releasable locking members.

In yet another feature, the embodiments of the present invention are directed to the system noted above wherein the structural member further comprises a first wall panel receiving channel formed by a first flange extending from a first narrow side of the structural member and a first member of a first pair of releasable locking members.

In yet another feature, the embodiments of the present invention are directed to the system noted above wherein the structural member further comprises a first wall panel receiving channel formed by a first flange extending from a first wide side of the structural member and a second flange extending from a first narrow side of the structural member.

In yet another feature, the embodiments of the present invention are directed to the system noted above wherein the structural member further comprises a second wall panel receiving channel formed by a second flange extending from a first wide side of the structural member and a second flange extending from a first narrow side of the structural member.

In yet another feature, the embodiments of the present invention are directed to the system noted above wherein the first portion of the base of the first batten engages the wall panel in the first wall panel-receiving channel upon assembly.

In yet another feature, the embodiments of the present invention are directed to the system noted above wherein the second batten member further comprises a third portion of the base and a coved portion between the first and third portion.

In yet another feature, the embodiments of the present invention are directed to the system noted above wherein the third portion engages a ceiling of the cleanroom upon assembly.

In yet another feature, the embodiments of the present invention are directed to the system noted above wherein the third portion engages a ceiling of the cleanroom upon assembly.

In yet another feature, the embodiments of the present invention are directed to the system noted above wherein each releasable locking member comprises a pawl biased in a resting first position, the pawl movable upon the application of a forced between the resting position and the second extended position, wherein in the second extending position the pawl may be engagable by a pawl of an opposed releasable locking member.

In yet another feature, the embodiments of the present invention are directed to the system noted above wherein the pawl of the first releasable connectors fits into or engages with the pawl of the second releasable connector and therefore the second releasable connector can only travel freely in the a first direction along a linear plane.

In yet another feature, the embodiments of the present invention are directed to the system noted above wherein the base of the second bracket may be adapted to receive an attachment member to securely affix the second bracket to the first bracket and the flange of the second bracket may be adapted to receive an attachment member to securely affix the second bracket to the structural member.

In yet another feature, the embodiments of the present invention are directed to the system noted above wherein the attachment member be a self-tapping TEK screw (e.g. No. 10).

In yet another feature, the embodiments of the present invention are directed to the system noted above wherein the wall panel comprises an exterior shell and interior core.

In yet another feature, the embodiments of the present invention are directed to the system noted above wherein the members are made from extruded aluminum or PVC.

In yet another feature, the embodiments of the present invention are directed to the system noted above wherein the first and second batten members are made from extruded aluminum or co-extruded PVC.

BRIEF DESCRIPTION OF THE DRAWINGS

The embodiments of the present invention shall be more clearly understood with reference to the following detailed description of the embodiments of the invention taken in conjunction with the accompanying drawings, in which.

DETAILED DESCRIPTION OF EMBODIMENTS OF THE INVENTION

Figure 1A:
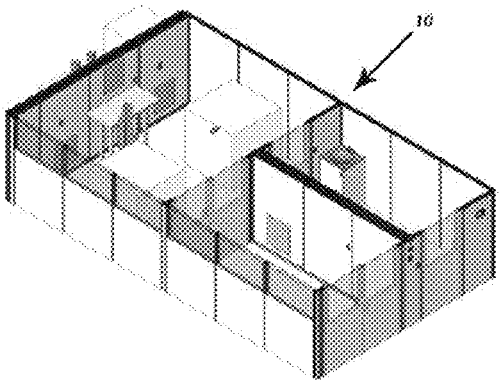
FIGS. 1A to 1C are perspective views of a Cleanroom.

The description which follows, and the embodiments described therein are provided by way of illustration of an example, or examples of particular embodiments of principles and aspects of the present invention. These examples are provided for the purposes of explanation and not of limitation, of those principles of the invention. In the description that follows, like parts are marked throughout the specification and the drawings with the same respective reference numerals.

In the description and drawings herein, and unless noted otherwise, the terms "vertical", "lateral" and "horizontal", are references to a Cartesian co-ordinate system in which the vertical direction generally extends in an "up and down" orientation from bottom to top (z-axis) while the lateral direction generally extends in a "left to right" or "side to side" orientation (y-axis). In addition, the horizontal direction extends in a "front to back" orientation and can extend in an orientation that may extend out from or into the page (x-axis). In the description and drawings herein, and unless noted otherwise, the use of the term "upper" generally refers to or indicates the area or direction towards a ceiling of a cleanroom, while the term "lower" generally refers to or indicates the area or direction towards a floor of a cleanroom.

Although the foregoing description and accompanying drawings relate to specific preferred embodiments of the present invention as presently contemplated by the inventor, it will be understood that various changes, modifications and adaptations, may be made without departing from the spirit of the invention.

In Cleanroom design, there are many factors to consider before a settling on a final design and beginning Cleanroom construction, including but not limited to, (i) the activity level within the Cleanroom; (ii) the type of activity required within the room; (iii) the contamination rate from any such activity; (iv) the temperature and humidity required for the activity, and; (v) the comfort of the associates that will work within the Cleanroom. Once all of these factors are analyzed, a design can be formulated, using guidelines that have been established, which will lead to a successful "operational" Cleanroom system. Over design will cost the owner additional up front cost, and operational cost, and under design will result in production problems. These issues can be addressed utilizing the flexibility of the present invention.

The present invention is directed to a system that may be installed as a modular demountable space partition or wall system, and be used for various configurations, including, but not limited to Cleanrooms. The system of the present invention was designed to have components, which would easily fit together in a semi-rigid fashion and can be more securely attached with the use of self-tapping screws for ease of installation and retrofit. The system can also be easily disassembled and/or re-configured with minimal disruption, effort, cost and loss of materials. The system can be assembled or disassembled with reduced debris so as to be a "clean" construction. When used in association with Cleanrooms, the present invention can be used with a new installation but also can be used where upgrading, modernizing, or expanding existing Cleanrooms are required (e.g. a retrofit).

According to the present invention, the construction of Cleanrooms can now be reduced to a set of construction members that can quickly and releasably secured together but can also be quickly disassembled. Accordingly, the complex prior art process of constructing a Cleanroom wall system may be now reduced to a series of steps that automatically result in proper alignment and sealing of wall junctions in order to meet the technical and functional requirements of a specific Cleanroom design.

The present invention provides a system that does not require precise preplanning, as other wall systems, which once installed, do not allow modification or adjustment. The modular system of the present invention is intrinsically a flexible system such that it may be possible to change the Cleanroom layout before, during, and after assembly. The present system provides a demountable wall system for use with Cleanrooms that includes construction components or members that are versatile and easy to assemble, owing to a universal locking mechanism. The components are designed to easily and securely align with the other components so as to secure wall panels as desired.

In the case of existing Cleanrooms, it may be possible to use the present invention in whole or in part. It will be understood by a person skilled in the relevant art that individual embodiments of the present invention can be used with pre-installed or preexisting systems and/or equipment. It will also be understood that, depending on any pre-existing or pre-installed configuration, not all embodiments of the present invention may be used. For example, where a ceiling may not be required, as there may be a pre-existing or installed ceiling, the system of the present invention can be used without any ceiling components. It will also be understood that where doors or windows are not required, they can be omitted as well. One aspect of the present invention, therefore, may be the flexibility of the system. It can also be adjusted after installation without significant effort or cost. Further, debris that can result from current systems may be significantly less that existing systems, which meant that post-installation modifications can be made quick, cost effective and with minimal disruption of existing activity within the Cleanroom and surrounding environment. It will be done in a "clean" manner without the need to create dust, debris, and any type of scrap incompatible with production areas. In many cases, the unused production material can be recycled as well. This may not be possible with pre-existing Cleanroom systems.

The present invention is directed to a framed wall construction system that can be easily assembled and disassembled. For the framed wall construction system in accordance with the present invention, the construction material may be fabricated by extrusion, using materials such as aluminum, composites or other suitable materials. It will be understood that any suitable material with functional characteristics (e.g. strength and flexibility requirements) may used with the embodiments of the present invention. Preferably, the embodiments of the present invention are made of a manufactured lightweight material, preferable extruded aluminum or engineered polymers (e.g. PVC, etc.). More preferably, construction material of the present invention may be extruded aluminum as it reduces contamination from metals that can rust and add additional contamination, and it provides construction material that can be completely recycled at end of the life of the system or components. In doing so, the system of the present invention provides for a "clean construction" in that the amount of material that cannot be reused or recycled may be reduced.

The system of the present invention involves a plurality of construction members comprising, track members (e.g. ceiling and floor track members), attachment members (e.g. differently sized generally "H" shaped brackets and generally "L" shaped brackets), structural members (e.g. stud members and ceiling support members), batten members, and wall/ceiling panel members that can be releasable interconnected to form a variety of Cleanroom configurations. Using a small set of differing types of construction members, a near infinite number of different combinations can be achieved An aspect of the present invention includes attachment members, which may comprise generally H-shaped brackets and L-shaped brackets of differing sizes. Both the H-shaped brackets and the L-shaped brackets are produced from, preferably, extruded aluminum and then cut and shaped to meet the requirements of any particular assembly.

The structural members include, but are not limited to, stud and ceiling support members, which provide the structural frames for the system of the present invention. Wall studs may be used vertically (e.g. functioning as a wall stud) and/or horizontally (e.g. functioning as a cross member) to hold the wall panels, corners, doorframes, windows and batten members in place. In a preferred embodiment, wall studs may be secured to ceiling and/or floor track members with H-brackets and/or L-brackets. In the system of the present invention, the studs and other structural elements can be single sided or double sided in order to accommodate single or double wall panels. A preferred double stud (see, for example, FIGS. 2A and 2B) allows for a double-sided wall with an interior cavity to hold electrical or mechanical elements. In another preferred embodiment, a strut style stud (see FIGS. 7A and 7B) may also be provided for use on a single sided wall with the ability to fasten mechanical and electrical components. The studs and cross members can be connected together using the H- and L-brackets of the present invention to provide a framework in any desired configuration needed to create the desired Cleanroom.

Another aspect of the present invention is a ceiling suspension system designed to support a suspended ceiling, preferably for use in Cleanrooms. In one configuration, ceiling support members, preferably extruded aluminum, and more preferably shaped as generally inverted "T"s (see FIGS. 19 and 20), are hung from the building structure ceiling to form an interstitial space between the ceiling and the building structure. As shown FIGS. 29A and 29B, additional ceiling support member embodiments are provided.

The suspended ceiling system for use in association with the present invention may incorporate a framework or grid formed from ceiling support members, which could be set out lengthwise or crosswise so as to form open areas for mounting substantial loads. The preferred embodiment of the present invention utilize two generally inverted T shaped support members, which when affixed to the building structure and used in accordance to loading tables known to a person skilled in the relevant art, can be used to support ceiling panels, air filter modules, light fixtures, sprinkler heads, high efficiency particulate air ("HEPA") filtration, mechanical & electrical components and the like. In a preferred embodiment, the suspended ceiling of the present invention can provide a walkable ceiling structure.

Separate heating, ventilating and air conditioning ("HVAC") system may provide a controlled, reproducible environment for the Cleanroom as well as a comfortable environment for those working in the facility. The cleanliness of any Cleanroom may be directly proportional to the air change rates of the air moving through the room. Because the air volumes supplied to Cleanrooms are many times (10-100) greater than those supplied to conventionally ventilated rooms, the capital and operating costs for the construction of such rooms can be very high. Hard, smooth, durable finish materials have been used in the construction of the Cleanroom to allow for routine cleaning and sterilization. Floor finishes, are typically seamless smooth surfaces, which are subject to the requirements of the Cleanroom.

The track members include, but are not limited to, ceiling tracks and floor tracks. The ceiling/floor tracks may anchor the stud members and wall panel members to the ceiling support members or the floor, as applicable. The present invention utilizes at least two track styles, each of which can be used for ceiling and floor applications. Floor track members may be required to adapt to any floor level irregularities, which are common. It will be understood that each track style can be used for both ceiling and floor applications. In other words, it may be possible to use the same track as both a ceiling track and floor. When used as a ceiling track, the tracks of the present invention may function as one or both of a fixation point for the stud members and holding any ceiling panels in place.

The system uses batten members including, but not limited to, wall battens and track battens, to hold wall panels in place and provide the profile and/or configuration that may be required by the technical requirements of each Cleanroom. In a preferred embodiment, a wall batten secures wall panels in place in vertical and horizontal orientations while track battens secure wall panels in place in horizontal orientations, particularly at floor and ceiling applications. It will be understood, however, that track battens may also be used to secure wall panels in place in a vertical orientation. Batten members can be made of variety of materials well known in the art. Preferably, batten members may comprise a solid material, preferably made of co-extruded poly vinyl chloride ("PVC")

or extruded aluminum, as a securing or holding mechanism where two construction members (i.e. wall panels and ceiling support members, wall panels and floor track members, etc.) join together. An aspect of the invention may be interchangeable batten members of differing configuration to be used in Cleanrooms configured for use in association with different requirements, such as, for example, electronics manufacture, pharmaceutical manufacture or biological containment. In a preferred embodiment, the system can utilize batten members of co-extruded PVC that allows for a tight seal, with little caulking required for reduced maintenance. The length of each batten member may vary and will be determined based on the height of the wall system required as well as locations of equipment ports at various positions along the wall system. In typical Cleanrooms, a floor cove may be integrated into the floor system. This decreases the versatility of the Cleanroom incorporating this design. In a preferred embodiment of the present invention, batten members (e.g. coves or coved batten members) may be incorporated into the wall system, which allows for flexibility in the relocation of the wall system as changes are required.

Sealants (e.g. silicone, latex, etc.) may be applied to all joints and gaps to fill all voids between construction materials, devices, and installed equipment. In a preferred embodiment of the present invention, extensive caulking may not be required to maintain the functional characteristics of the Cleanroom.

An aspect of the present invention provides a system that allows the use of any wall panel that will be suitable for specific Cleanroom classifications (e.g. ISO 14644 Standards), and that also meet any applicable local building codes requirements. In a preferred embodiment, the wall panel can have a ½" thickness but it will be understood that the embodiments of the present invention could be sized for and function with a variety of wall panel thicknesses (see, for example, FIGS. 34A and 34B). Typically wall panels comprise an interior core and an exterior shell or surface. Alternate surfaces and cores are available to meet the requirements of any type of Cleanroom application. Wall panel shells may be made of materials well know in the art, including aluminum or reinforced materials with various core options, including, but not limited to, aluminum honeycomb or extruded foam. In a preferred embodiment, shell or surfaces may include vinyl, stainless steel, Fiberglas™ reinforced plastic ("FRP"), polyvinyl chloride ("PVC"), high pressure laminates, etc. In a preferred embodiment, wall panel cores include expanded polystyrene, paper honeycomb, aluminum honeycomb, gypsum, isocyanurate, etc. It will be understood by a person skilled in the relevant art that a variety of wall panels comprising various combinations of shell and cores are available and any specific wall panel can be selected based on the specific functional requirements of the Cleanroom. For example, aluminum honeycomb type wall panels may be chosen for microelectronics Cleanrooms because of the functional characteristics that are desired for that application, such as, but not limited to, non-outgassing, non-particle shedding, and anti-static as well as lightweight and non-combustible. In other applications, different functional requirements are needed. For example, biotechnological or pharmaceutical applied Cleanrooms may require wall panels that can be washed continuously without breaking down the wall. Examples of wall panel that may be suitable for such uses (e.g. can withstand repeated cleaning and sanitization with various chemicals to resist microbial and fungal growth) may include aluminum or FRP panels. In a more preferred embodiment, the wall panels can include aluminum with an aluminum honeycomb core (ALUMAcomb™), aluminum with a foam core ALUMAfoam™), aluminum & FRP with a foam core (ALUMAfrp™) and vinyl faced gypsum panels such as National Gypsum Gold Bond Foil Back Gypsum Board. It will be understood that the dimensions of a wall panel section may vary and can be determined based on the height of the wall system required as well as locations of equipment ports at various positions along the wall system. Wall panels may be constructed with a uniform width of a basic unitary dimension. For example, panel section may preferably be 4' wide×4' to 12' in length×½" or comparable metric measurements which can be utilized to develop a total wall section of appropriate dimension by interlocking various unitary panel sections to realize the total width desired. A preferable embodiment for aseptic filing applications may be directed to a wall panel with a rolled snap panel design that does not require a batten.

Each wall panel section generally includes an interior face and an exterior face. Typically, the interior face may form a planar surface, which provides interior wall structure to the clean room assembly, while the exterior face may not be provided in the Cleanroom but external to the clean room. It will be understood that a wall panel in Cleanroom construction can have two interior wall faces. The demountable wall system of the present invention allows for the formation of a single or double wall system. While many Cleanroom wall systems provide for a solid single panel, a preferred embodiment of the present invention provides for a double-sided "cavity wall" installation. A double-sided "cavity wall" allows for piping, electrical, mechanical, etc. to be integrated within any location along the wall. Alternatively, the invention may utilize a single sided panel, using specific embodiments for attaching mechanical and electrical components. With this wall option, it would not be necessary to create a double wall with two partitioned walls panels.

Another aspect of the invention may be a locking mechanism comprising an interlocking snap configuration that provides a semi-rigid universal connector. An embodiment of the present invention may be a plurality of locking mechanisms that allow for quick connection and quick release of different construction members of the present invention. Once connected, the locking mechanism of the present invention forms a semi-rigid connection between two construction members (e.g. track member and stud member). Having an interlocking mechanism allows for quick assembly and disassembly of the various elements of the present invention and thus provides for the versatility of the present invention. An aspect of the present invention is a first releasable snap connector on a first construction member, the first snap connector having a unidirectional engagement member adapted to engage or mate with a second releasable snap connector on a second construction member. The first and second releasable snap connector, when in mating engagement, are opposingly oriented (e.g. oriented in opposite directions) along a linear plane of movement so as to secure the first and second construction members along the linear plane of movement. In order to engage the snap connectors, a pawl member biased in a resting first configuration can be moved when forced is applied to it, preferably from a pawl member of a second snap connector, to a second extended configuration. In a preferred embodiment, when the pawl may be biased towards the second position (e.g. by a force applied by second pawl), the first pawl provides resistance to the applied force. Once the force is released, the first pawl returns to the first resting configuration. The second pawl may travel against the first pawl pushing the first pawl to the second extended configuration until it clears the first pawl at which time, the first pawl is released and returns to the first configuration. It will be understood that as the first pawl is biased to the second position, so will be the second pawl; as the first pawl is released, so is the second pawl. So long as the second releasable connector travels in a first direction along the linear plane, the pawl of the first releasable connector allows the second connector to travel until the second pawl no longer biases the first pawl towards the second position. In other words, the pawl of the first releasable connectors fits into or engages with the pawl of the second releasable connector and therefore the second releasable connector can only travel freely in the first direction along the liner plane. Once the force is taken away, the pawl member returns to the first position such that it can engage with or snap into the second pawl member. In order to release the snap connector, the construction member can be moved perpendicularly to the linear plane so as to basis the pawls to the section position thus release the engagement of the two pawl members. Once the pawl members have been released, the construction members can be separated. It will be understood, as described in greater detail in reference to the drawings that having a plurality of releasable connectors allows for secure semi-rigid attachment of construction members but this secure attachment can be released with the application of sufficient force perpendicular to the linear plane of movement in order to release the pawl members.

Figure 1B:
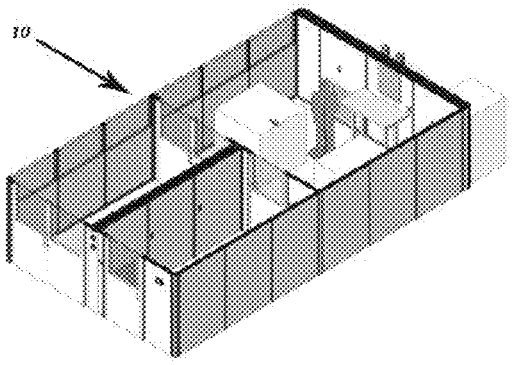
Figure 1C:
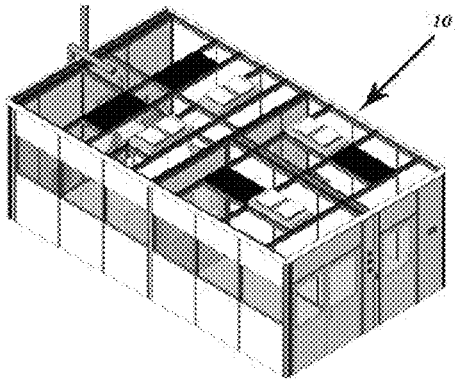

As shown in FIGS. 1A to 1C, there is provided Cleanroom 10 having walls extending generally vertically between a floor and a ceiling (not shown). It will be understood that the ceiling of a typical cleanroom (as shown, for example, in FIG. 1A) can be of known construction. In rooms such as Cleanrooms, it will be understood that the ceiling may include air filter and ventilation (as shown, for example, in FIG. 1C), each in a manner well know in the art. The floor may also be of known construction, such as, but not limited to, raised access floor varieties. It will be understood by a person skilled in the relevant art that the wall system of the present invention may be used with a variety of ceiling and floor constructions that provide structures to which the various embodiments of the present invention may be secured, attached or affixed.

FIGS. 2A to 40B provide examples of preferred construction members of the present invention. FIGS. 41A to 61C provide examples of preferred embodiments of the preferred constructions members interconnected.

Figure 2A:
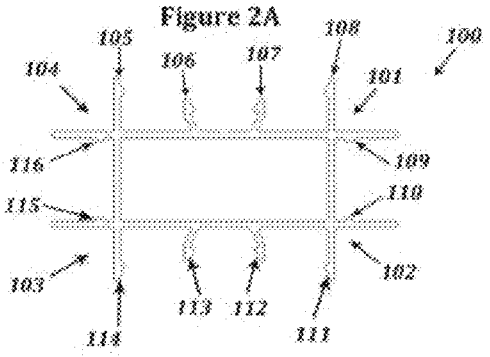
FIGS. 2A to 7B are cross sectional and perspective views of embodiments of stud members used in the present invention.
Figure 2B:
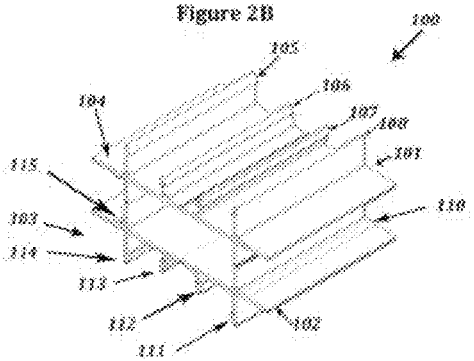
Figure 3A:
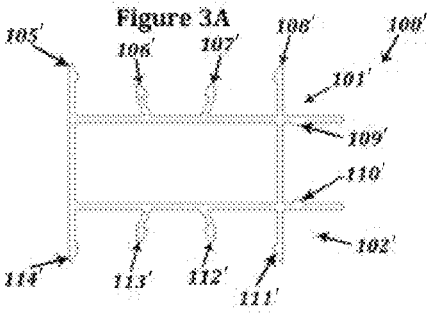
Figure 3B:
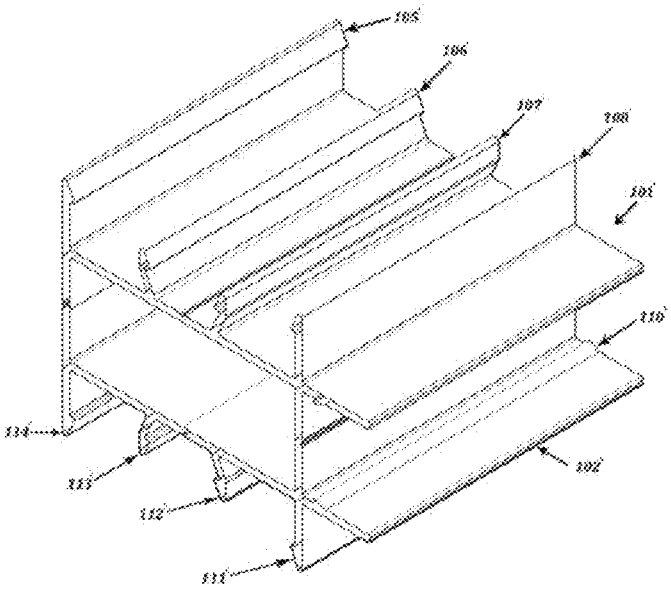
Figure 41A:
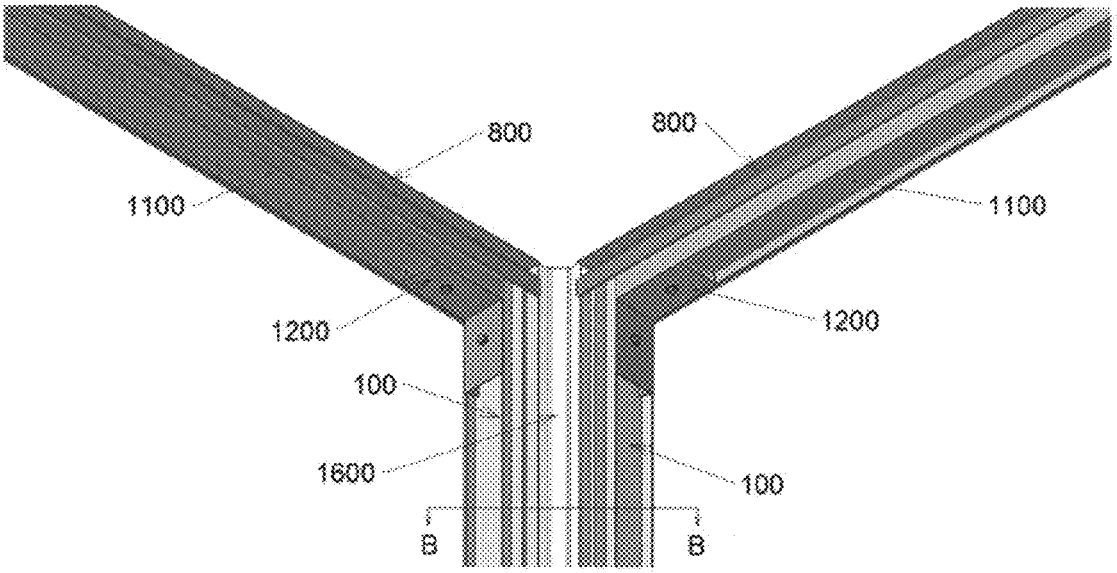
FIGS. 41A to 61C are cross sectional, perspective and exploded views of embodiments of assembled construction members used in the present invention.
Figure 41B:
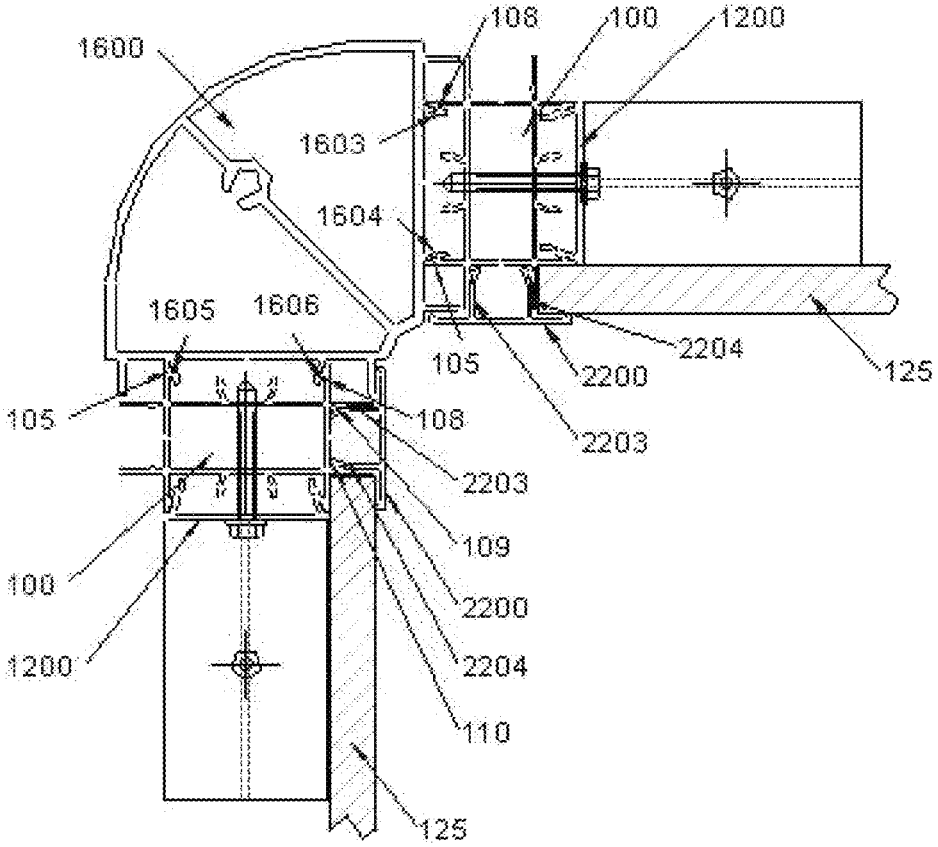

As shown in FIGS. 2A and 2B, there is stud member 100. Preferably, stud member 100 may be a hollow stud, preferably rectangular that can be made from an extrusion process of an extruded material, preferably extruded aluminum. It will be understood by a person skilled in the relevant art that a wall panel section of a Cleanroom can be quickly assembled having up to four individual wall panels arranged in generally co-planar alignment with a plurality of stud members 100. Based on the configuration of stud 100, up to four wall panels (not shown) can be removable accommodated within the recesses 101 to 104 when stud member 100 may be used in a vertical orientation. As provided in FIG. 41B, wall panel members 125 may be inserted into any of the recesses 101 to 104, provided on the ends of stud 100. It will be understood, however, that not all of recesses 101 to 104 need to be occupied in an assembled configuration. For example, FIG. 41B shows only two wall panels in the assembled wall, while FIG. 42B shows four wall panels in the assembled wall. The wall panels (as shown, for example, in FIGS. 41B and 42B) are automatically aligned in co-planar relationship with stud 100 such that they can be secured using other construction members (e.g. batten members) as discussed in greater detail below (see, for example, FIGS. 41B and 42B). As can be seen from FIGS. 2A and 2B, stud member 100 may be configured with a plurality of locking mechanisms 105 to 116 designed to engage corresponding locking mechanisms on other construction members. In a preferred embodiment, locking members may be comprised of pawls 105 to 116 having a generally half arrow configuration.

Figure 4A:
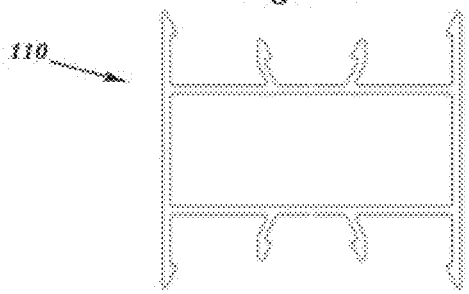
Figure 4B:
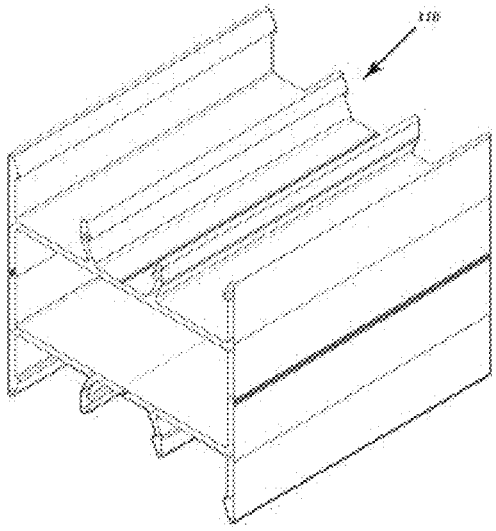
Figure 5A:
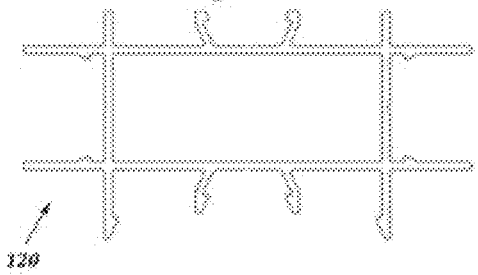
Figure 5B:
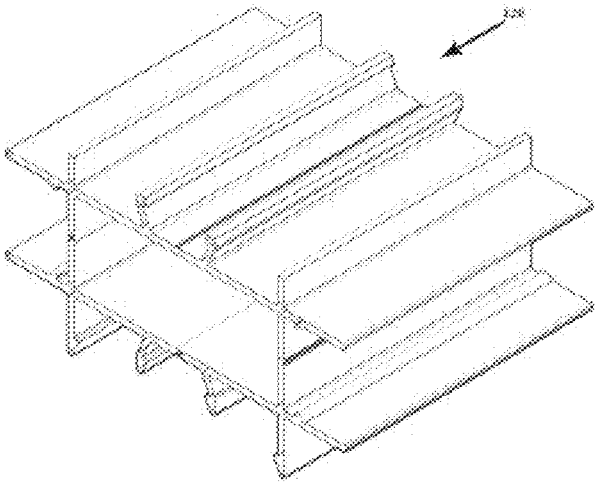
Figure 6A:
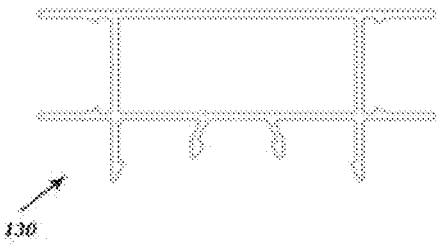
Figure 6B:
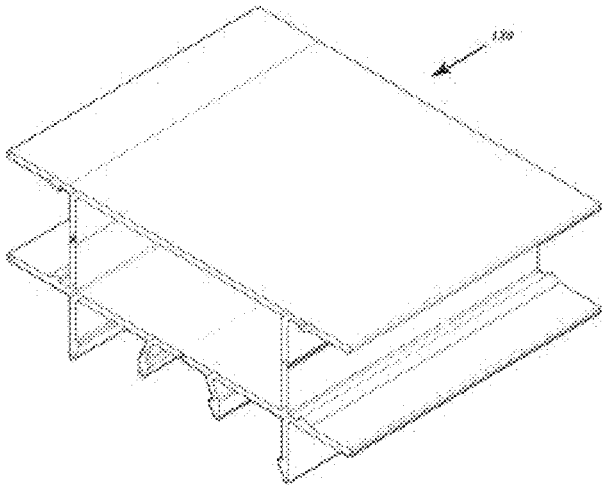

Stud 100 can be used for either a double wall panel configuration (e.g. wall panels provided in all recesses 101 to 104) or a single wall panel configuration (e.g. wall panels provided in only 101 and 102 as shown in FIG. 42B. It will be understood that stud member 100 can be modified so as to reduce the number of wall panel receiving recesses (see, for example, FIGS. 3A and 3B). It will be understood by a person skilled in the relevant art that stud 100 may also used horizontally at openings and windows as a cross member. For example, stud members can be purchased up to 26' in height as a single stud, while wall panels typically have a 12' height restriction. FIGS. 4A to 6B also provide modifications of the basic stud member 100. As shown in FIG. 4A, stud 110 may be utilized to add stability or to provide additional support for attaching cabinetry or other components that may require attachment to a wall. As shown in FIGS. 5A, 5B and 6A, 6B, stud members 120 and 130 may be used to where installation against an existing wall or ceiling may be desired and a tight fit with a construction member (e.g. a batten member) may also be desired. The modifications of stud 100 (as shown in FIGS. 5A to 6B) allow for various configurations of wall design, and can be used with various attachment members (e.g. H- or L-brackets).

Figure 7A:
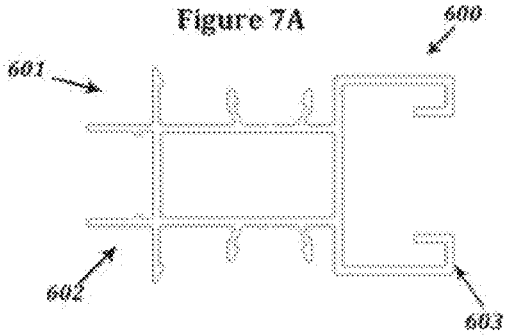
Figure 7B:
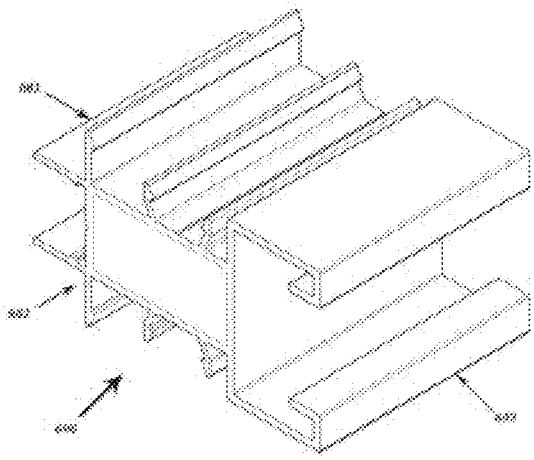

As shown in FIGS. 7A and 7B, stud strut member 600 is provided for receiving up to two wall panel members into recesses 601 and 602 along with an opposing strut 603. In a preferred embodiment, stud strut member 600 allows for a configuration where a single sided wall with an allowance for mechanical and electrical piping to be accommodated in the opposing strut 603 may be desired (see FIGS. 49B and 50B).

Figure 8A:
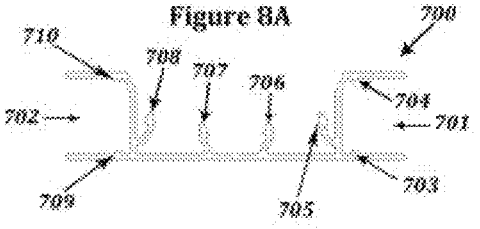
FIGS. 8A to 9B are cross sectional and perspective views of embodiments of track members used in the present invention.
Figure 8B:
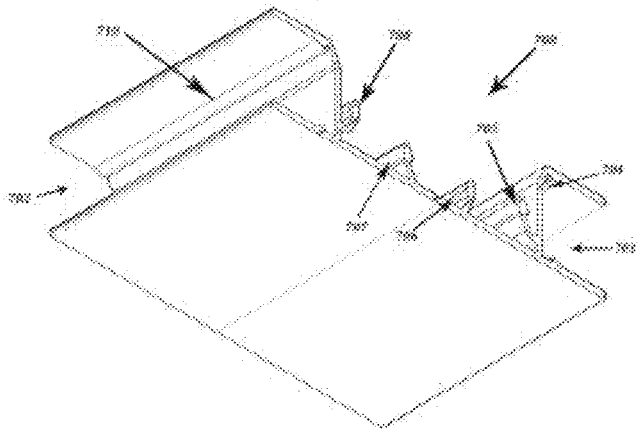

FIGS. 8A, 8B, 9A and 9B provide preferred embodiments of track members 700 and 800. Track members 700 and 800 may be used to anchor construction members (e.g. wall panels, stud members, batten members, etc.) of the present invention to the ceiling and/or the floor. As can be seen from FIGS. 8A and 8B, track member 700 may be configured with a plurality of locking mechanisms 704 to 710 designed to engage corresponding locking mechanisms on other construction members. As can be seen in FIGS. 8A and 8B, track member 700 may be provided with a pair of generally "U" shaped receiving channels 701 and 702 that can be used with other construction members (e.g. batten members) to secure wall panel members (not shown) in position.

Figure 9A:
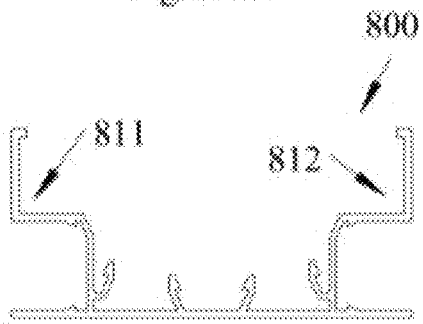
Figure 9B:
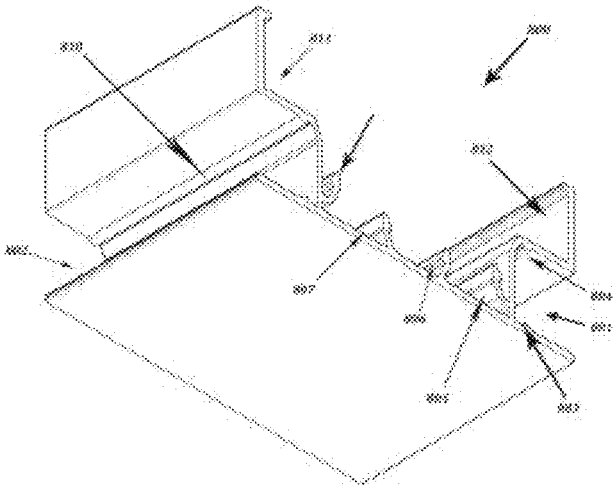
Figure 41C:
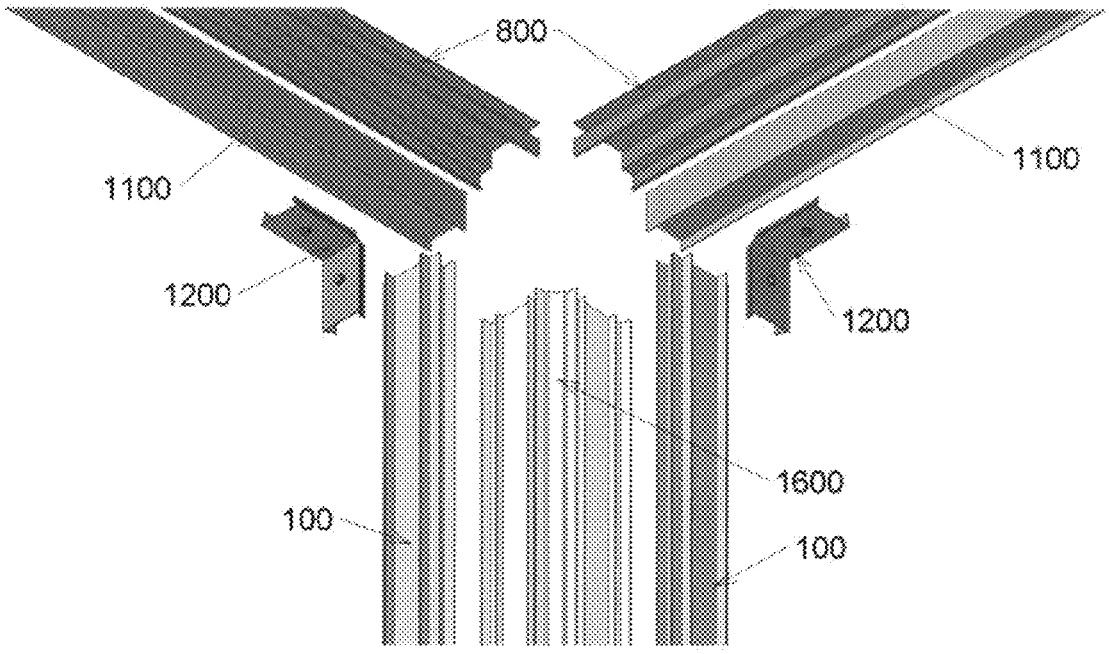

As shown in FIGS. 9A and 9B, track member 800 may be provided with additional receiving recesses 812 and 811. When used as a ceiling track, for example, track member 800 (as seen in FIG. 41A to 41C), can be used with other construction members (e.g. batten members) to secure wall panel members (not shown) in position. It will be understood that track members 700 and 800 can be used in either a ceiling or floor configuration, as desired.

Figure 10A:
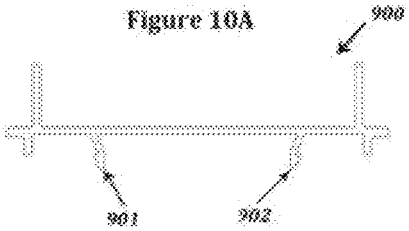
FIGS. 10A and 10B are cross sectional and perspective views of embodiments of window members used in the present invention.
Figure 10B:
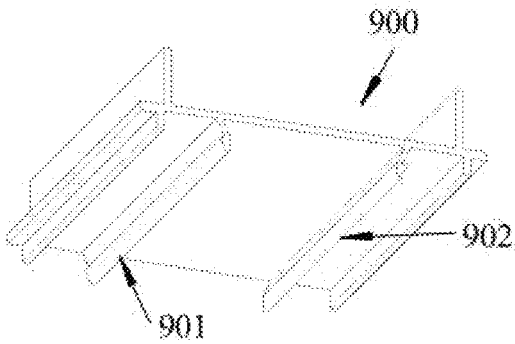
Figure 11A:
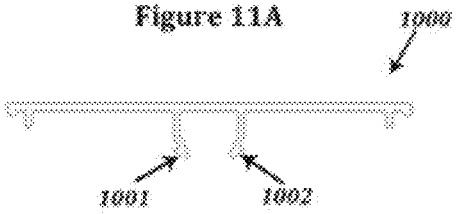
FIGS. 11A and 11B are cross sectional and perspective views of embodiments of cap members used in the present invention.
Figure 11B:
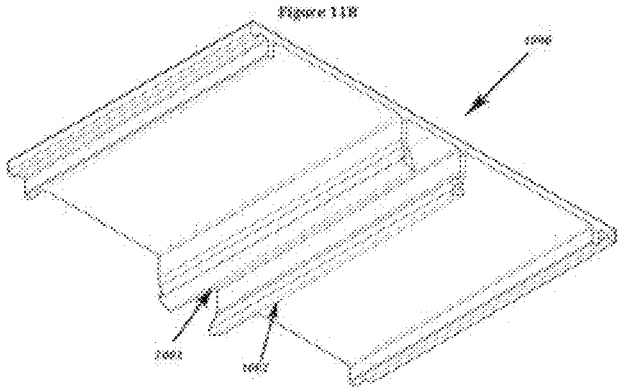

FIGS. 10 and 11 provide batten members 900 and 1000. As can be seen from FIGS. 9A and 10A, batten or "cap" members 900 and 1000 are configured with a plurality of locking mechanisms 902,901 and 1002,1001 designed to engage corresponding locking mechanisms on other construction members. A function of the cap batten members can be to provide, for example, a finished end at where construction members are connected (see, for example, FIG. 55A).

Figure 12A:
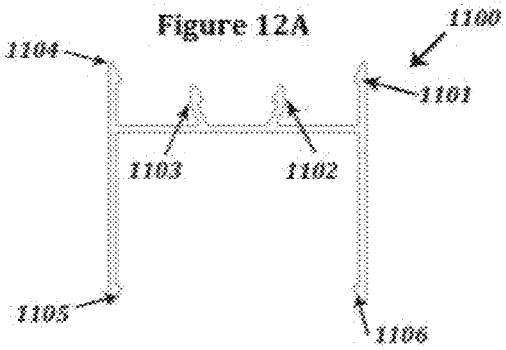
FIGS. 12A to 15B are cross sectional and perspective views of embodiments of bracket members used in the present invention.
Figure 12B:
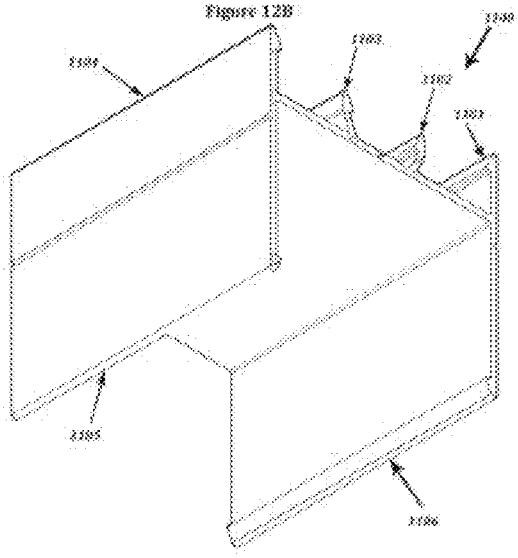

As shown in FIGS. 12A and 12B, there may be provided a generally "H" shaped bracket 1100 that may be used to secure construction elements as will be described in greater detail herein. As can be seen from FIGS. 12A and 12B, bracket 1100 may be configured with a plurality of locking mechanisms 1101 to 1106 designed to releasable engage corresponding locking mechanisms on other construction members. For example, as shown in FIGS. 41A to 41C, H-shaped bracket 1100 may engage with track member 800 through the releasable locking members so as to form a semi-rigid connection therewith. In another configuration, the H-shaped bracket can secure wall panels to a track member (not shown).

Figure 13A:
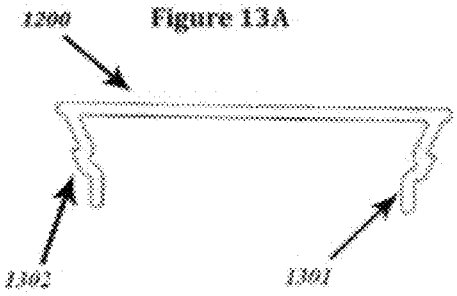
Figure 13B:
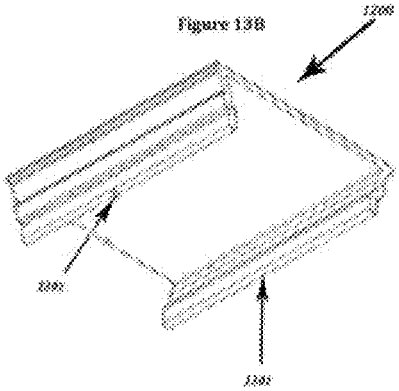
Figure 14A:
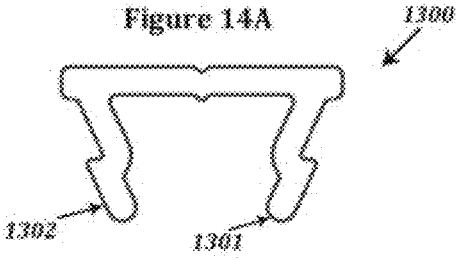
Figure 14B:
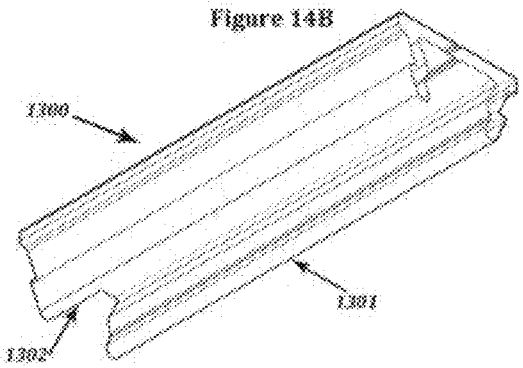

FIGS. 13 and 14 provide extruded members 1200 and 1300. As can be seen from FIGS. 13A and 14A, for example, brackets 1200 and 1300 may be configured with a plurality of locking mechanisms 1201, 1202 and 1301, 1302 designed to releasable engage corresponding locking mechanisms on other construction members. Members 1200 and 1300 can be adapted to form generally L-shaped brackets that may be used to secure construction members of the present invention.

Figure 15A:
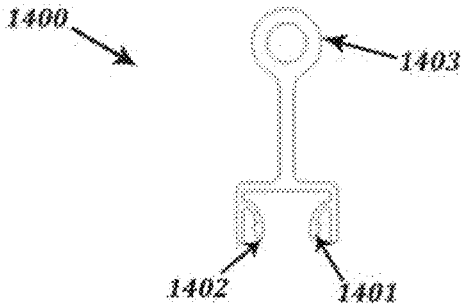
Figure 15B:
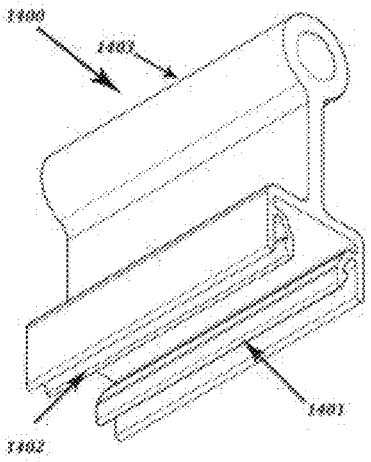

FIG. 15 shows a corner bracket 1400. As can be seen from FIGS. 15A and 15B, for example, corner bracket 1400 may be configured with a plurality of locking mechanisms 1401, and 1402 designed to releasable engage corresponding locking mechanisms on other construction members. Corner bracket 1400, with three-way corner bracket 1700 can be used as a centerline in wall construction (ring member 1403 indicating center), to secure corner bracket 1700, or to make a four-way corner (e.g. two corner brackets 1700 secured together).

Figure 16A:
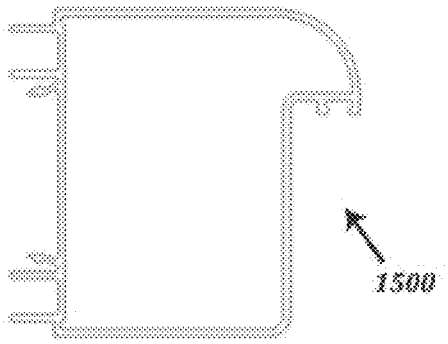
FIGS. 16A and 16B are cross sectional and perspective views of an embodiment of a door frame member used in the present invention.
Figure 16B:
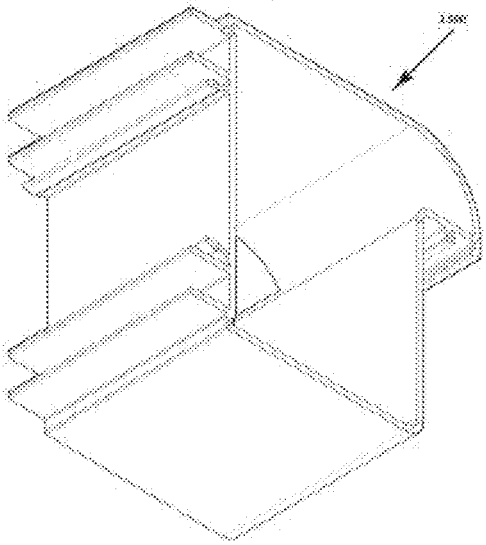
Figure 17A:
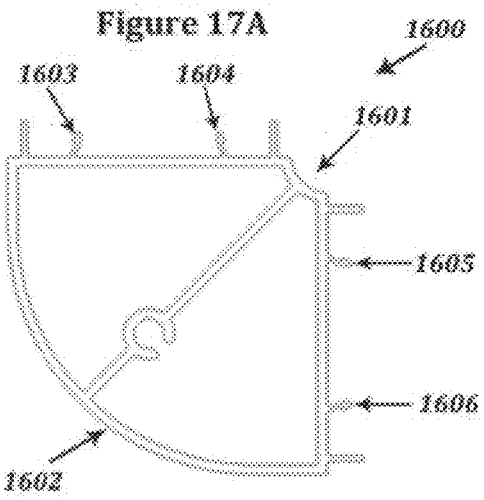
FIGS. 17A and 17B are cross sectional and perspective views of an embodiment of a 90° corner frame member used in the present invention.
Figure 17B:
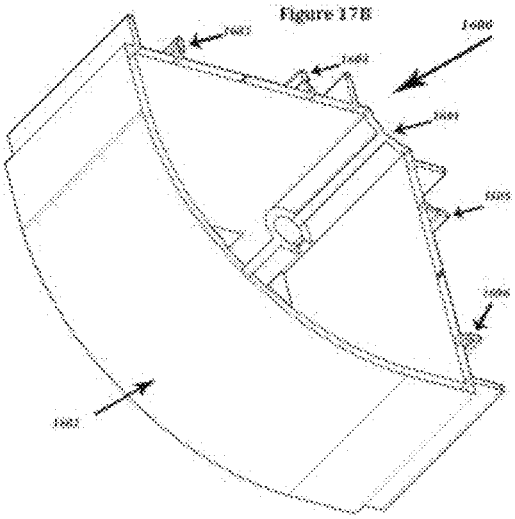
Figure 18A:
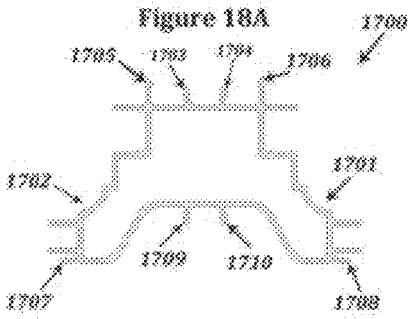
FIGS. 18A and 18B are cross sectional and perspective views of an embodiments of a 3 way corner frame member used in the present invention, which can be doubled up for a 4 way corner.
Figure 18B:
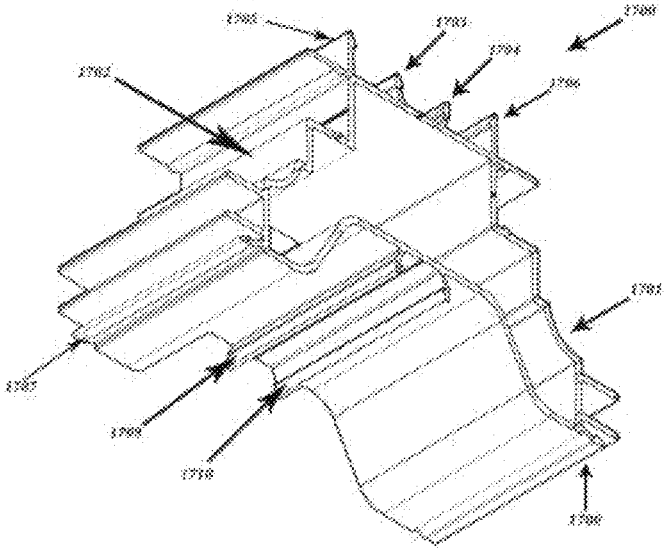

FIGS. 16 to 18 show preferred door and corner embodiments of the present invention. As seen in FIG. 16A, there is provided doorframe member 1500. Doorframe member 1500 allows for installation of various sizes of doors within a Cleanroom. FIGS. 17A and 17B show corner member 1600, which in a preferred embodiment provides for a concave 1601 corner (e.g. a cove) and a convex 1602 corner. Preferably, concave and convex surfaces 1601, 1602 may be used to form a junction between a ceiling and a wall or a wall and a wall, and may be referred to as coving. The coving in corner member 1600 may allow for increased ease of cleaning inside and outside corners, which may be of particular importance in biological and pharmaceutical cleanroom construction. Other embodiments of the present invention provide a three way corner 1700 (see FIGS. 18A and 18B), which allows for a coved inside corner 1701,1702 on side-by-side walls, and if used back to back can create a 4 way corner (not shown). As can be seen from FIGS. 16 to 18, each of door frame member 1500 and corner members 1600, 1700 may be configured with a plurality of locking mechanisms designed to releasable engage corresponding locking mechanisms on other construction members (e.g. 1603, 1604, 1709, 1710, etc). Further embodiments of the corner members are provided in FIGS. 30 and 31. Shown in FIGS. 30A to 30F is an inside corner cove 3000, while FIGS. 31A to 31F provide outside corner cove 3100. The coving in corner member 3000 and 3100 may allow for increased ease of cleaning inside and outside corners, which may be of particular importance in biological and pharmaceutical cleanroom construction. The molded corners allow for a smooth corner which matches to the floor and ceiling cove.

Figure 19A:
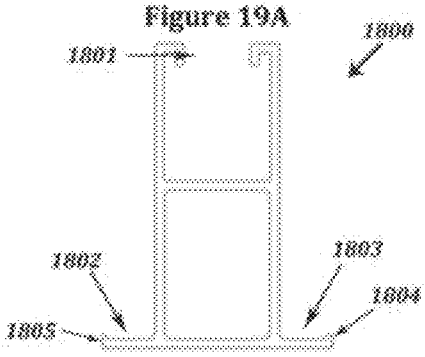
FIGS. 19A to 20B are cross sectional and perspective views of an embodiment of ceiling support members used in the present invention.
Figure 20A:
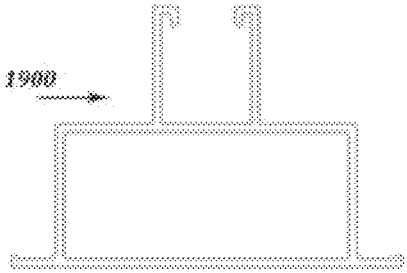
Figure 19B:
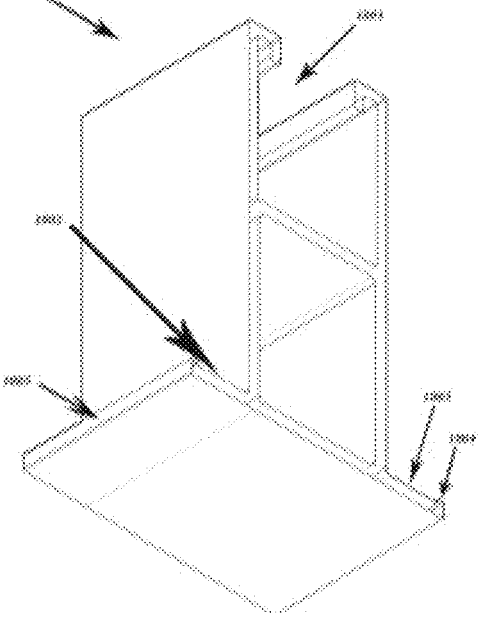
Figure 20B:
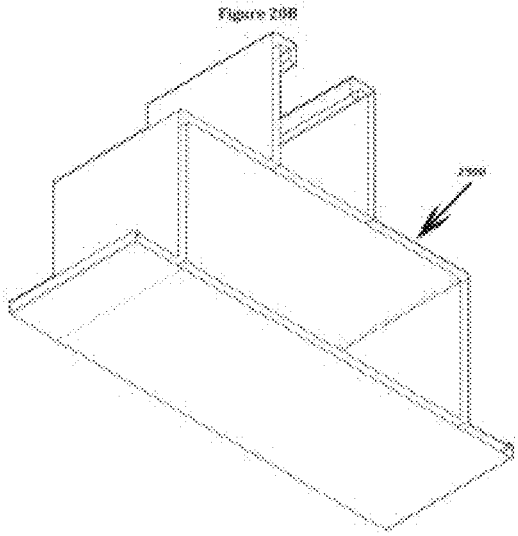
Figure 21A:
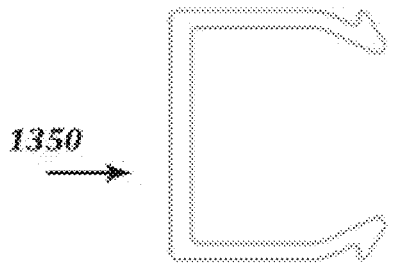
FIGS. 21A and 21B are cross sectional and perspective views of an embodiment of a track cap member which may be used with a track member to fill the void when no batten may be required in the present invention.
Figure 21B:
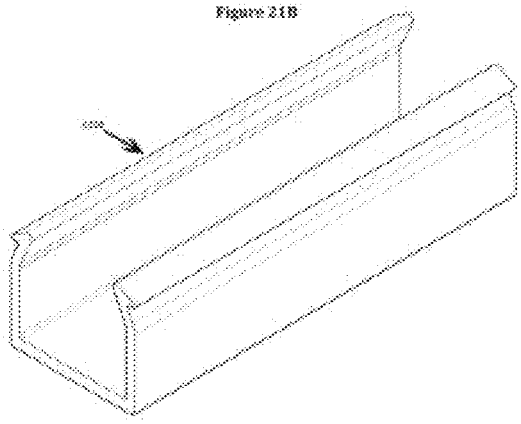
Figure 22A:
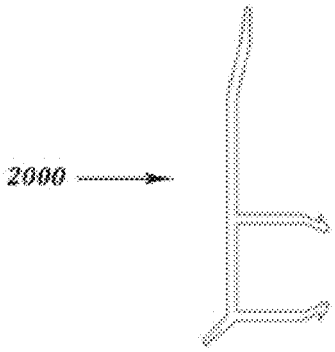
FIGS. 22A to 25B are cross sectional and perspective views of embodiments of batten members used in the present invention.
Figure 22B:
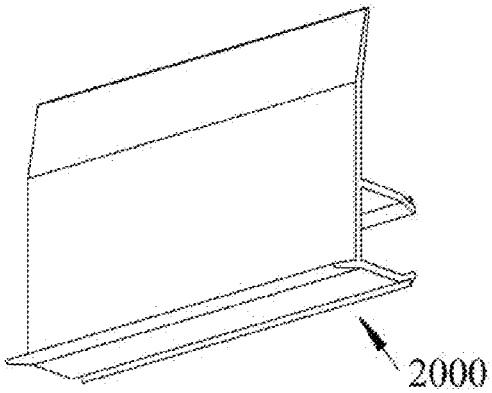
Figure 23A:
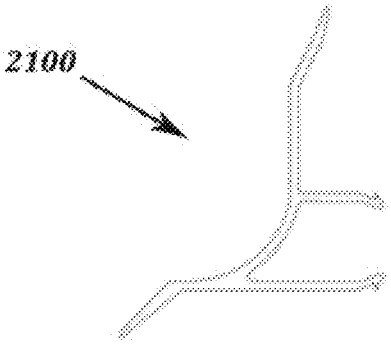
Figure 23B:
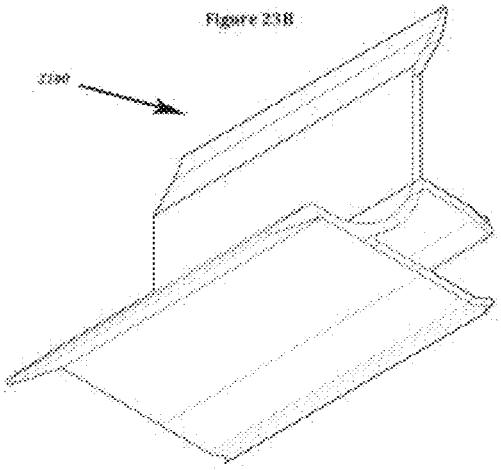
Figure 24A:
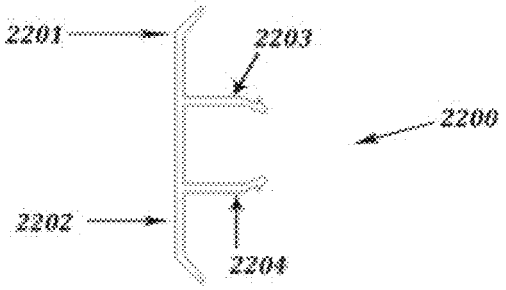
Figure 24B:
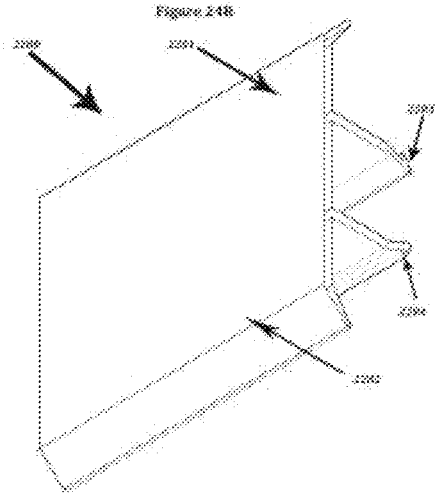
Figure 25B:
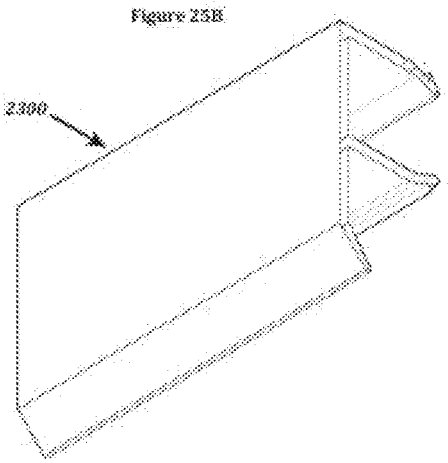
Figure 25A:
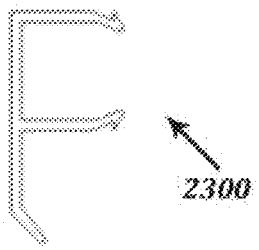
Figure 29B:
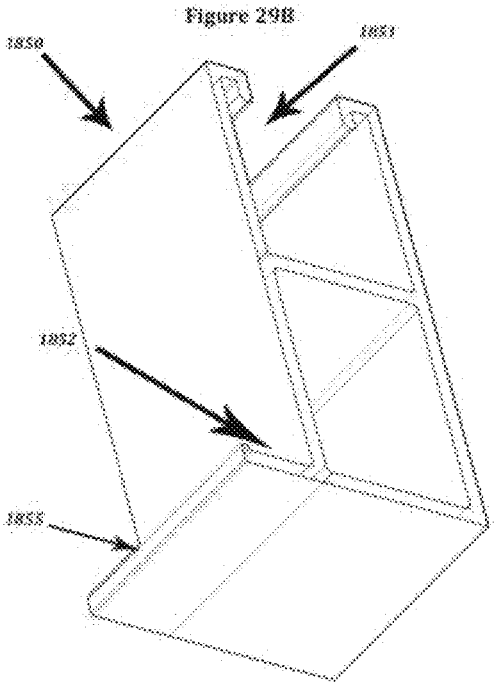
FIGS. 29A and 29B are cross sectional and perspective views of an embodiment of a ceiling support member used in the present invention.
Figure 29A:
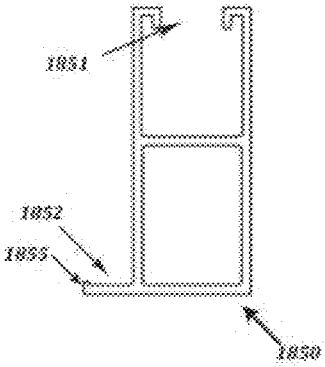
Figure 30A:
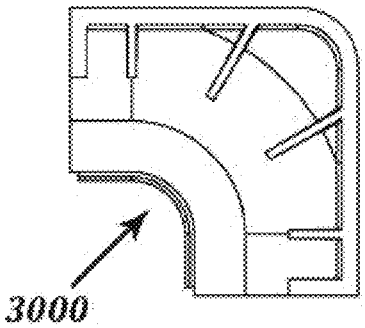
FIGS. 30A to 31F are perspective views of embodiments of corner cove members used in the present invention.
Figure 30B:
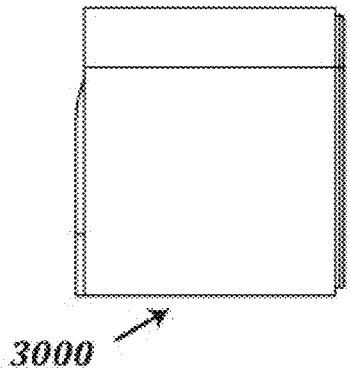
Figure 30C:
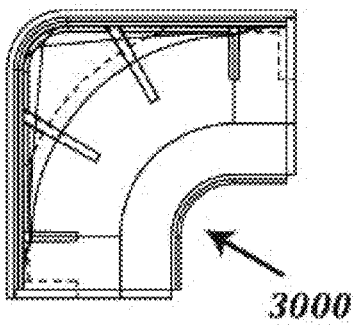
Figure 30D:
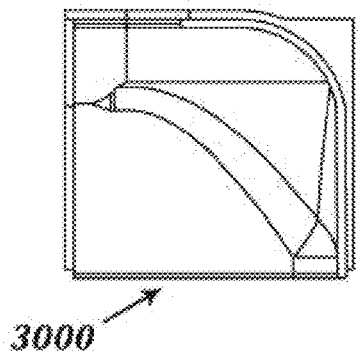
Figure 30E:
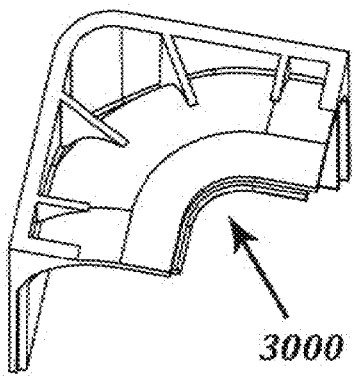
Figure 30F:
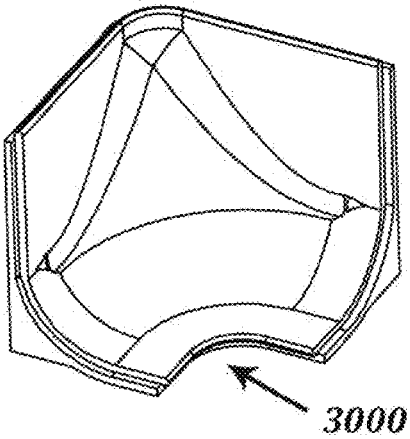
Figure 31A:
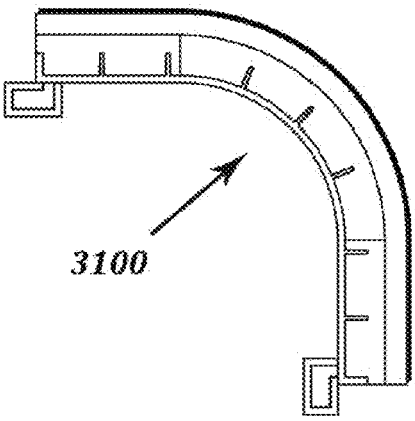
Figure 31B:
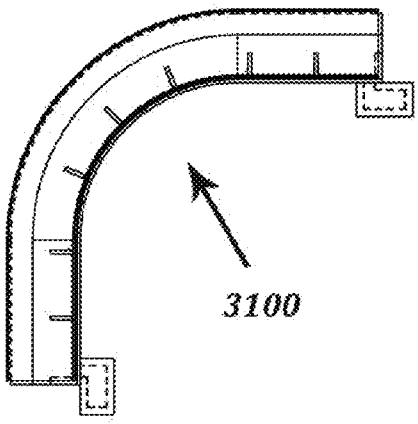
Figure 31C:
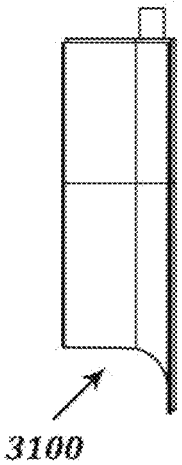
Figure 31D:
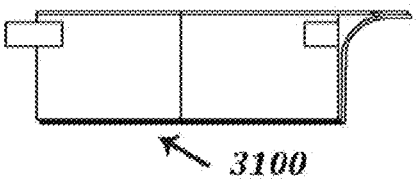
Figure 31E:
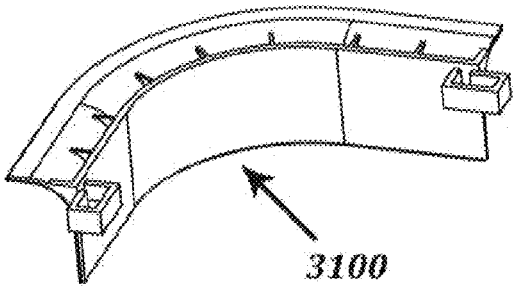
Figure 31F:
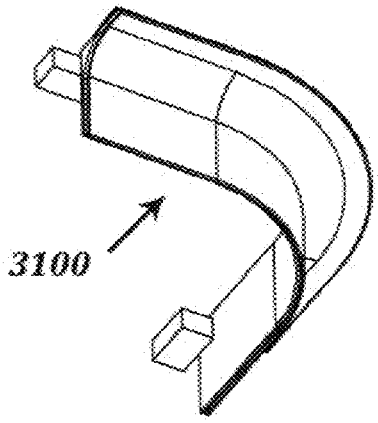

FIGS. 19 and 20 show ceiling members of the present invention. Ceiling member 1800 and 1900 shaped as generally inverted "T"s can be, in a preferred embodiment, hung from the building structure ceiling via engagement end 1801 to form an interstitial space between the ceiling and the building structure. In a preferred embodiment, ceiling member 1800 has two lip extensions 1802 and 1803 for use in securing panel members in a well-known suspension ceiling arrangement. Each extension 1802 and 1803 has a vertically extending tab 1804, 1805 which functions to elevate any construction member (e.g. ceiling panel). In a preferred embodiment, caulking may be provided on extensions 1802 and 1803. The preferred embodiments of the present invention utilize two generally inverted T shaped support members, which when irremovably affixed to the building structure and used in accordance to loading tables known to a person skilled in the relevant art, can be used to support ceiling panels, air filter modules, light fixtures, sprinkler heads, HEPA filtration, mechanical & electrical components and the like (see, for example, FIG. 61B). In a preferred embodiment, ceiling member 1800 has an outer diameter (extending from 1805 to 1804) of approximately 3". There may also be ceiling member 1900, which in a preferred embodiment has an outer diameter (extending from 1805 to 1804) of approximately 6". It will be understood, however that any sized ceiling member which meets the functional requirements of the Cleanroom can be used. As shown in FIGS. 29A and 29B, ceiling support member 1800 and 1900 can be symmetrical or asymmetrical. For example, ceiling support member 1850 has a single lip extension 1852 for use in securing panel members in a well-known suspension ceiling arrangement. Extension 1852 has a vertically extending tab 1805 which functions to elevate any construction member (e.g. ceiling panel).

FIGS. 22 to 25 show preferred batten members of the present invention. The types of battens used in the individual clean rooms may be dictated by the function of the clean room but all embodiments have in common the formation of a tight seal between two other construction members, without the requirement for caulking. In a preferred embodiment, batten members of the present invention secure construction members (e.g. wall panel members) to the other construction members (e.g. stud members) in which they are engaged. Batten members also serve to provide a nearly seamless connection between construction members so as to provide ease of cleaning. In a preferred embodiment, there may be provided track batten 2000, which is preferably a co-extruded PVC batten member, which can be used in electronics type Cleanrooms. In another preferred embodiment, there may be a coved track batten member 2100, which is preferably a co-extruded PVC batten member, which can be used in pharmaceutical and biological containment Cleanrooms. As shown in FIGS. 24A, 24B and 25A, 25B, batten members 2200 and 2300 can be symmetrical or asymmetrical. As seen in FIG. 24A, batten member 2200 may be provided with flange members 2201 and 2202, which are adapted for engaging a construction member (e.g. a wall panel member) to securely engage the construction member. As shown in FIGS. 45B and 46B, for example, each of batten members 2200 engage with corner member 1700 and wall panel 125 so as secure wall panels 125 in the frame construction. As shown in FIGS. 36 to 40, preferred batten members are provided. As can be seen from FIGS. 22 to 25 and 38 to 40, each of the batten members of the present invention are configured with a plurality of locking mechanisms (e.g. 2203 and 2204 as seen in FIGS. 24A and 24B) designed to releasable engage corresponding locking mechanisms on other construction members.

Figure 26B:
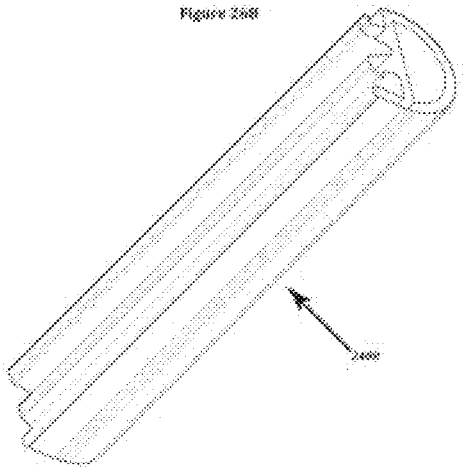
FIGS. 26A and 26B are cross sectional and perspective views of an embodiment of a door sealing or gasket member used in the present invention.
Figure 26A:
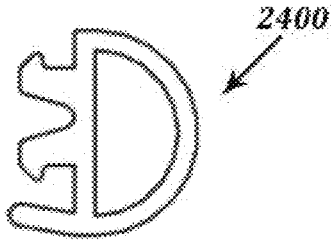
Figure 48A:
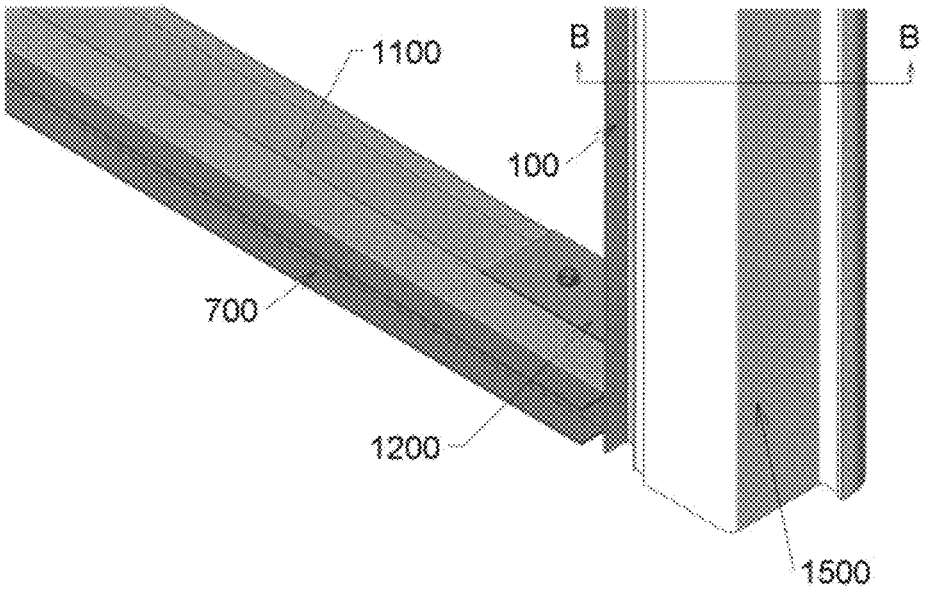
Figure 48B:
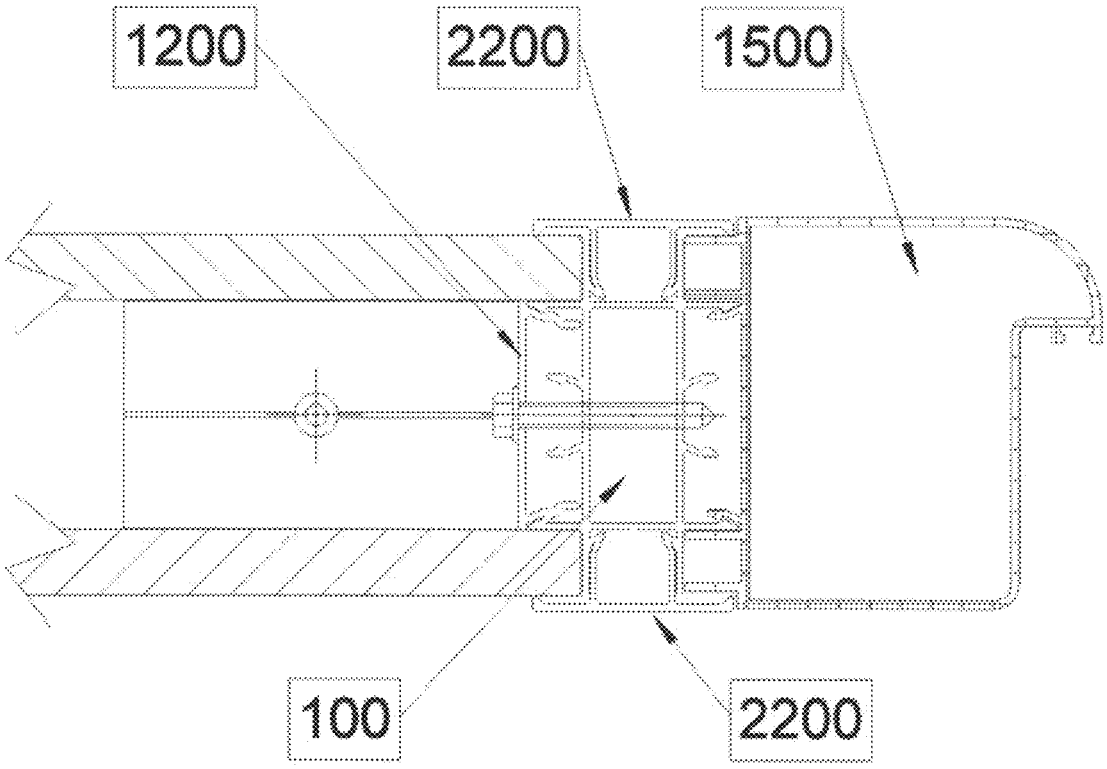
Figure 48C:
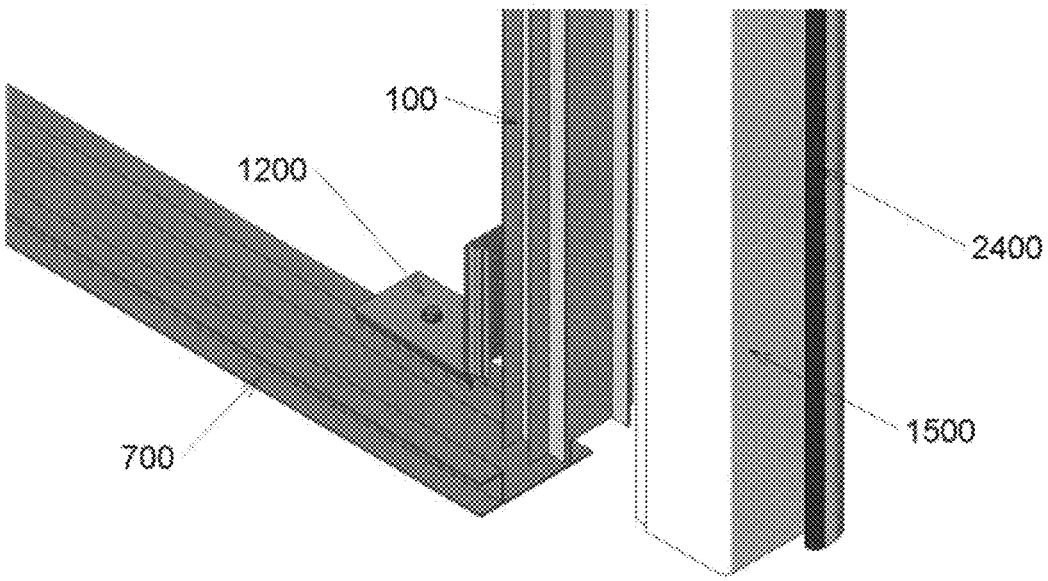

As shown in FIGS. 26A and 26B, there is provided door sealing or gasket member 2400 that may be used with the door frame 1500 to seal against air leakage (see FIG. 48C).

Figure 27A:
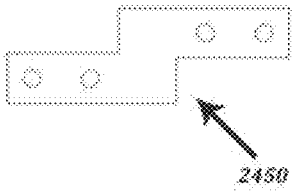
FIGS. 27A and 27B are cross sectional and perspective views of embodiments of bracket member used in the present invention.
Figure 27B:
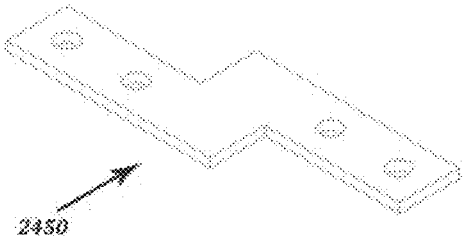

As shown in FIGS. 27A and 27B, there is shown a Z-bracket member that functions to secure construction members.

Figure 28A:
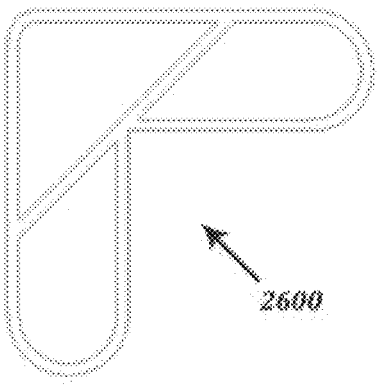
FIGS. 28A and 28B are cross sectional and perspective views of an embodiment of a bracket member used in the present invention.
Figure 28B:
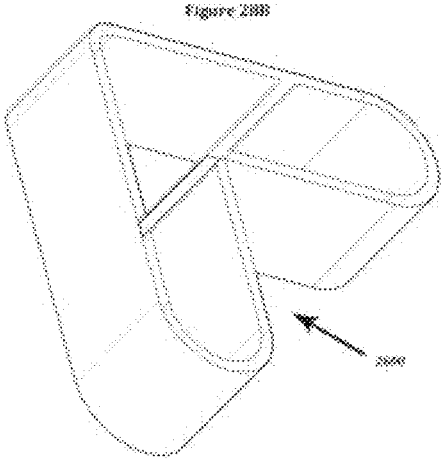

As shown in FIGS. 28A and 28B, there is provided door corner bracket 2500, which may be used to hold the 45° corner of the doorframe securely in position.

Figure 32A:
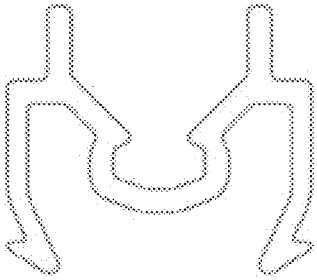
FIGS. 32A to 33B are cross sectional and perspective views of embodiments of a rolled panel snap insert, and a rolled panel snap batten used in the present invention.
Figure 32B:
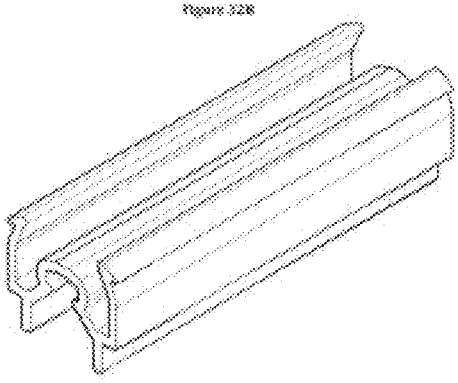

FIGS. 32A to 32B provide snap panel inserts used in the present invention to allow for a non batten method of securing wall panels to construction members. The panel has a roll formed edge which snaps into the insert, holding the panel securely.

Figure 33A:
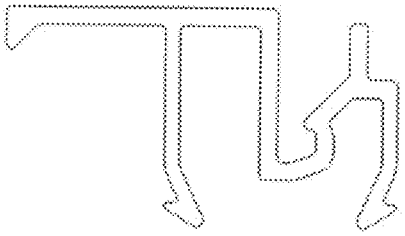
Figure 33B:
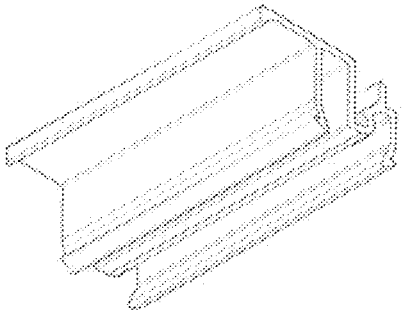

FIGS. 33A and 33B are cross sectional and perspective view of embodiments of the snap panel Batten which may be used to secure a panel with the roll formed edge on one side and acting as a batten on the opposite side, as used in corners, and at doors.

Figure 34A:
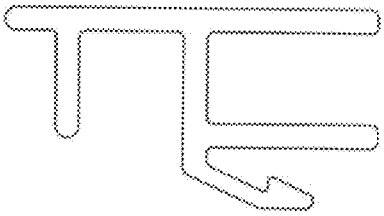
FIGS. 34A and 34B are cross sectional and perspective views of embodiments of an insert to allow the use of ¼" panels used in the present invention.
Figure 34B:
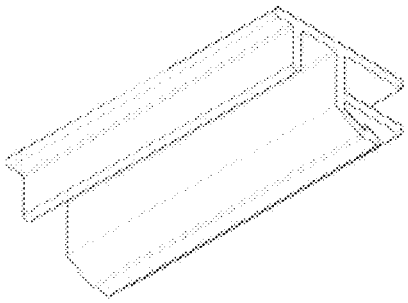

FIGS. 34A and 34B are cross sectional and perspective views of embodiments of ¼" panel insert, which will allow the members of the present invention to utilize a ¼" panel instead of the standard ½" panel.

Figure 35A:
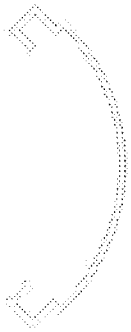
FIGS. 35A and 35B are cross sectional and perspective views of embodiments of a 90° outside corner that inserts into studs used in the present invention.
Figure 35B:
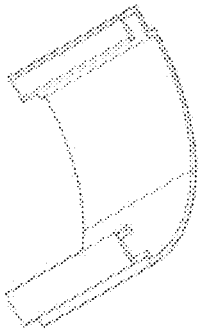
Figure 36A:
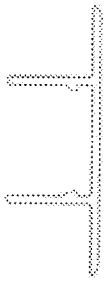
FIGS. 36A to 37B are cross sectional and perspective views of embodiments of members that may be used with existing walls to fasten panels, and match stud and track of in the present invention.
Figure 36B:
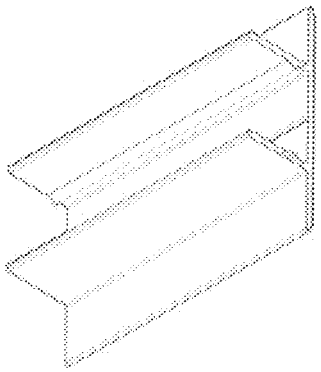
Figure 37A:
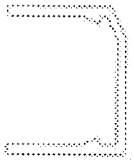
Figure 37B:
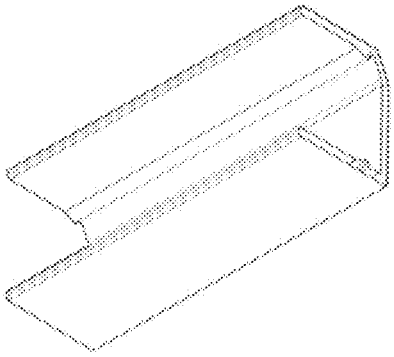
Figure 38A:
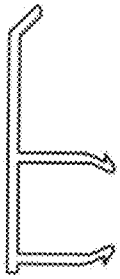
FIGS. 38A to 40B are cross sectional and perspective views of embodiments of batten members used in the present invention.
Figure 38B:
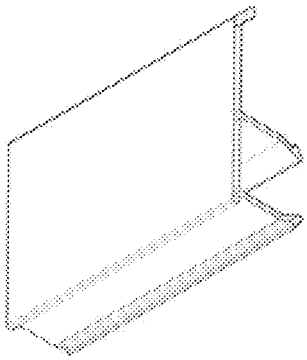
Figure 39A:
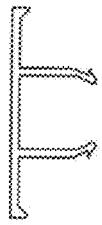
Figure 39B:
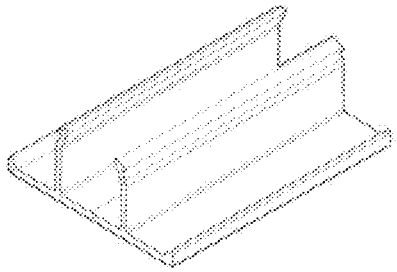
Figure 40A:
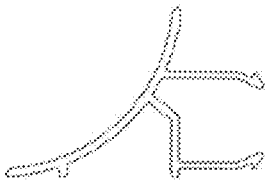
Figure 40B:
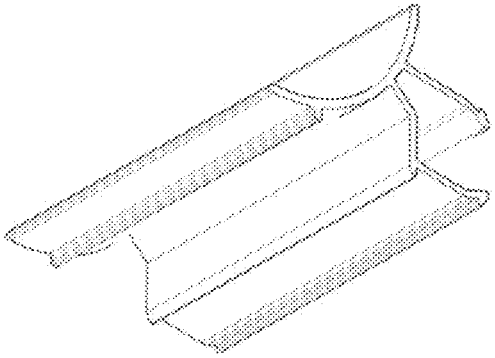

FIGS. 35A and 35B are cross sectional and perspective views of embodiments of an outside corner extrusion used in the present invention.

It will be understood that with the use of wall panels of existing configurations, demountable cleanrooms can be produced using the construction members of the present invention. It will also be understood by a person skilled in the art that the construction members of the present invention can be assembled together to create any number of combinations of Cleanroom configurations. FIGS. 41 to 61 show the construction members of the present invention assembled into various configurations. Using the configurations possible with the various construction members, it may be possible to construct a Cleanroom within a predefined space quickly and easily. It may be also easier than existing Cleanroom systems to adjust the design should the circumstances in which the Cleanroom was initially constructed should change. It will also be understood by a person skilled in the relevant art that the invention is not limited to configurations set out herein. The present invention provides a system that does not require precise preplanning, as other wall systems, which once installed, do not allow modification or adjustment. The modular system of the present invention is intrinsically a flexible system such that it may be possible to change the Cleanroom layout before, during, and after assembly. In the case of existing Cleanrooms, it may be possible to use the present invention in whole or in part. It will be understood by a person skilled in the relevant art that individual embodiments of the present invention can be used with preinstalled or preexisting systems and/or equipment.

As shown in FIG. 41A to 41C, there is provided the upper interior of a two way corner, with two attached studs 100 attached to track member 800 at the ceiling, which have inserted H brackets 1100, and secured in place with L-brackets 1200. L-Brackets are then secured in place with fixing members, preferably self-tapping screws, more preferably TEK screws No. 10. It will be understood, however, that any suitable fixing members could be used such as screws, nails, etc. It will be understood that traditional nuts and bolts used in the construction of other Cleanrooms are not required in the current invention. This provides for a simple mounting and demounting of the system of the present invention.

Shown in FIGS. 41B and 41C is a cross sectional and exploded view, respectively of the assembled construction members. As shown in FIG. 41B, the locking mechanism comprising an interlocking snap configuration provides a universal connector for the components of the system of the present invention. The secured engagement of, for example, stud member 100 to L-bracket 1200 and corner frame member 1600 allows for quick connection and quick release of the different construction members. It will be understood that by explaining one set of connections, all other connections will be understood.

Releasable snap connectors 105 and 108 of stud member 100 have a unidirectional engagement member adapted to engage or mate with the releasable snap connectors 1605, 1603 and 1604,1606 on corner frame member 1600. The releasable snap connectors 105,108 and 1603,1604, for example, when in mating engagement, are opposingly oriented (e.g. oriented in opposite directions) along a linear plane of movement, which corresponds to the vertical or z-axis, so as to secure stud 100 and corner frame 1600 along the linear plane of movement of the vertical or z-axis. In order to engage the snap connectors, pawl member 1605, biased in a resting first configuration, may be moved when forced is applied to it by pawl member 105 moving towards corner frame member 1600, so as to move pawl 1605 towards a second extended configuration. When pawl 1605 is biased towards the second position (e.g. by the force applied by pawl 105), pawl 1605 resists the applied force. Once the force is released (when pawl 105 no longer engages pawl 1605), pawl 1605 returns to the first resting configuration. Concurrently, pawl 105 travels against pawl 1605 pushing pawl 1605 to the second extended configuration until pawl 105 clears pawl 1605 at which time, the force is released and pawl 1605 returns to the first configuration. It will be understood that as pawl 1605 is based to the second position, as will be pawl 105; as pawl 1605 is released, so is pawl 105. So long as pawl 105 travels in a first direction along the linear plane, pawl 1605 allows pawl 105 to travel until the pawls are no longer biases towards the second position. In other words, pawl 1605 fits into or engages with pawl 105 and therefore pawl 105 can only travel freely in the first direction along the liner plane (e.g. z-axis) thus forming a semi-rigid connection. Once the force is taken away, the pawl members return to their first position such that they can engage with each other. In order to release the snap connector, the construction member 100 and 1600 can be moved along the y-axis so as to release the engagement of pawl members 105 and 1605 and 108 and 1606. Once the pawl members have been released, the construction members 100 and 1600 can be separated. It will be understood that having a plurality of releasable connectors allows for secure attachment of construction members but this secure attachment can be released with the application of sufficient force perpendicular to the linear plane of movement in order to release the pawl members.

It will also be understood that a variety of construction members can be secured using the releasable snap connectors or locking mechanism of the present invention. For example, in FIG. 41B, there is provided two batten members 2200. The locking mechanism of each batten member 2200, namely 2203 and 2204 securely but releasably engage with locking mechanisms 109 and 110 of stud member 100.

Figure 42A:
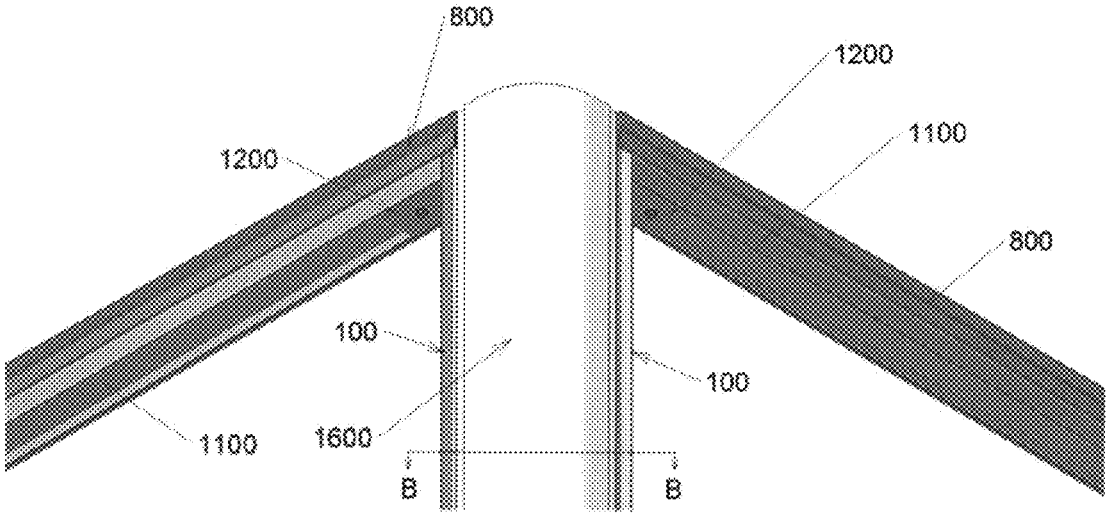
Figure 42B:
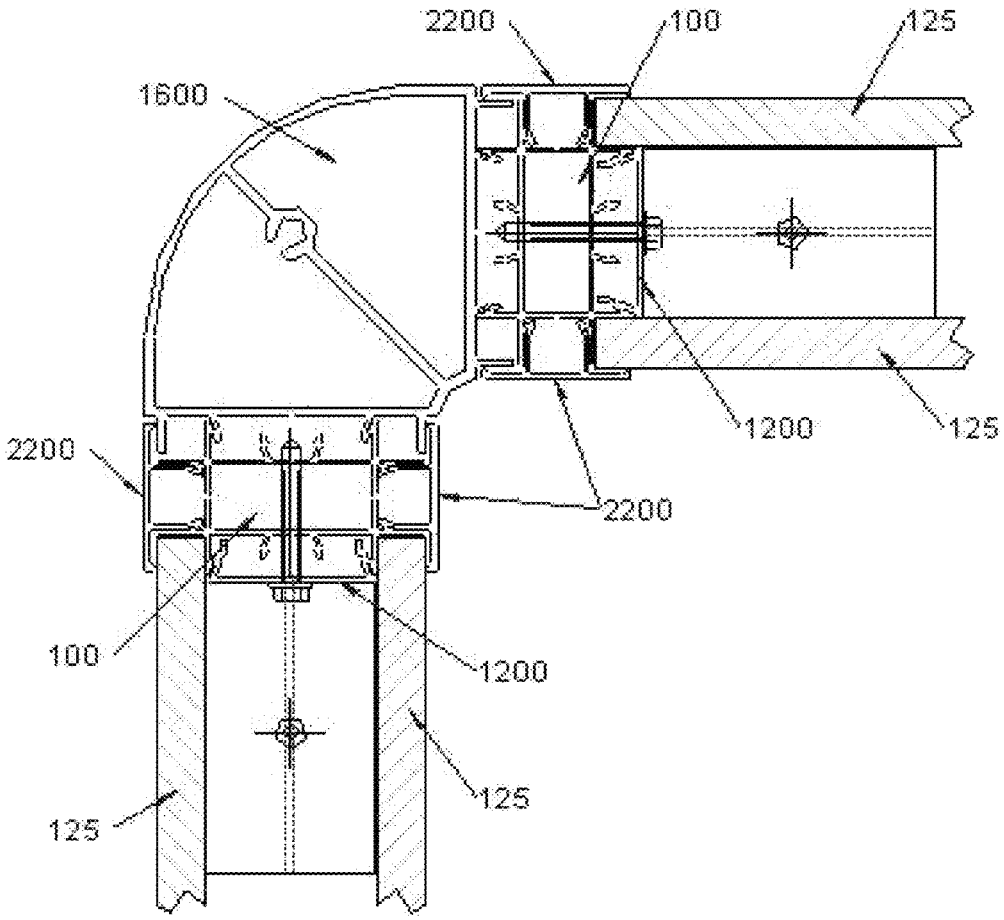
Figure 42C:
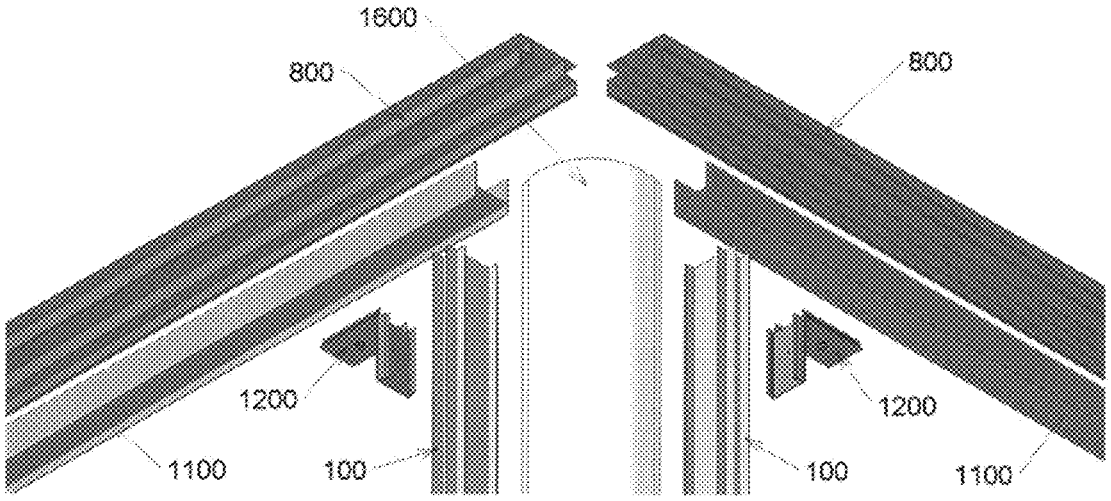

As shown in FIG. 42A to 42C, the upper exterior of the two way corner provided in FIG. 41 is shown. Similar to the configuration provided in FIGS. 41A to 41C, the embodiment in FIG. 42 is the upper exterior representation rather than interior representation. Two attached studs 100 attached to track member 800 at the ceiling, which have inserted H brackets 1100, and secured in place with L-brackets 1200. Shown in FIGS. 42B and 42C is a cross sectional and exploded view, respectively of the assembled construction members from an exterior perspective.

Figure 43A:
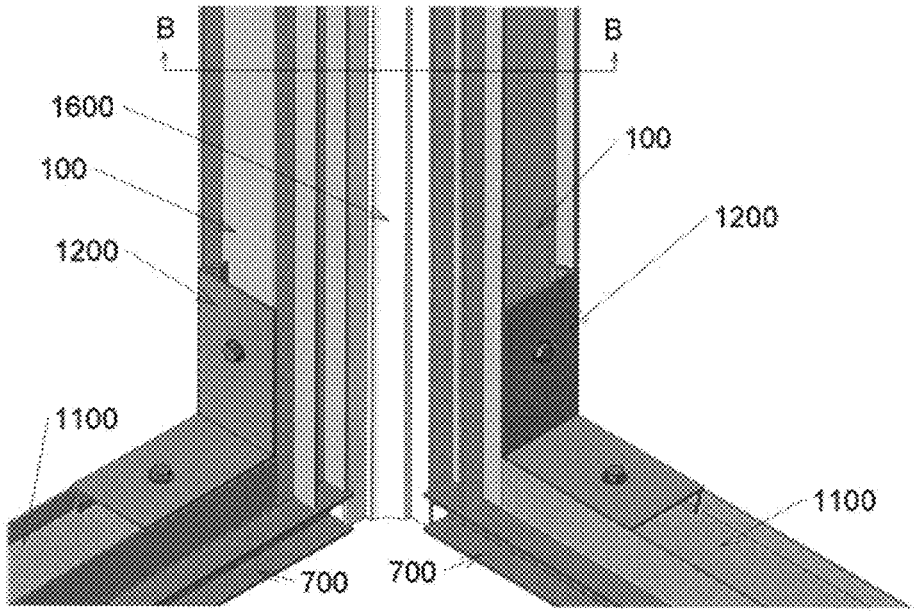
Figure 43B:
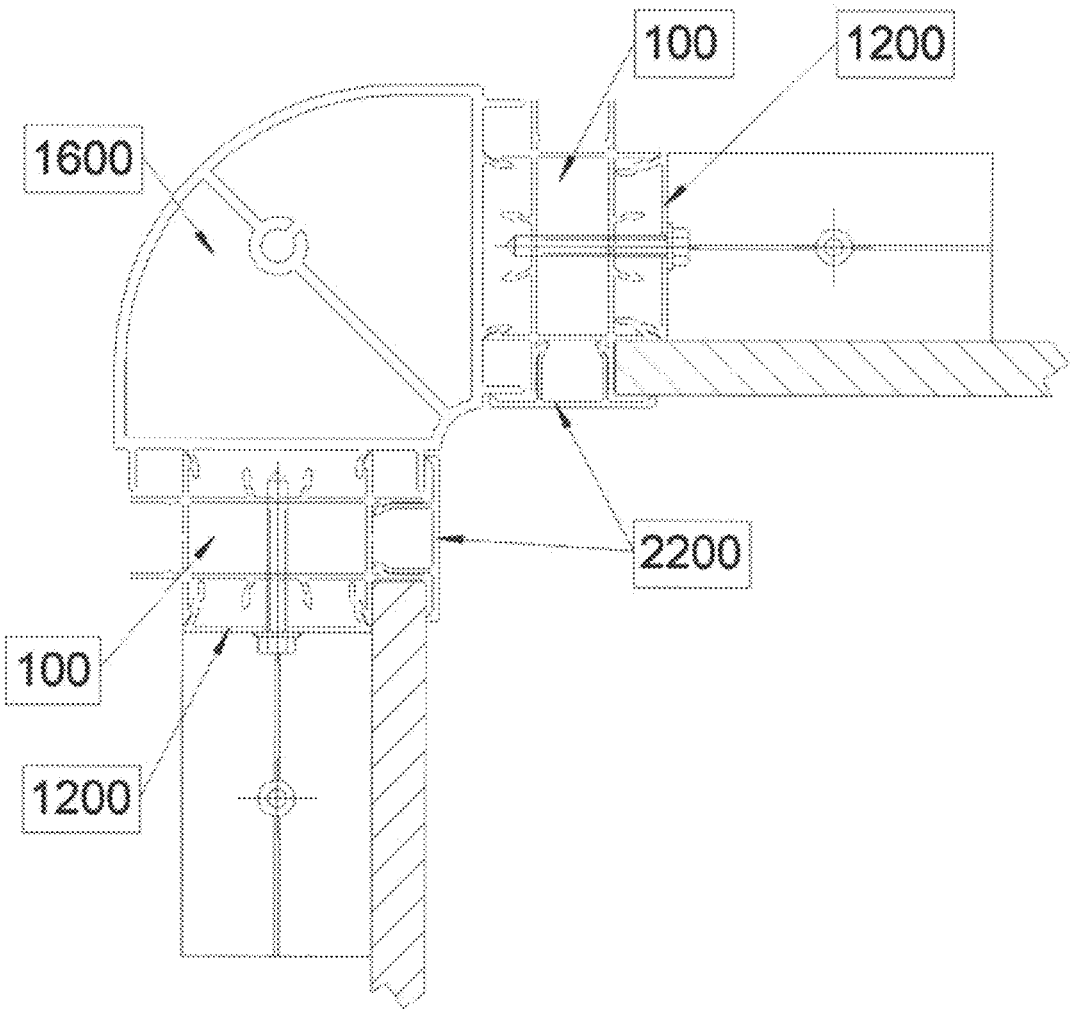
Figure 43C:
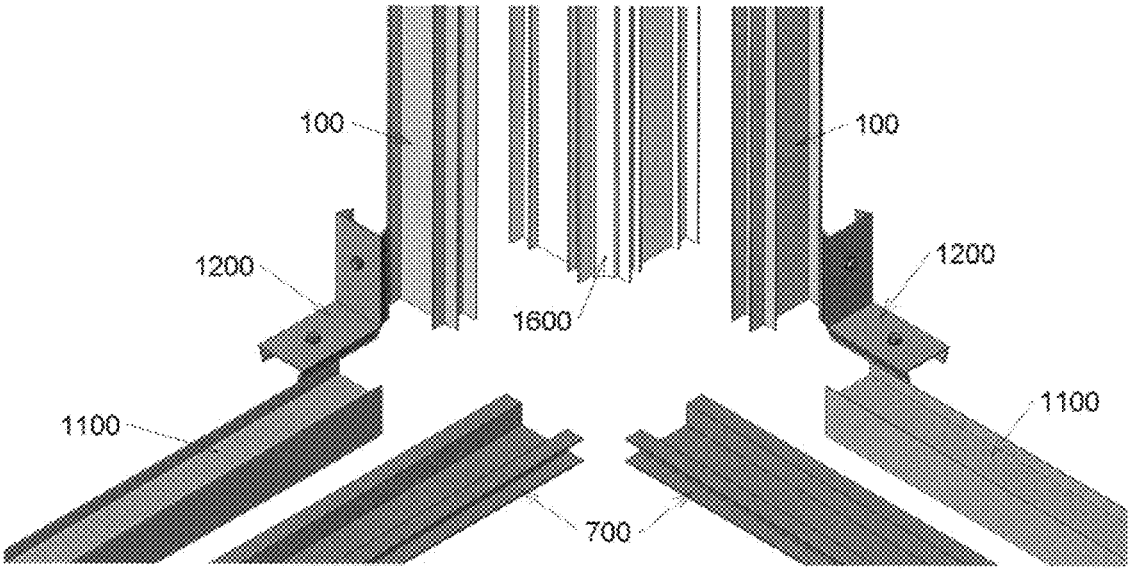
Figure 44A:
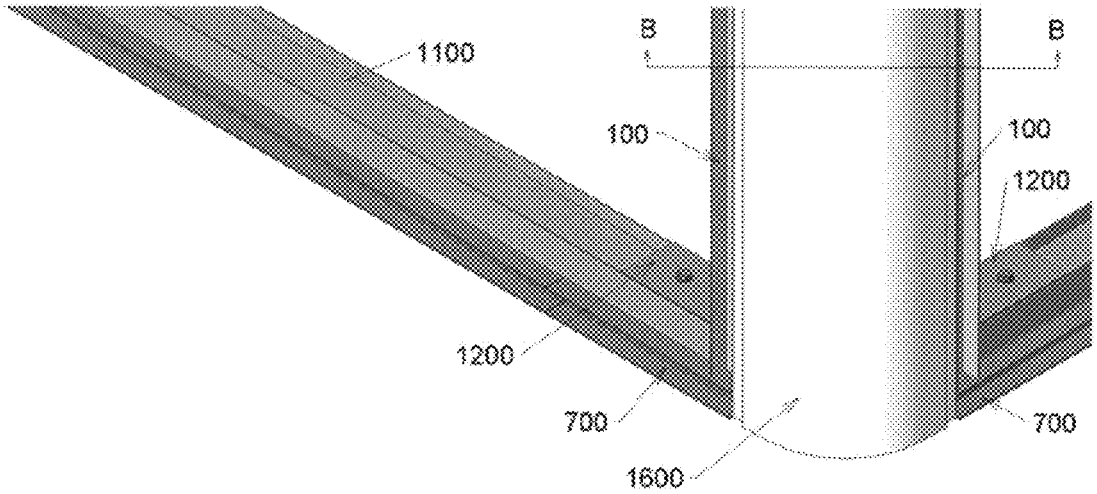
Figure 44B:
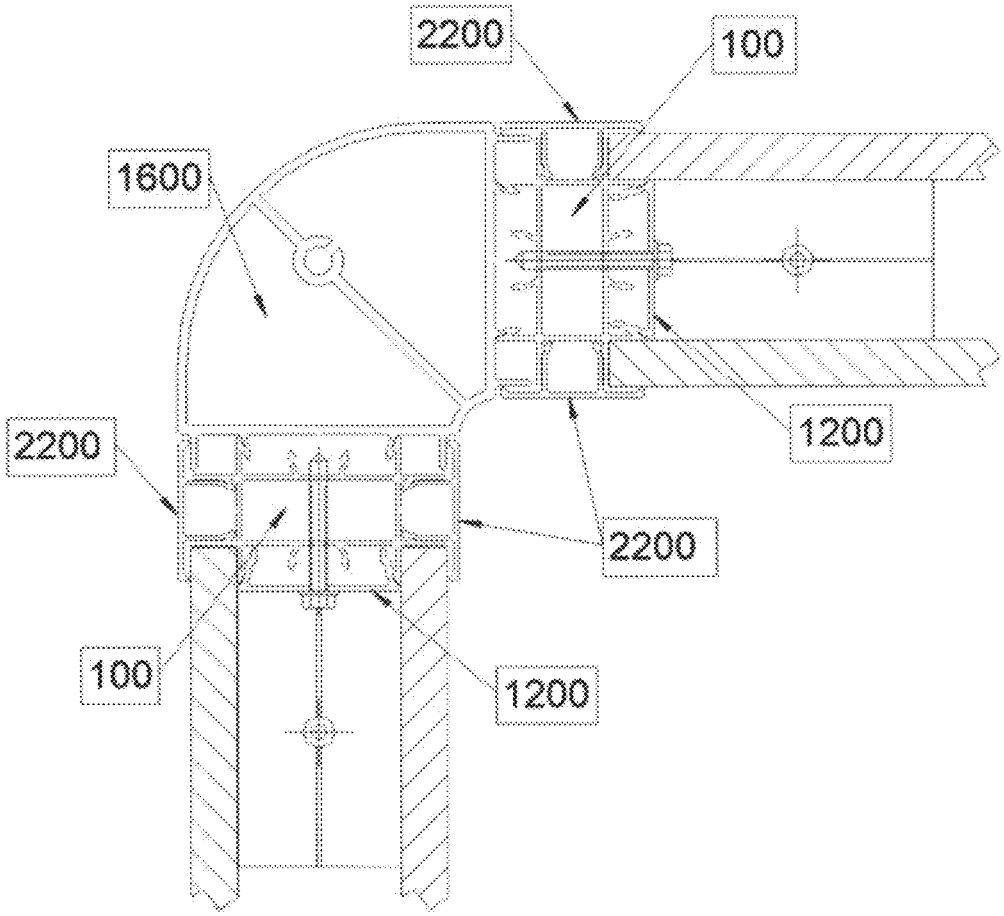
Figure 44C:
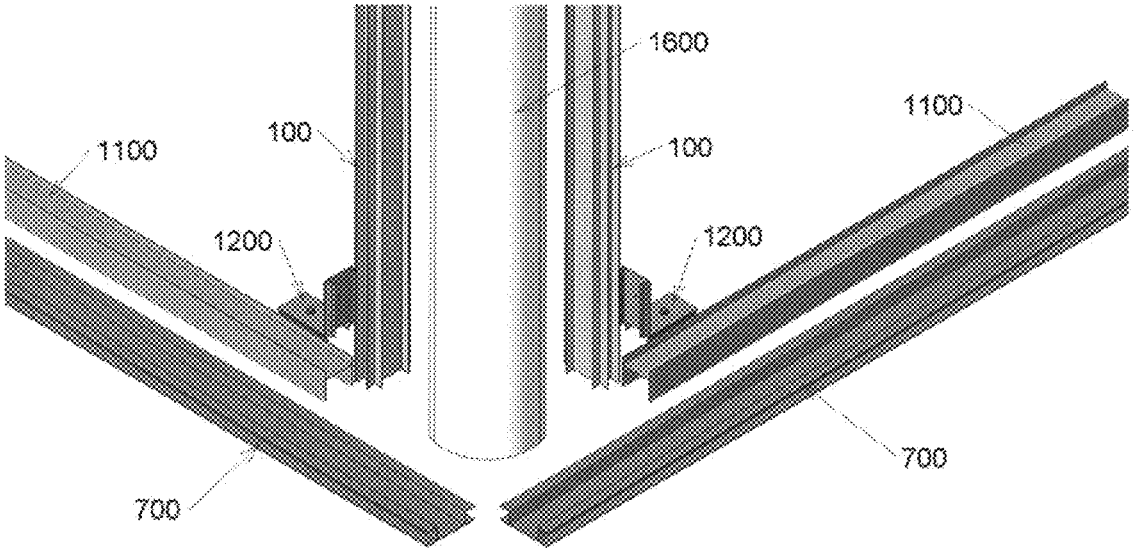

As shown in FIG. 43A to 43C, there is provided the lower interior view of the two way corner. Similar to the configuration provided in FIGS. 41 and 42, the embodiment in FIG. 43 is the lower interior representation of the embodiment. Two attached studs 100 attached to track member 700 at the floor, which have inserted H brackets 1100, and secured in place with L-brackets 1200. Shown in FIGS. 43B and 43C is a cross sectional and exploded view, respectively of the assembled construction members from the lower outside perspective. As shown in FIG. 44A to 44C, the lower exterior of the two way corner is provided.

Figure 45A:
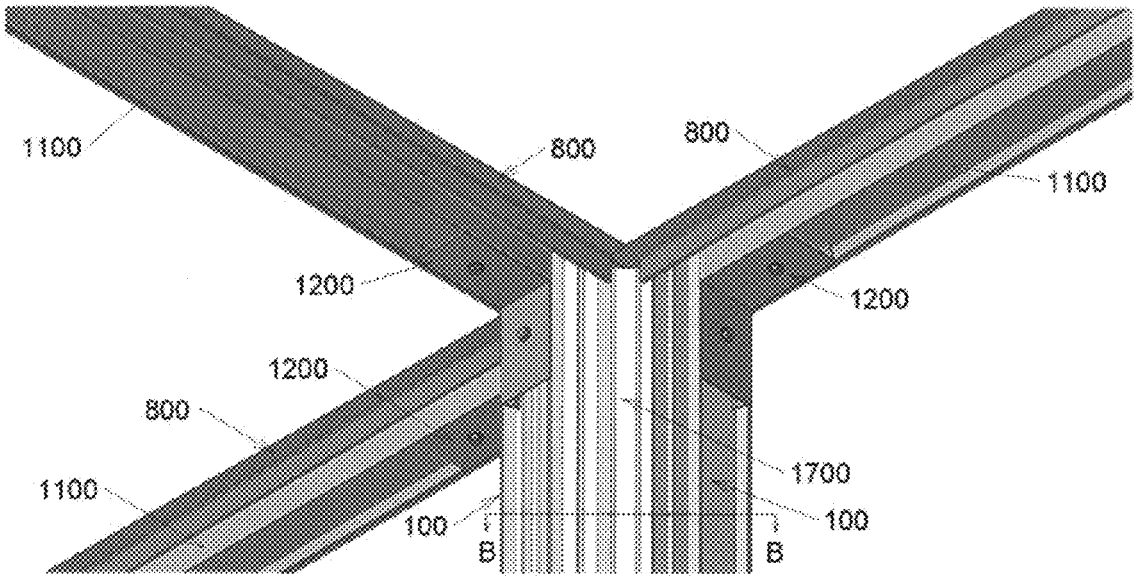
Figure 45B:
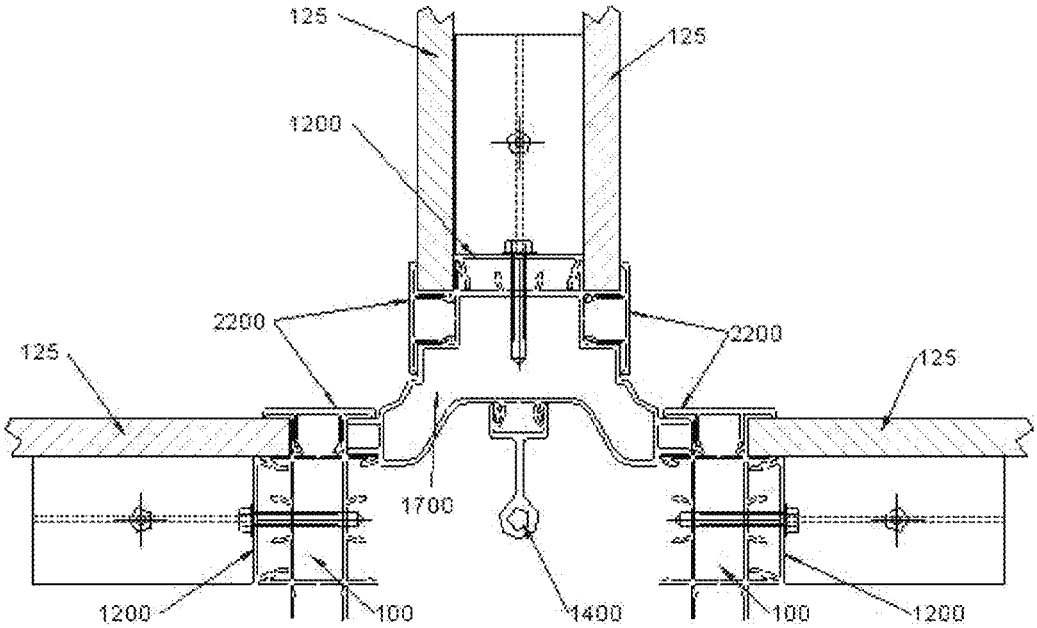
Figure 45C:
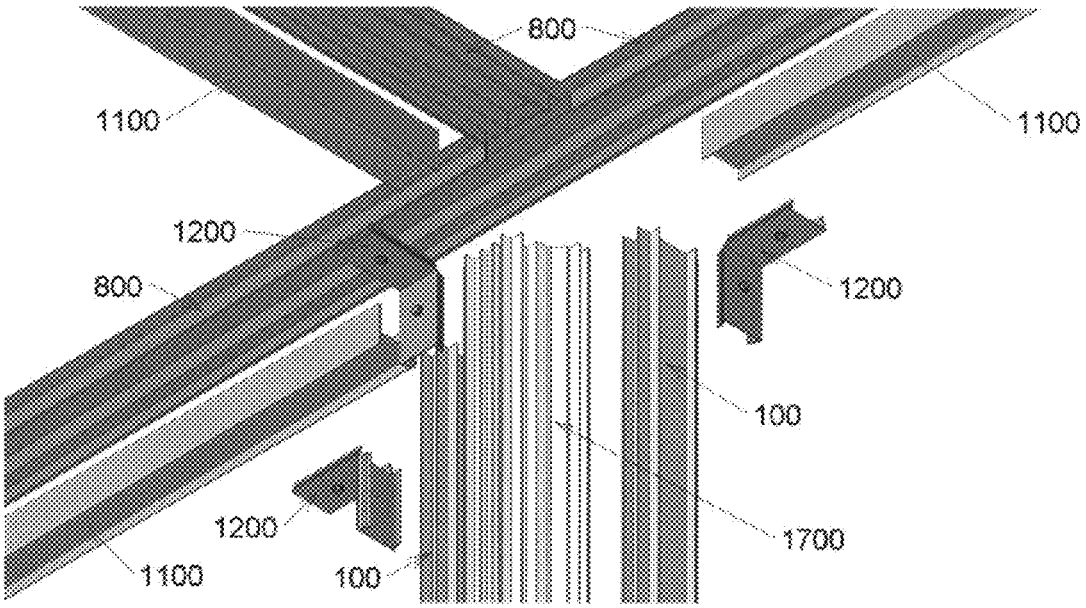

Shown in FIG. 45A to 45C is the upper interior perspective view of a three way corner, with wall panels 125 two stud members 100 attached to ceiling track 800 wherein H-brackets 1100 are inserted and secured in place with L-brackets 1200. Shown in FIGS. 45B and 45C is a cross sectional and exploded view, respectively of the assembled construction members. As can be seen from FIG. 45B, there are two single wall constructions and one double wall construction.

Figure 46A:
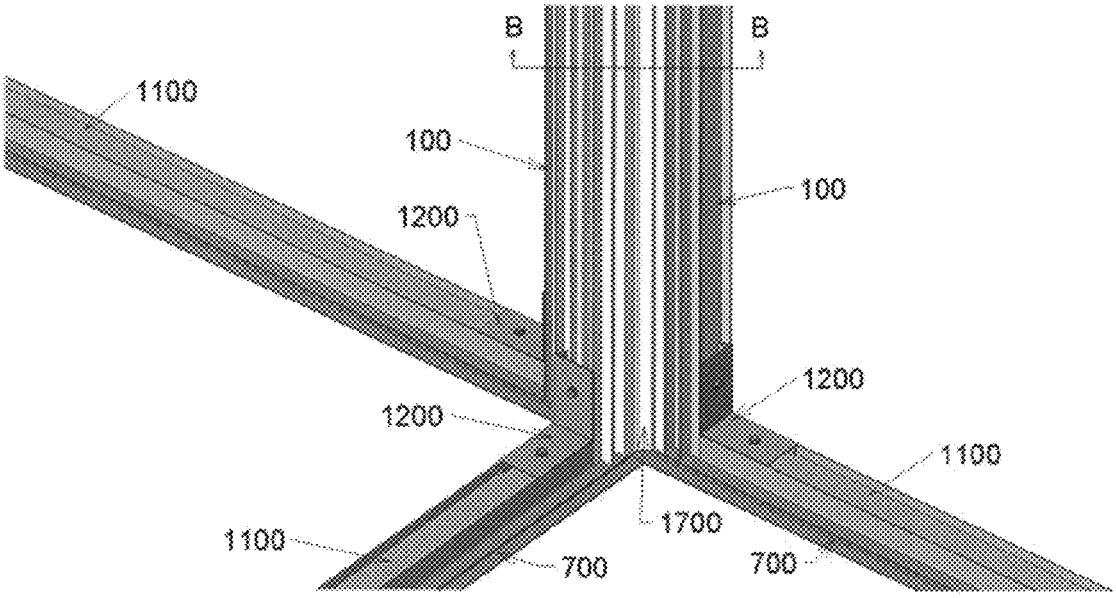
Figure 46B:
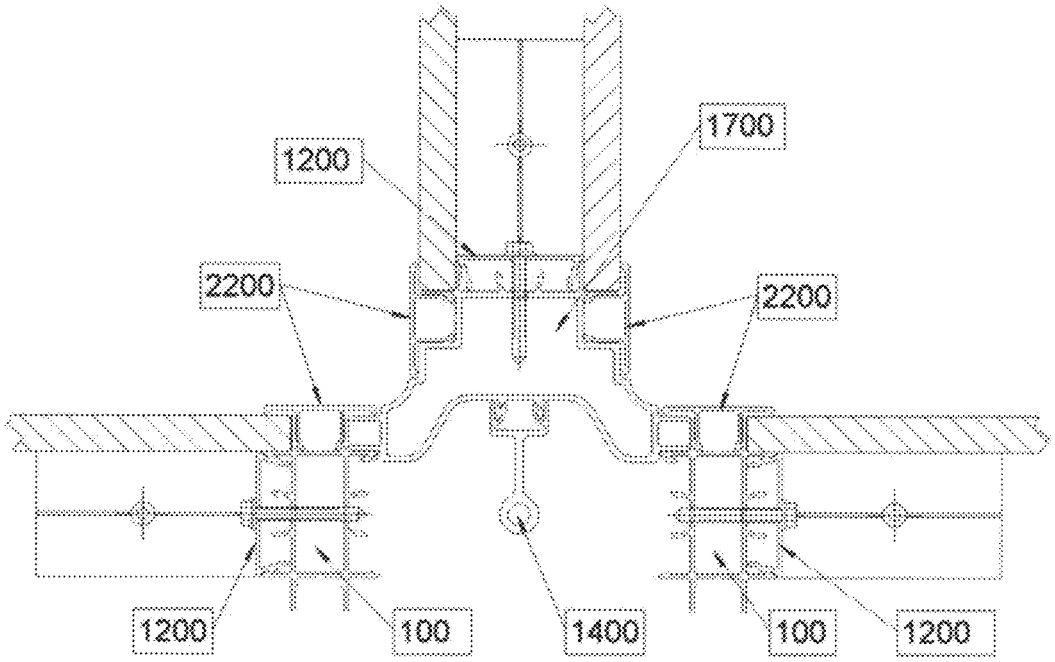
Figure 46C:
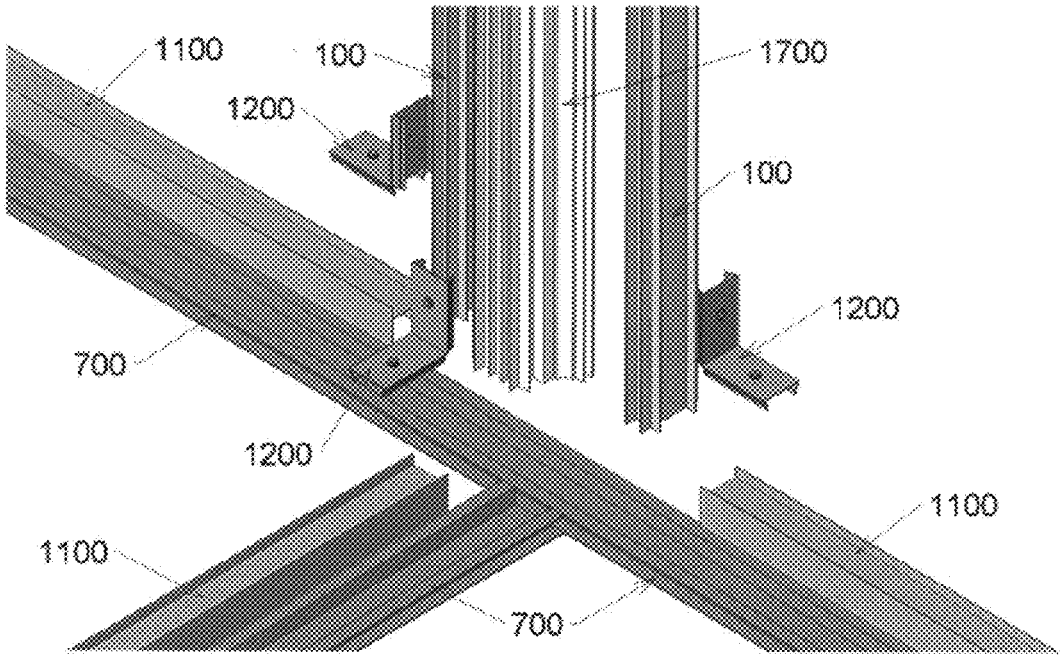

As shown in FIG. 46A to 46C, the lower interior of the three way corner of FIG. 45 is provided, similar to the configuration provided in FIGS. 45A to 45C, the embodiment in FIG. 46 is the inside lower representation of the embodiment. Three attached studs 100 attached to track member 700 at the floor, which have inserted H brackets 1100, and secured in place with L-brackets 1200. Shown in FIGS. 46B and 46C is a cross sectional and exploded view, respectively of the assembled construction members from the insider perspective.

Figure 47A:
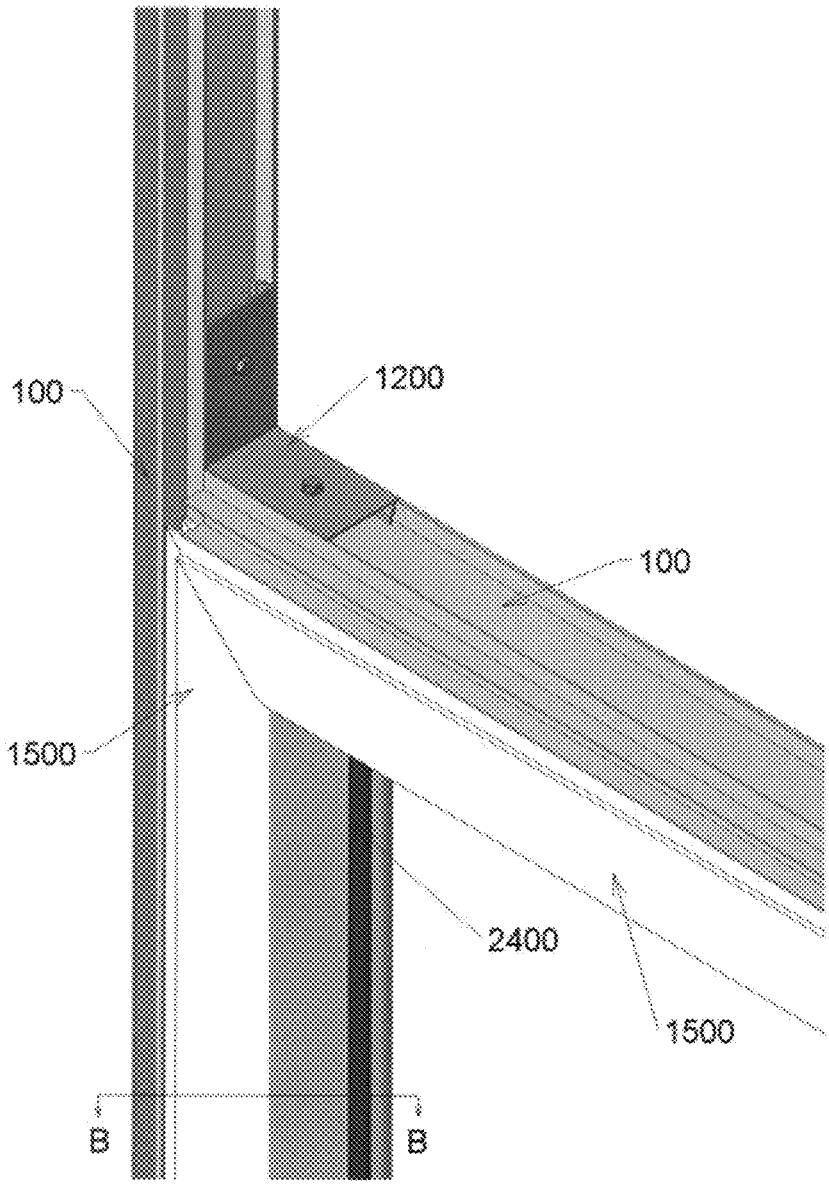
Figure 47B:
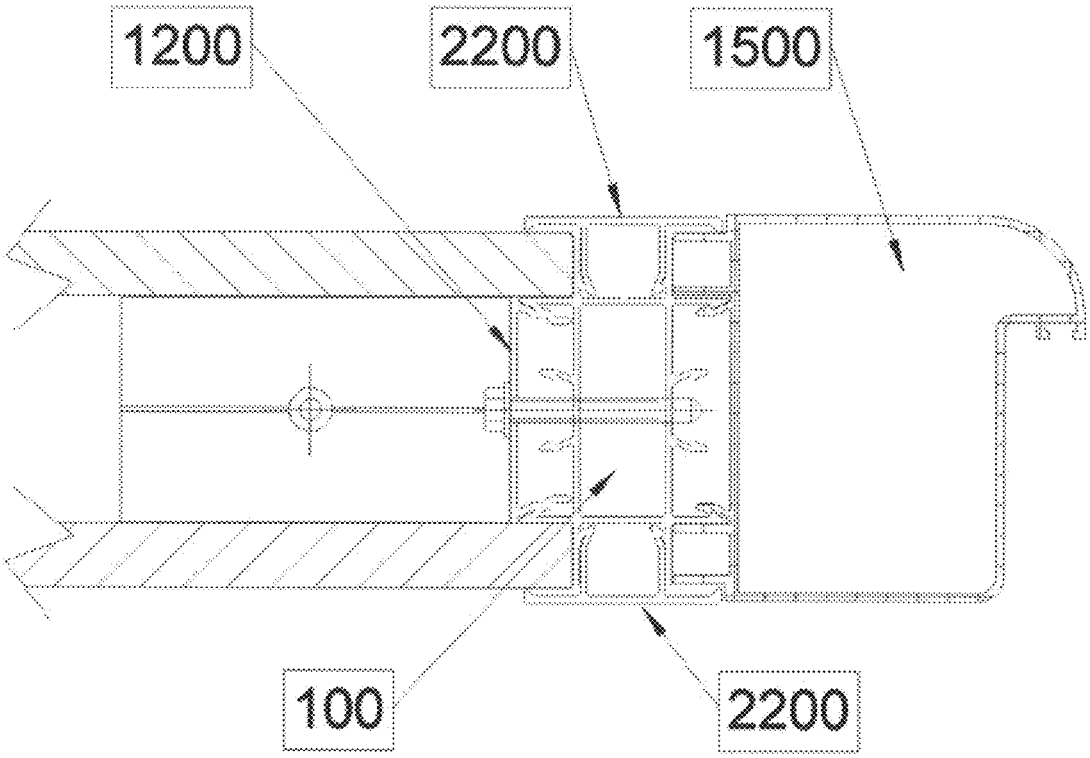

FIGS. 47A and 47B show a view of an upper corner of a doorframe using door frame member 1500, with two studs members 100 (one of which is a cross member) and secured in place with L-Brackets 1200. As shown in FIGS. 48A to 48C is the lower corner of a doorframe using doorframe member 1500, with attached stud 100 and secured at the bottom to track member 700 and H-Bracket 1100 and secured in place with L-Brackets 1200.

Figure 47C:
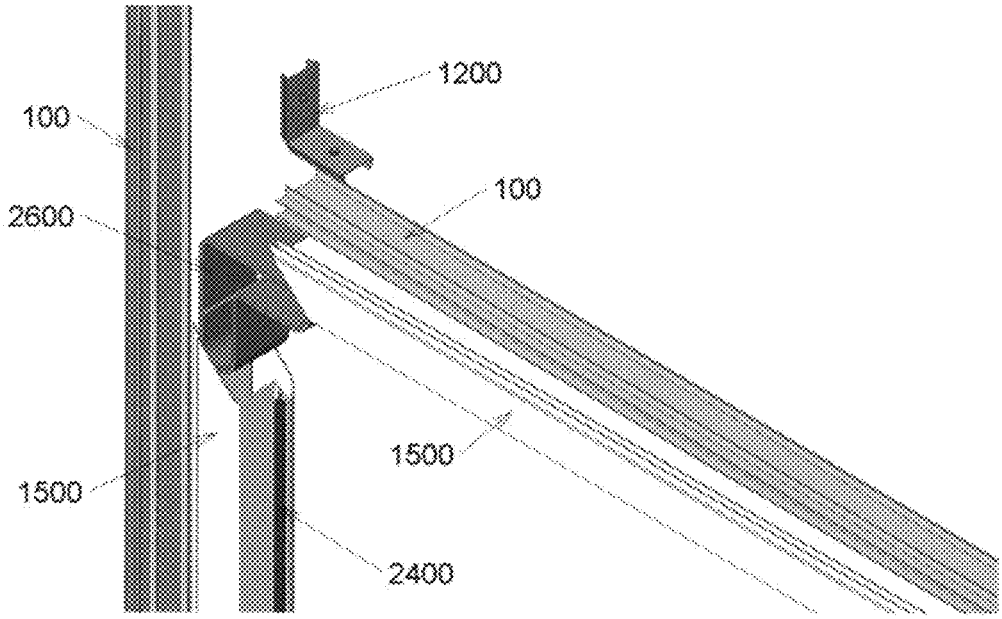

FIG. 47C shows a view of an upper corner of a doorframe using door frame member 1500, with two attached studs 100 and secured in place with L-Brackets 1200. Also shown in FIG. 47C is the door corner bracket 2600 which can be used to secure the corner.

Figure 49A:
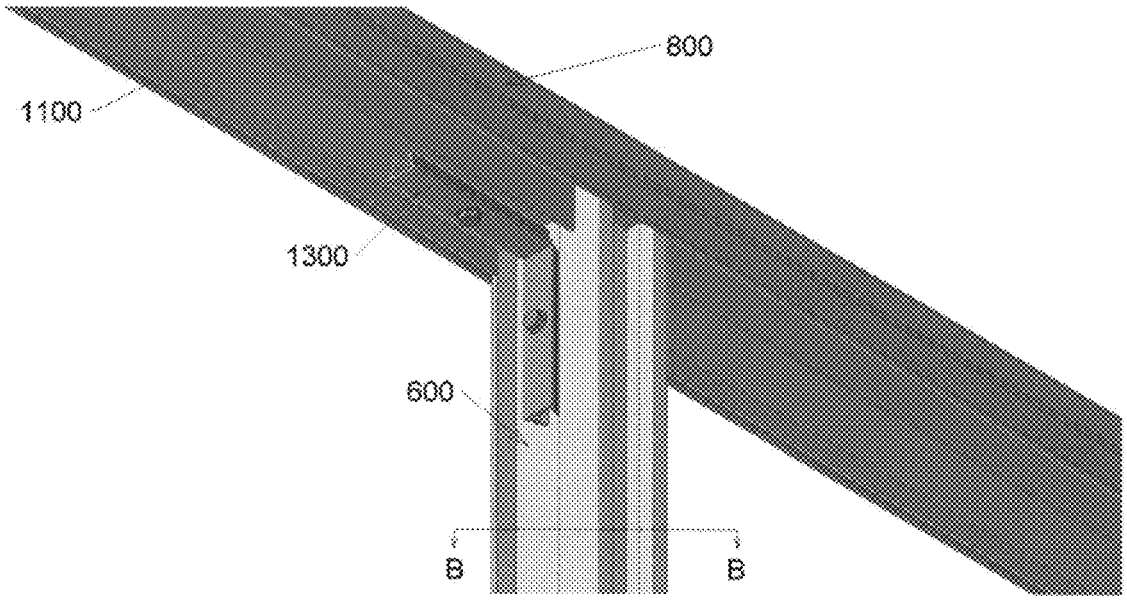
Figure 49B:
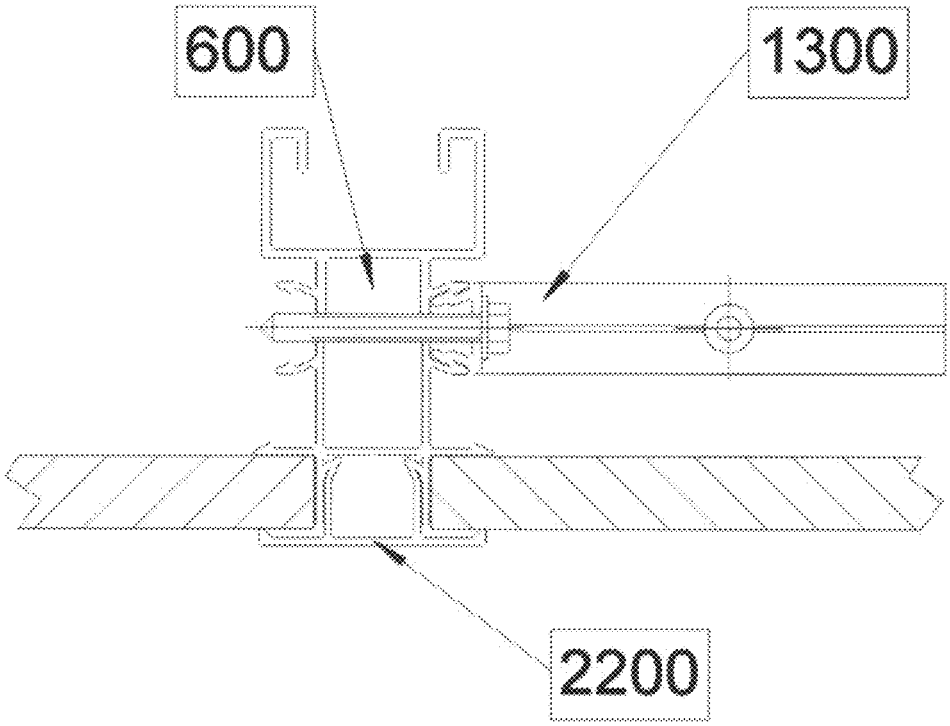
Figure 49C:
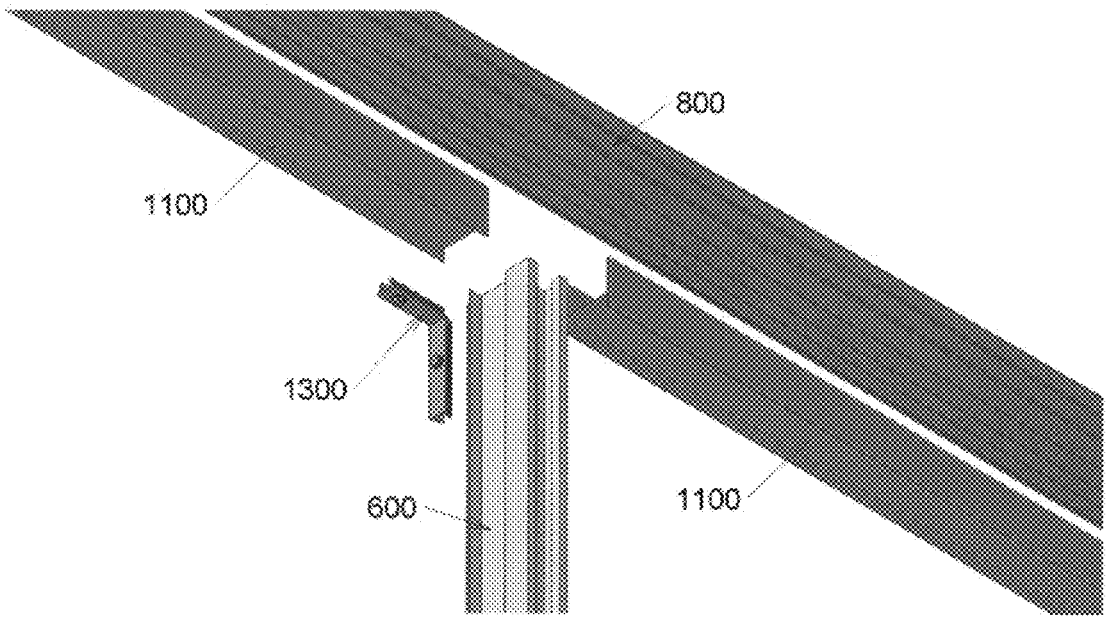
Figure 50A:
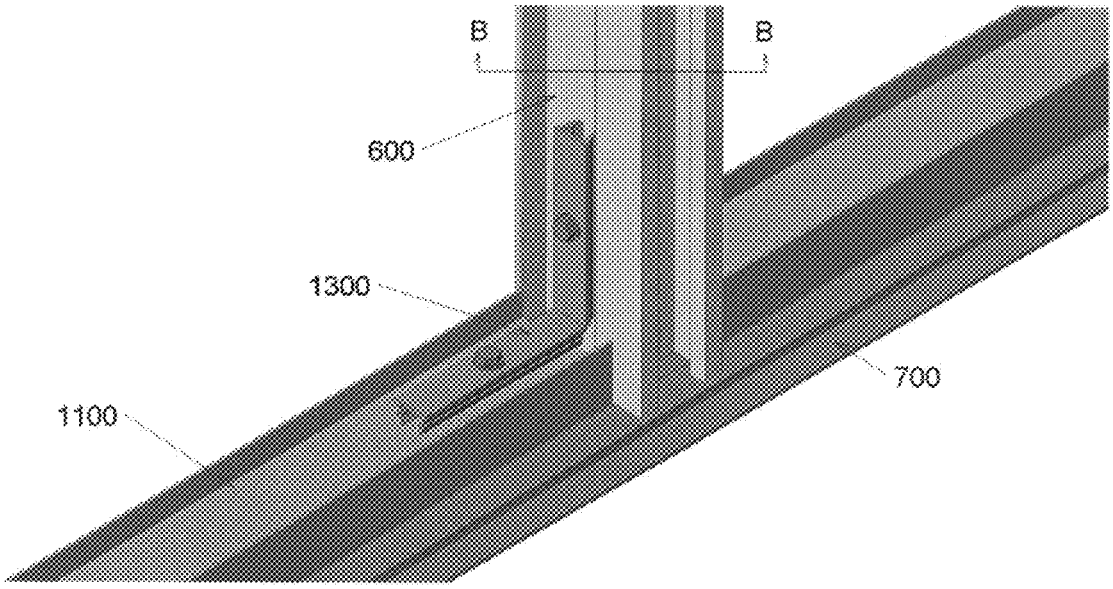
Figure 50B:
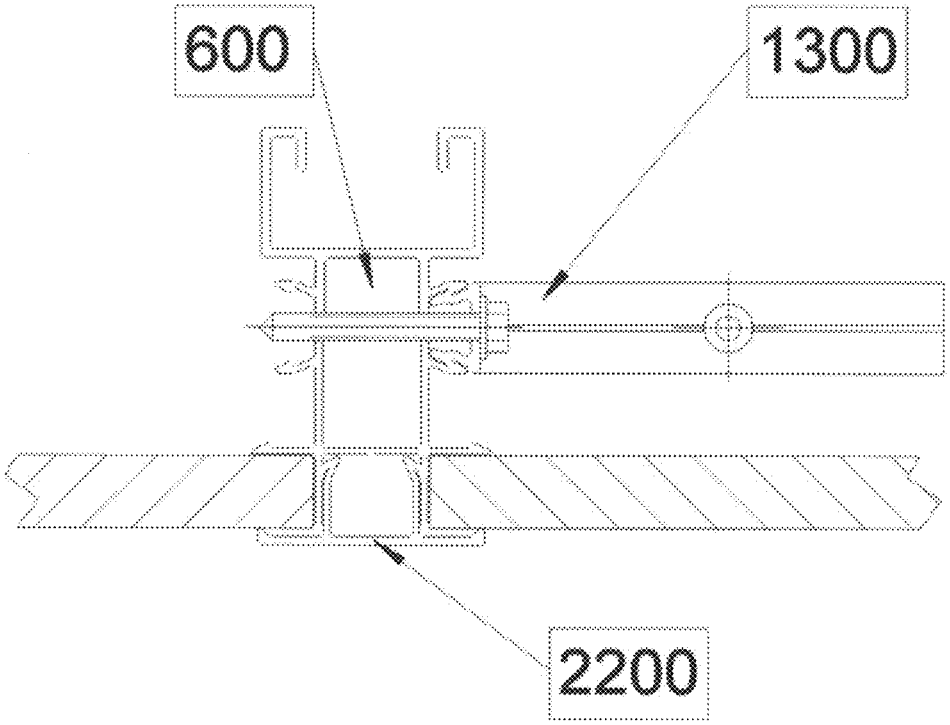
Figure 50C:
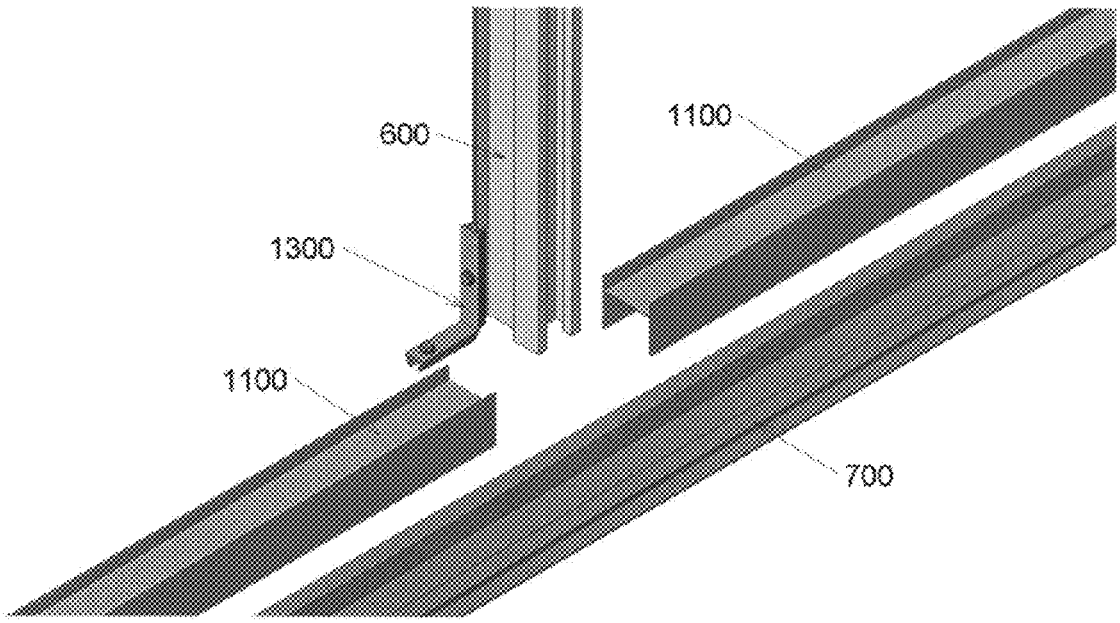

FIGS. 49A to 49B show strut stud 600 attached to track member 800 at a ceiling, which have inserted H brackets 1100, and secured in place with L-Brackets 1300. FIGS. 50A to 50C also shows a strut stud 600 attached to a floor track 700, which have inserted the H brackets 1100, and secured in place with brackets 1300.

Figure 51A:
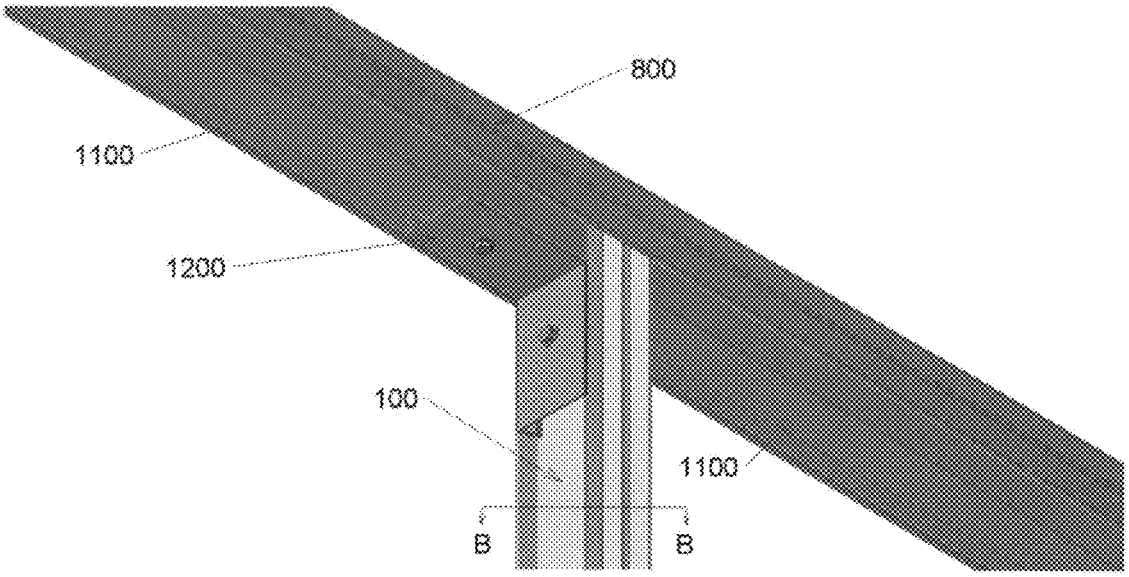
Figure 51B:
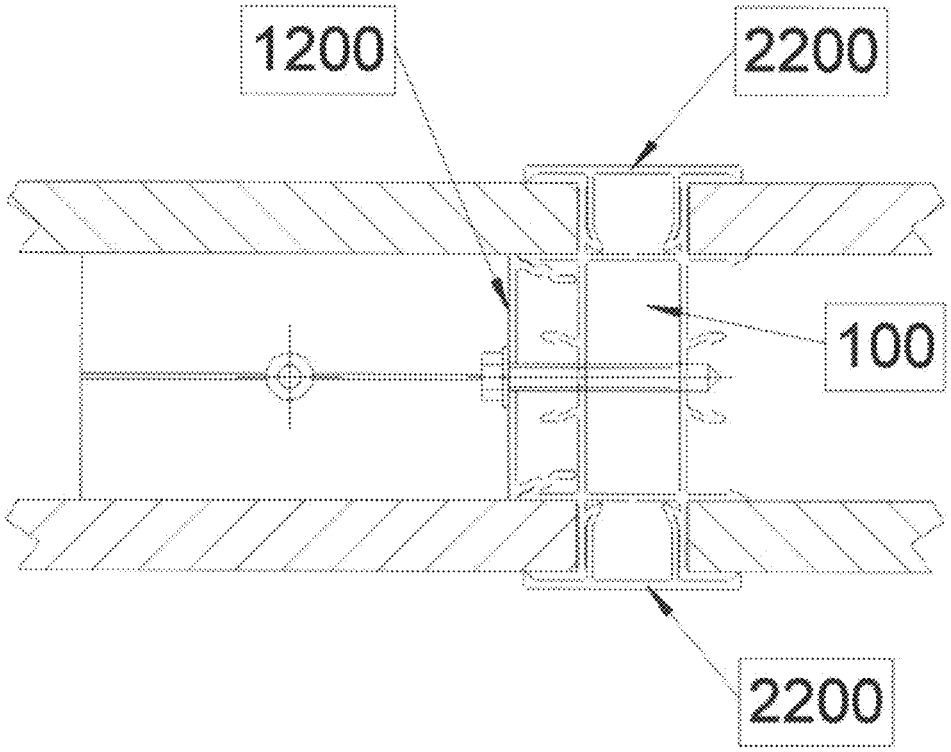
Figure 51C:
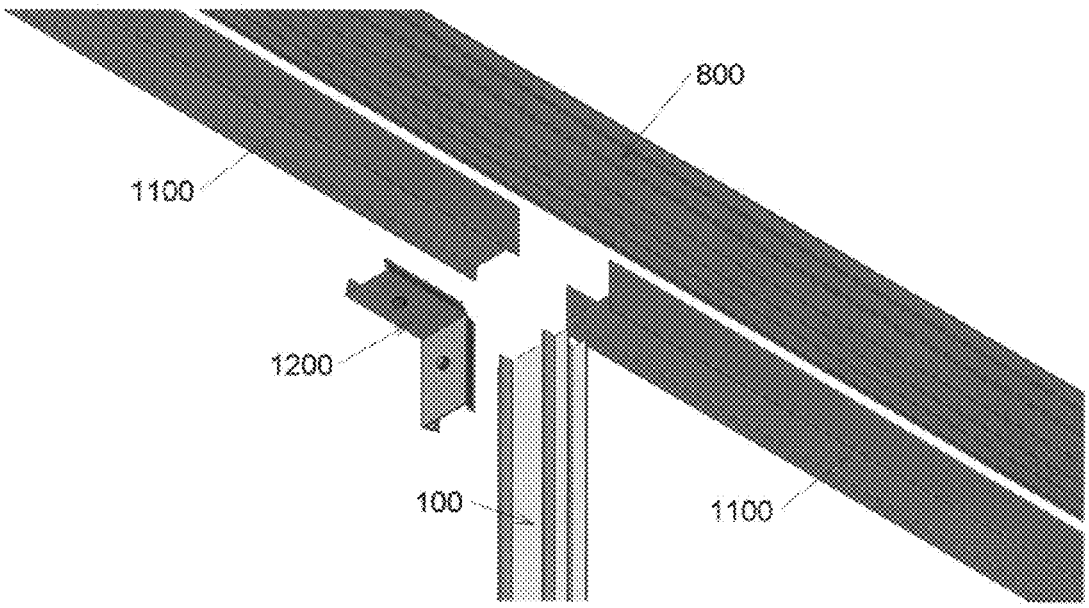
Figure 52A:
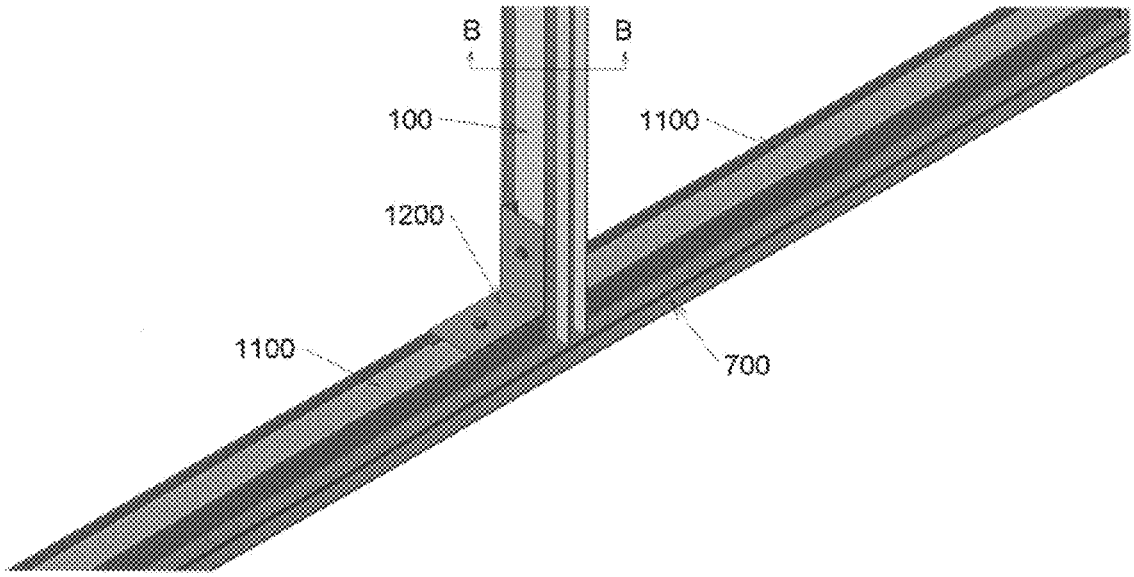
Figure 52B:
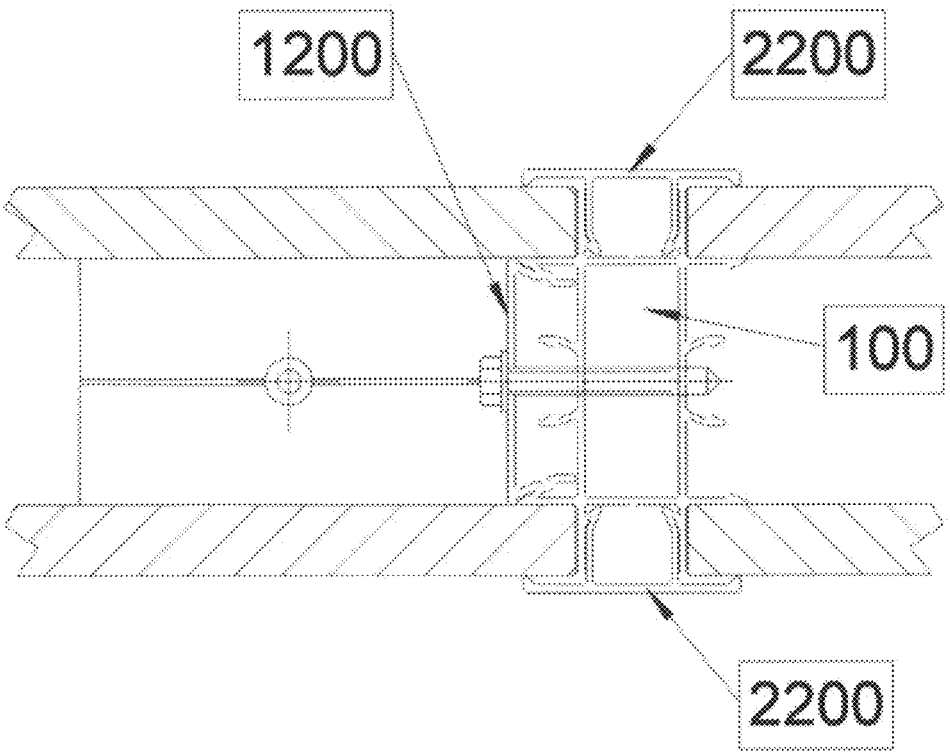
Figure 52C:
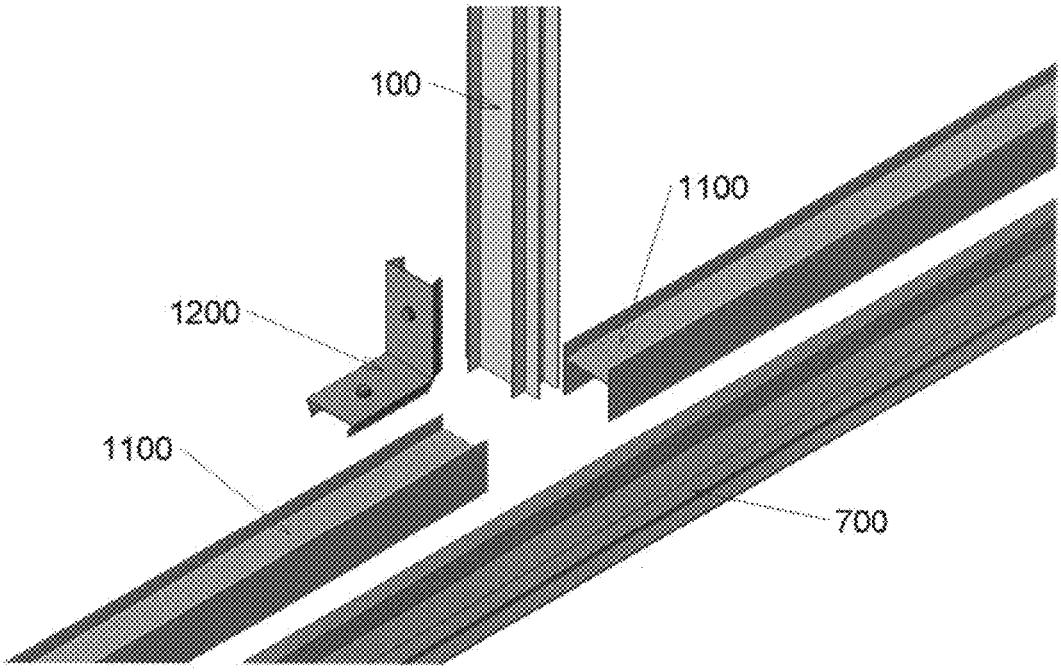

FIGS. 51A to 51C show an assembled view of stud member 100 attached to ceiling track member 800, which have inserted H brackets 1100, and secured in place with brackets 1200. FIGS. 52A to 52C also provide a view of stud member 100 attached to a track member 700 provided at the floor, which have inserted H brackets 1100 and secured in place with brackets 1200

Figure 53A:
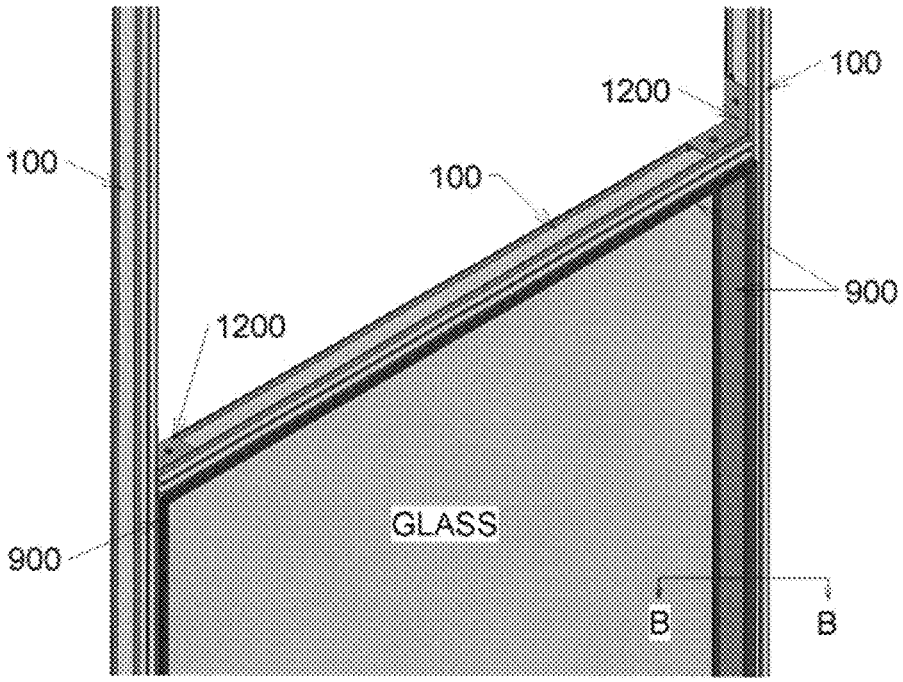
Figure 53B:
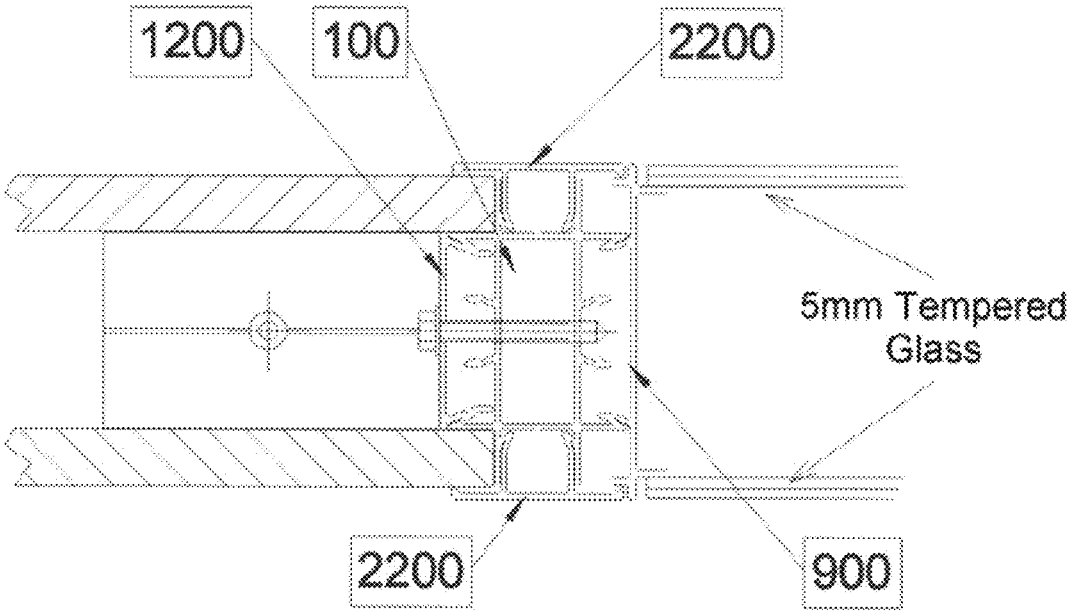
Figure 53C:
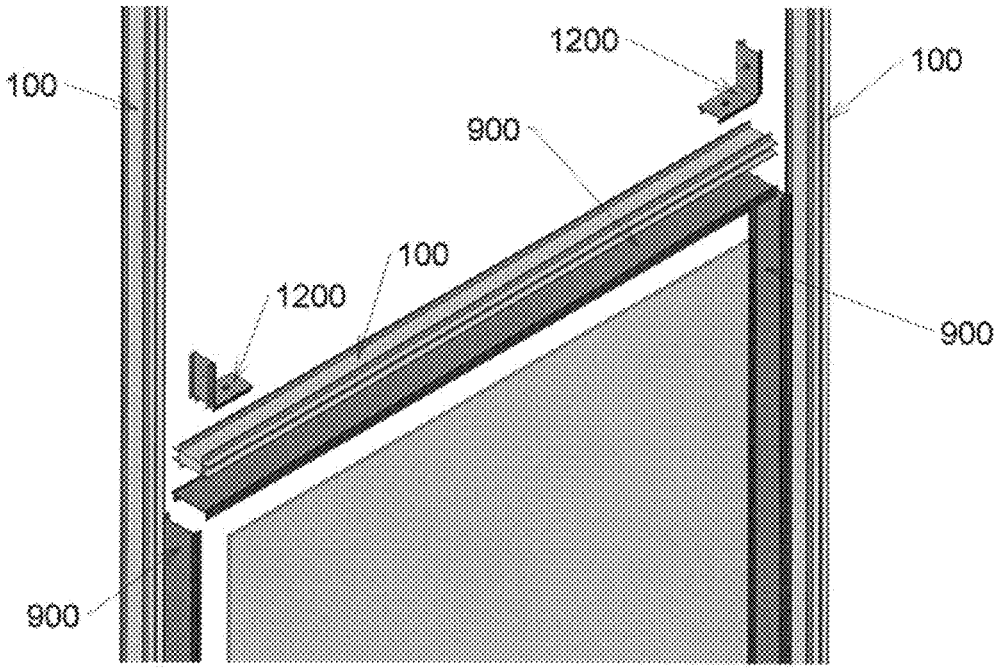
Figure 54A:
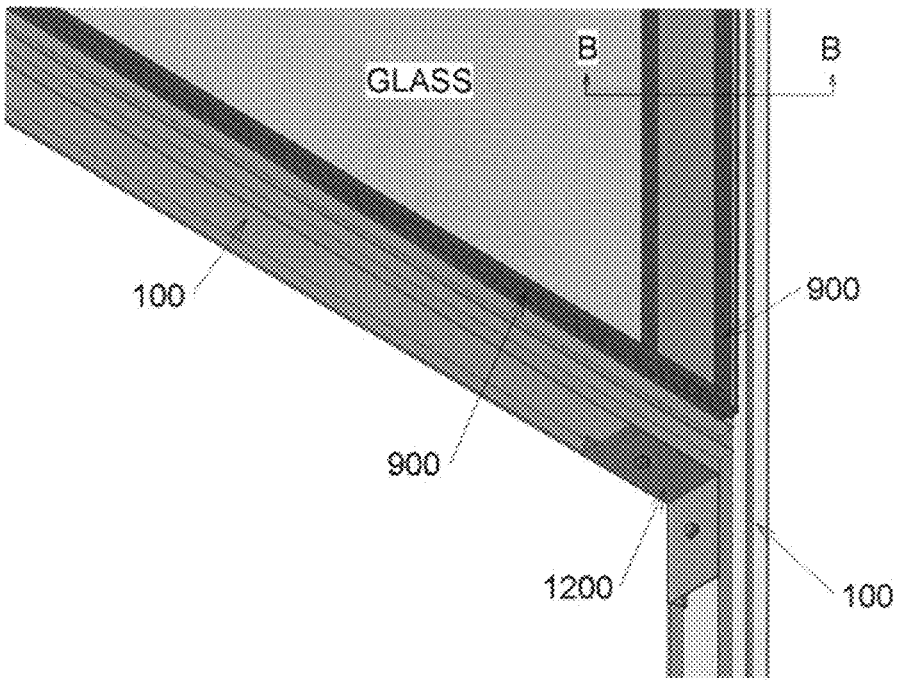
Figure 54B:
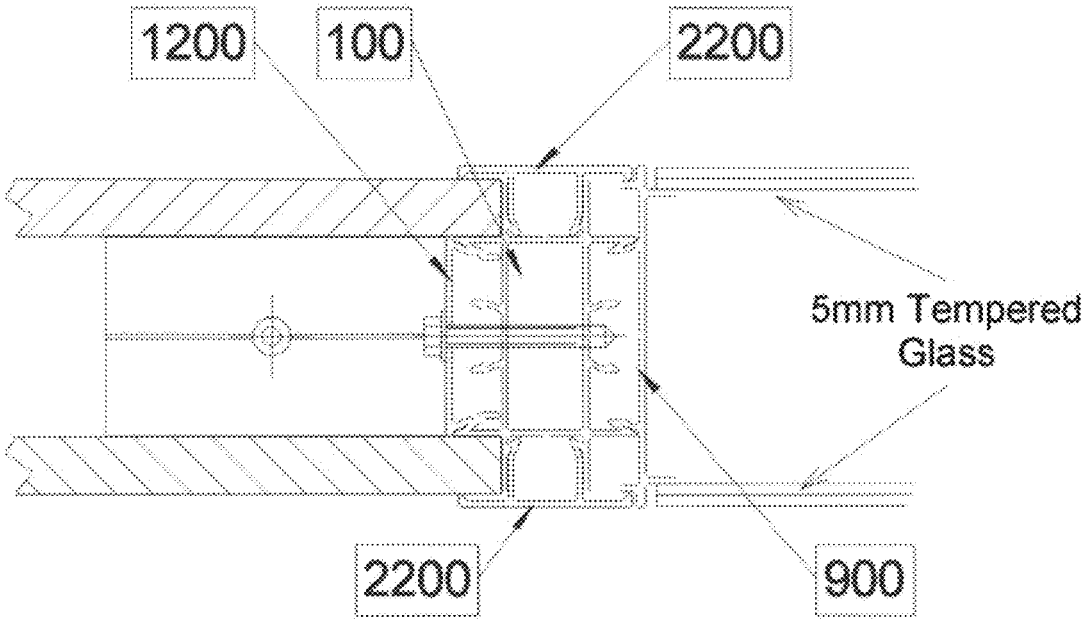
Figure 54C:
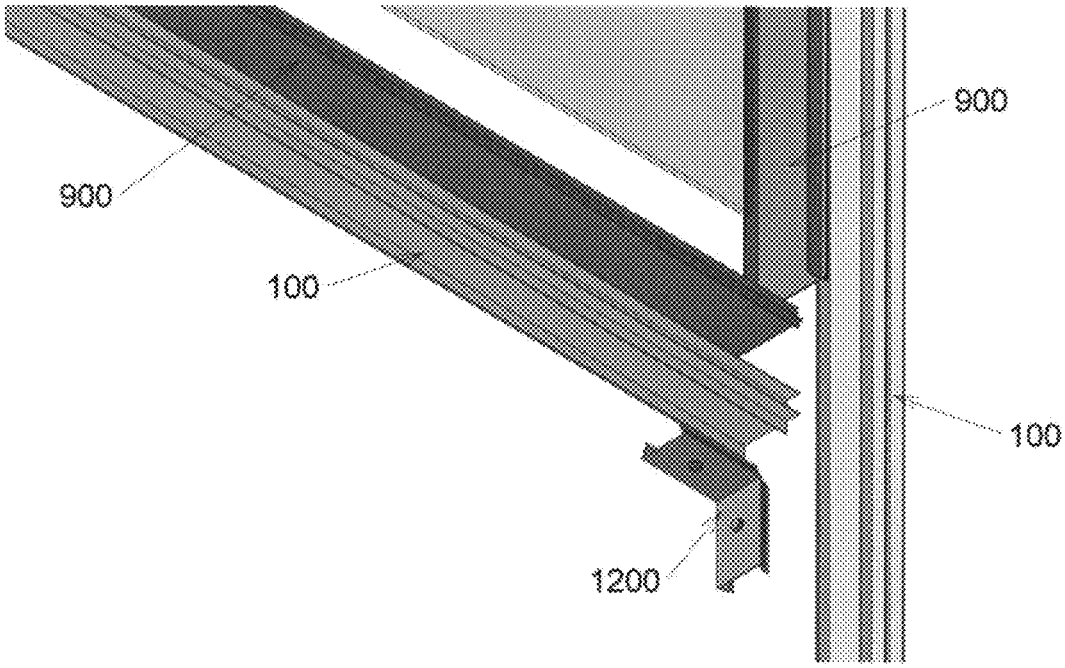

FIGS. 53A to 53C show a view of a window with horizontal stud member or cross member 100 attached to vertical studs 100, which are secured in place with brackets 1200. The window batten member 900 snaps onto the studs and the glass may be secured with methods known in the art (e.g. double-sided glass tape). FIGS. 54A to 54C also provide a view of a window with cross member stud 100 attached to vertical studs 100, which are secured in place with brackets 1200.

Figure 55A:
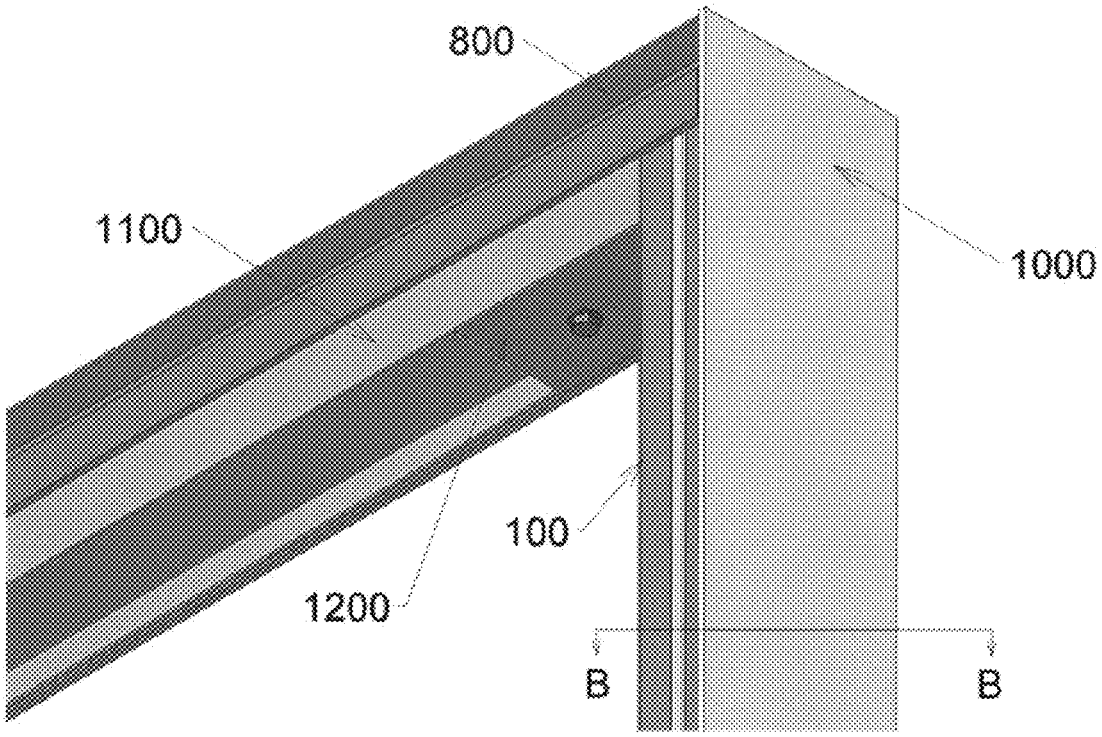
Figure 55B:
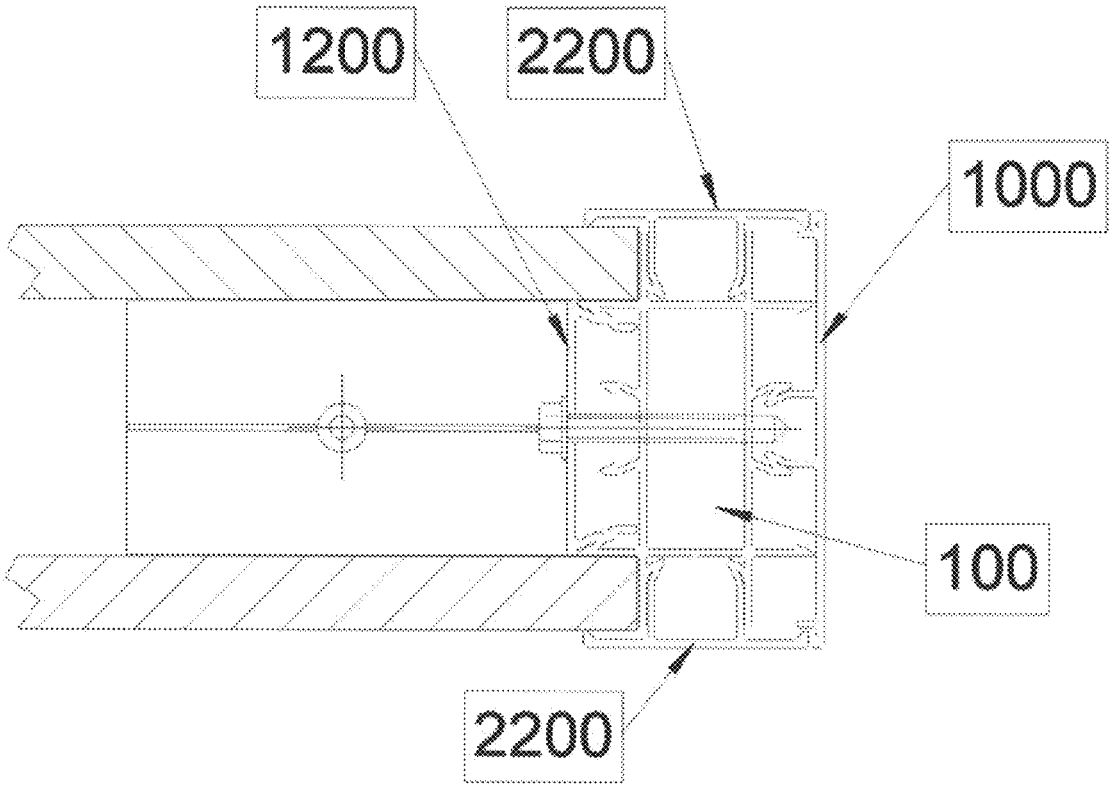
Figure 55C:
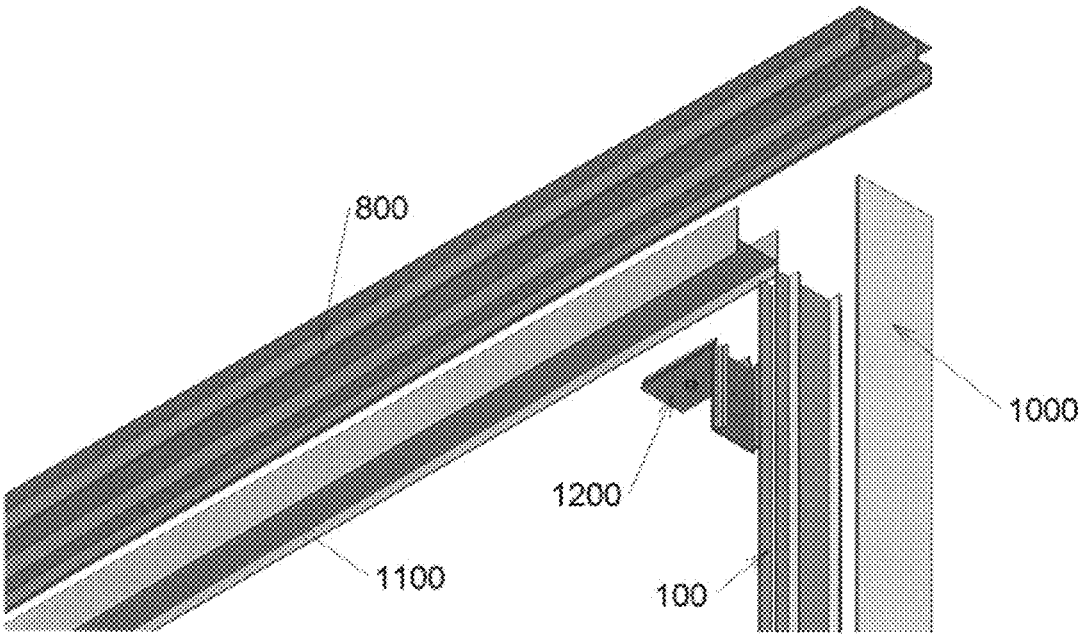

FIGS. 55A to 55C show stud member 100 attached to track member 800 acting as a ceiling support member. Stud member 100 has inserted H-brackets 1100, and secured in place with L-Brackets 1200. As seen best in FIG. 55A, there is provided on one end of stud member 100 end cap 1000.

Figure 56A:
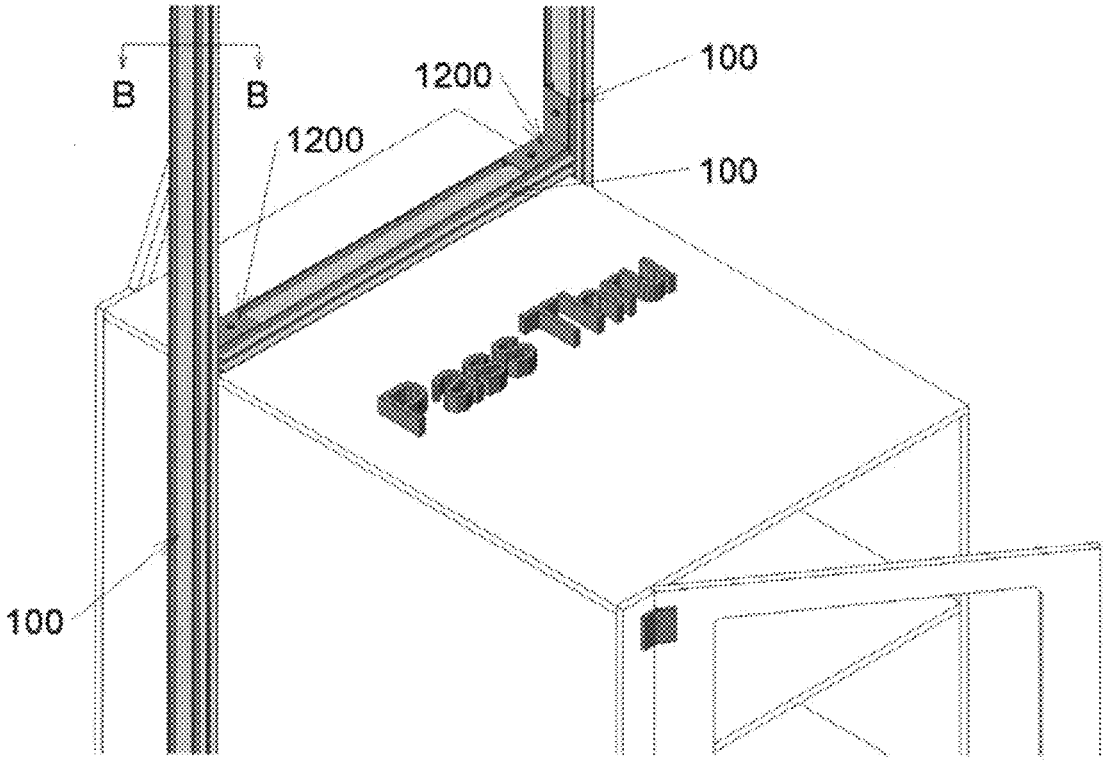
Figure 56B:
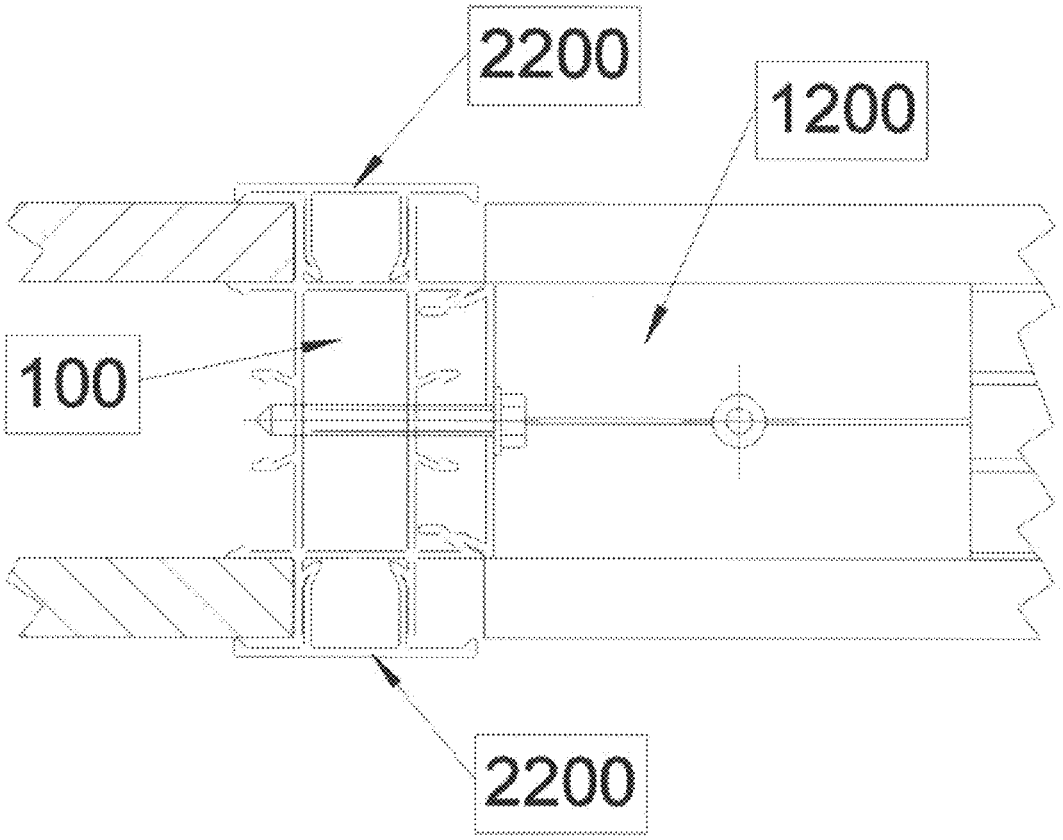
Figure 56C:
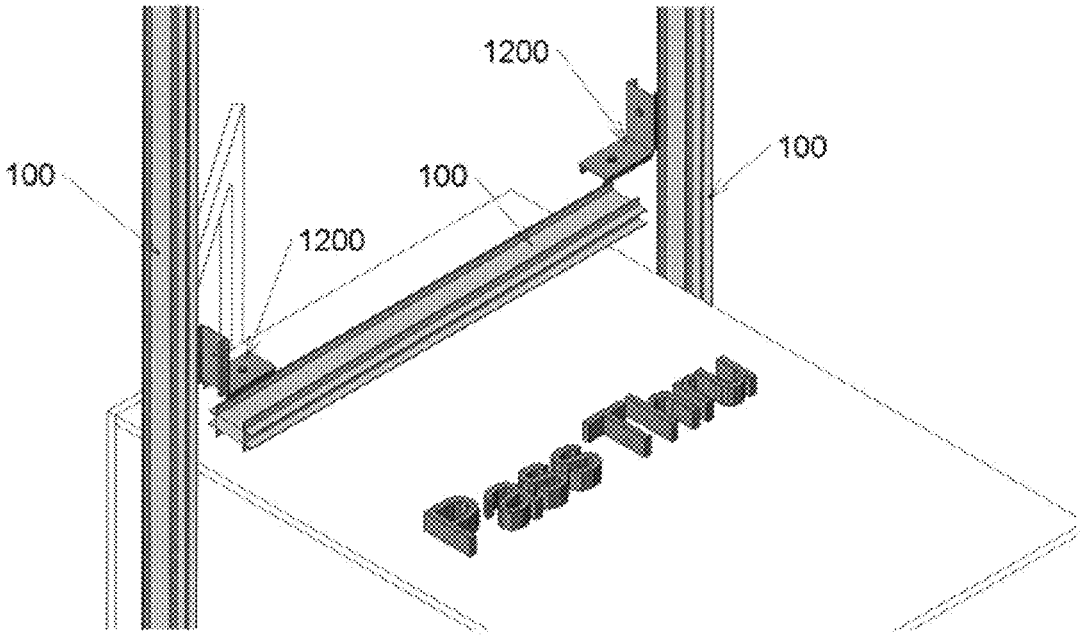

FIGS. 56A to 56B show a pass through with a horizontal placed stud member or cross member 100 attached to two vertical studs 100, which are secured in place with brackets 1200. Pass Throughs are a common element used in Cleanrooms as a means of allowing material transfer between zones. As shown best in FIG. 56A, this same embodiment may be used to install equipment into the provided opening.

Figure 57A:
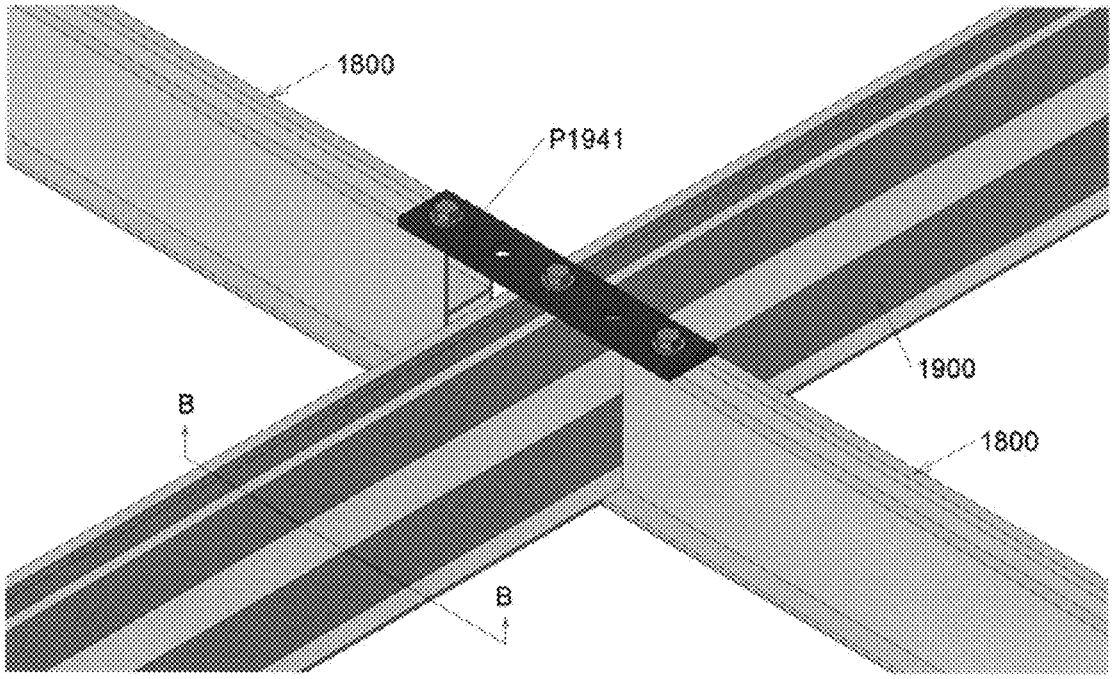
Figure 57B:
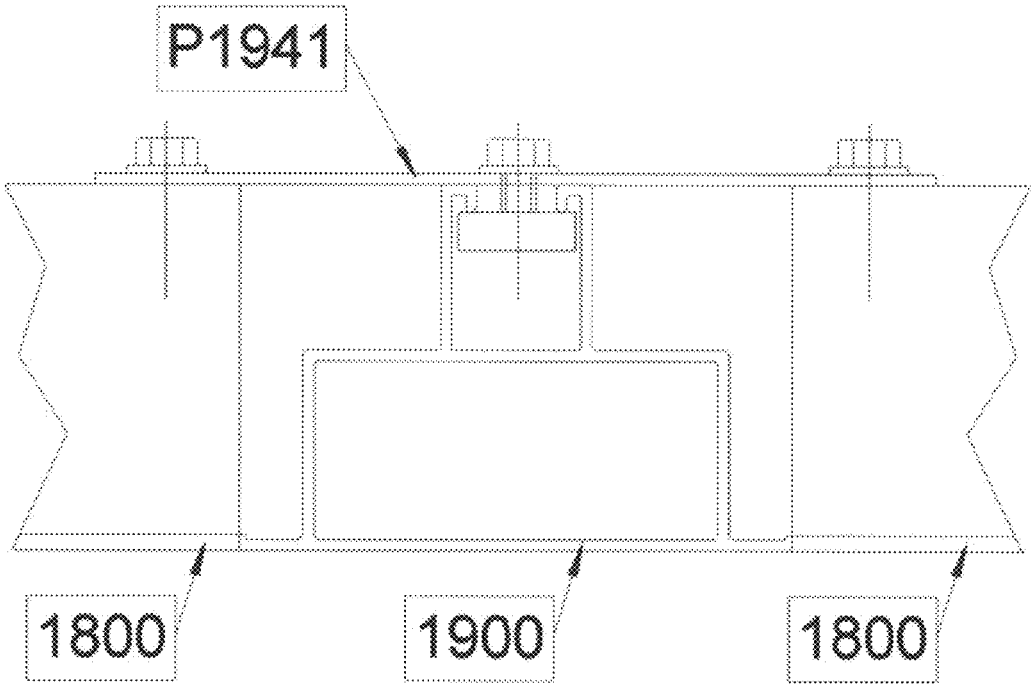
Figure 57C:
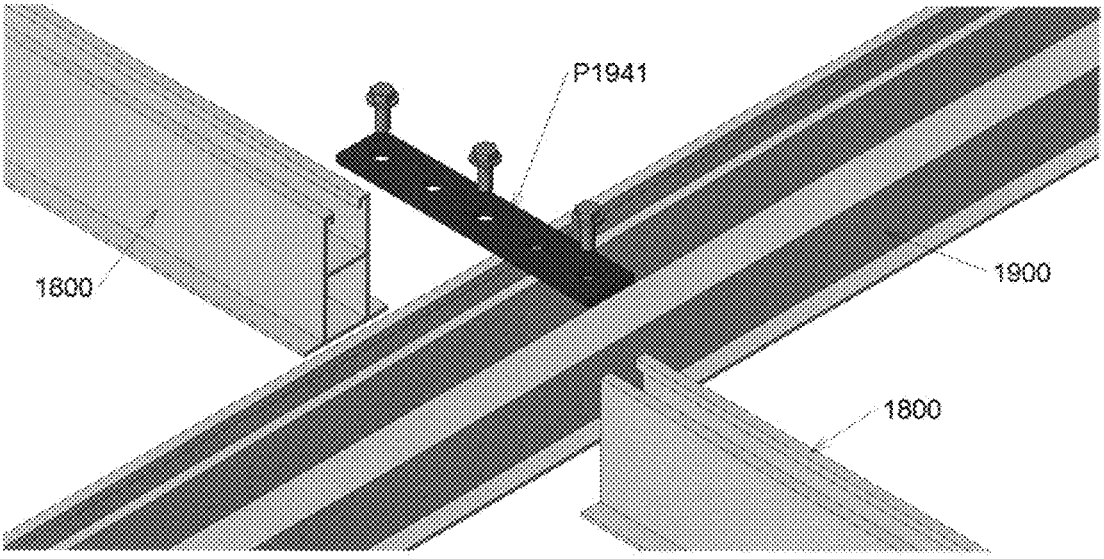

FIGS. 57A to 57C show a ceiling support embodiment of the present invention. Two ceiling support members 1800 may be used as a cross members to ceiling support member 1900 The ceiling support members 1800 and 1900 may be connected using a standard industry connector (e.g. P1941), preferably with an industry standard spring nut, bolt and washer, sized to meet the requirements for weight loading.

Figure 58A:
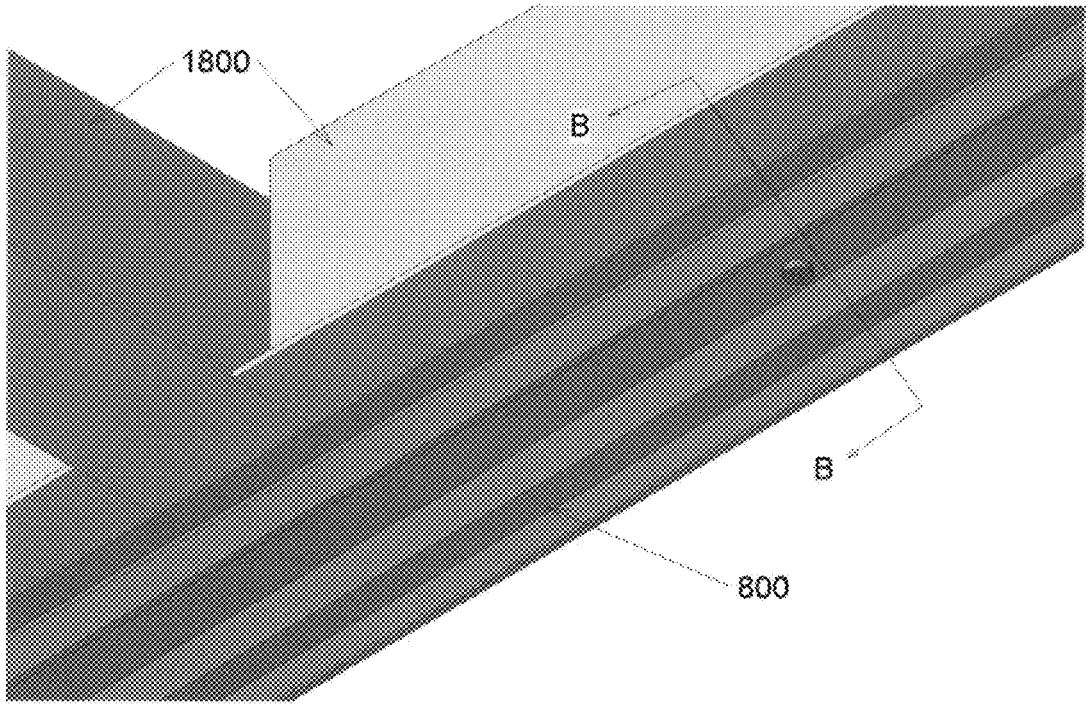
Figure 58B:
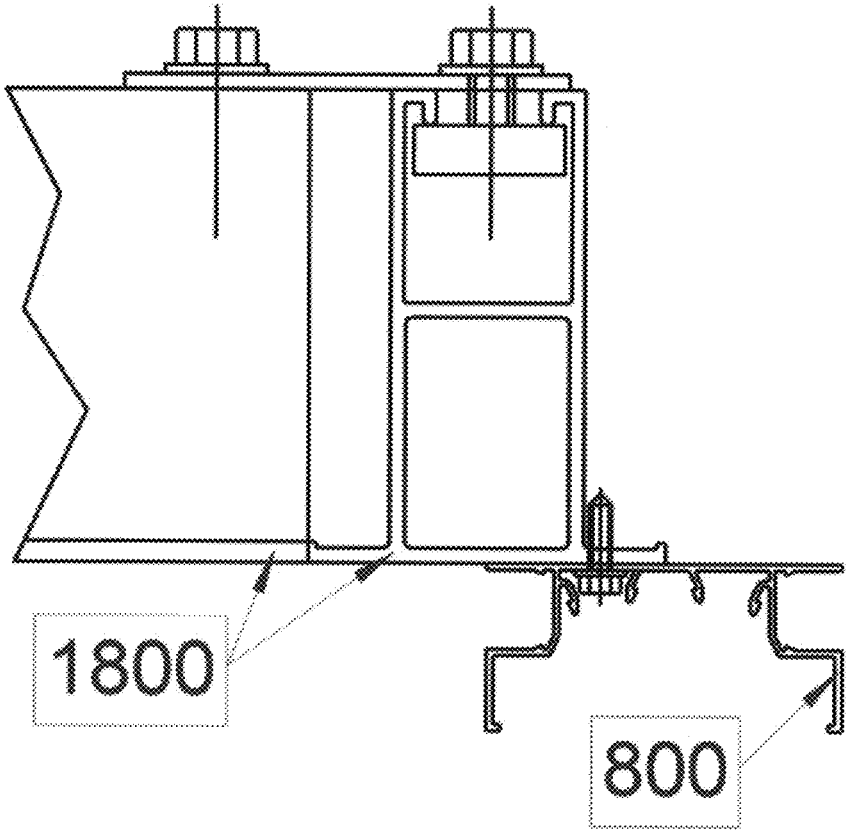
Figure 58C:
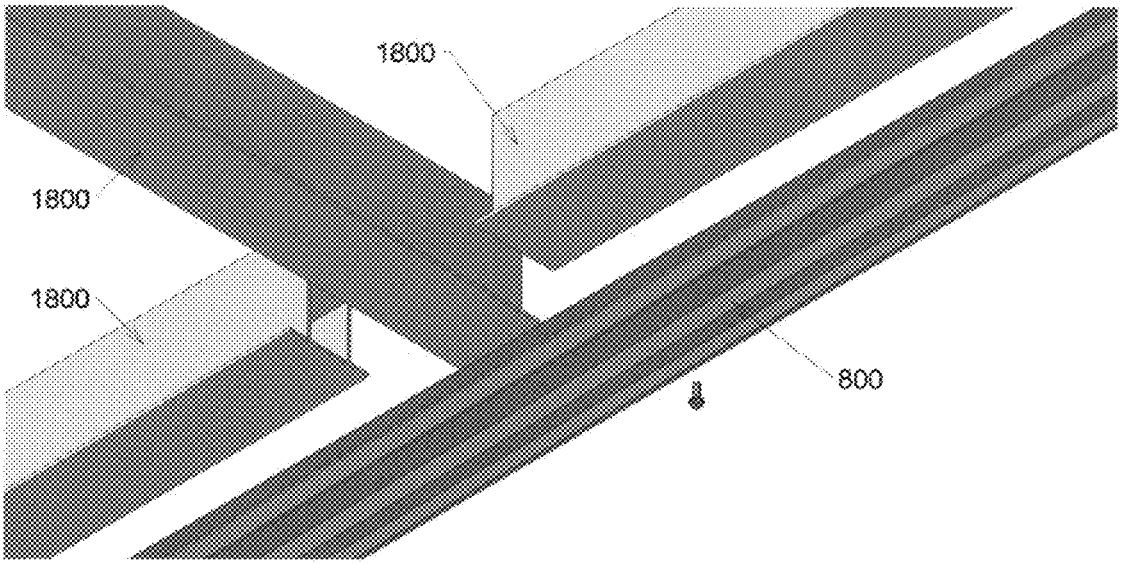

FIGS. 58A to 58C show a further ceiling embodiment of the present invention. Support members 1800 have track member 800 secured thereto.

Figure 59A:
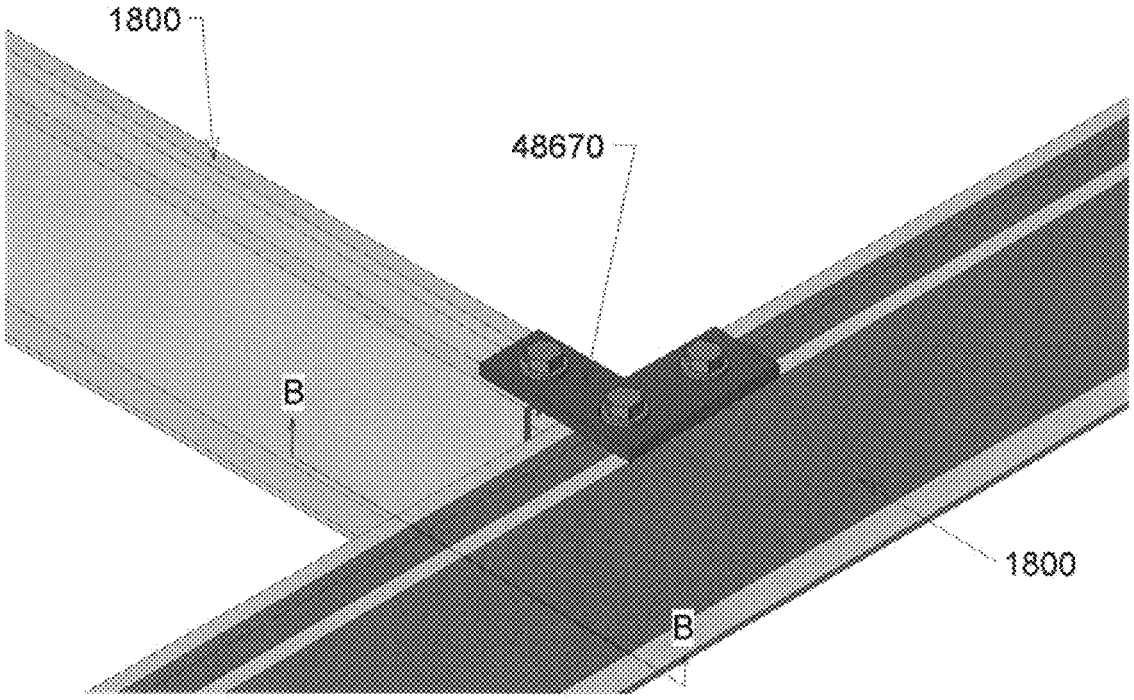
Figure 59B:
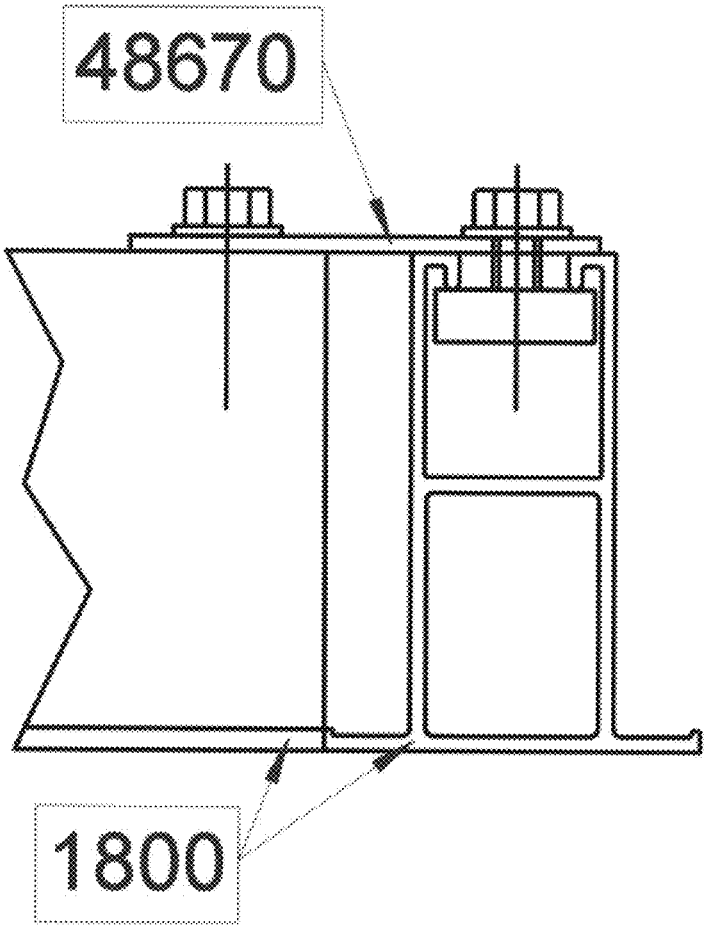
Figure 59C:
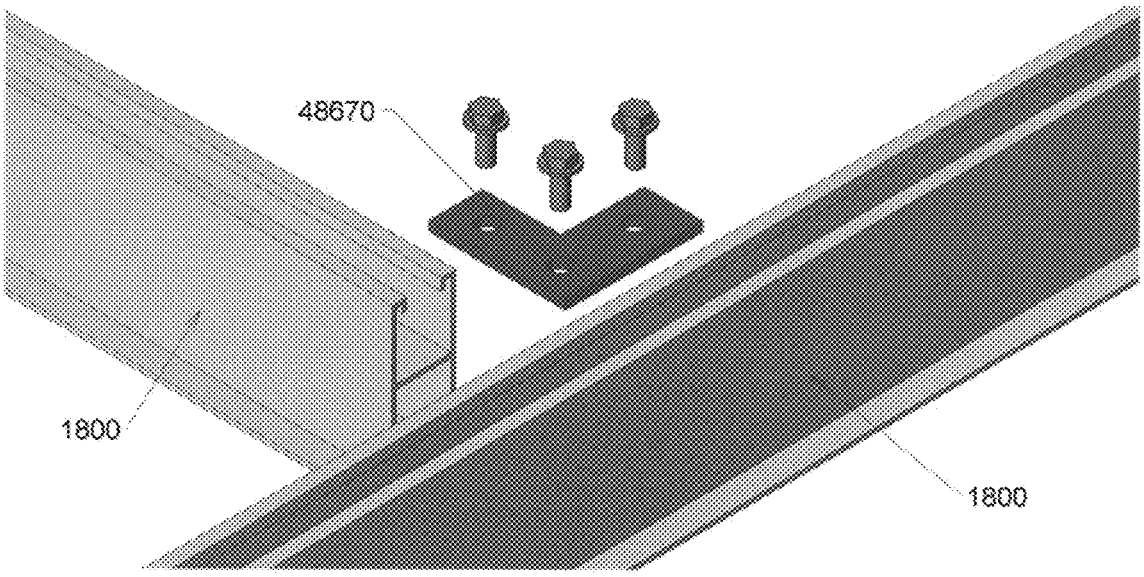
Figure 60A:
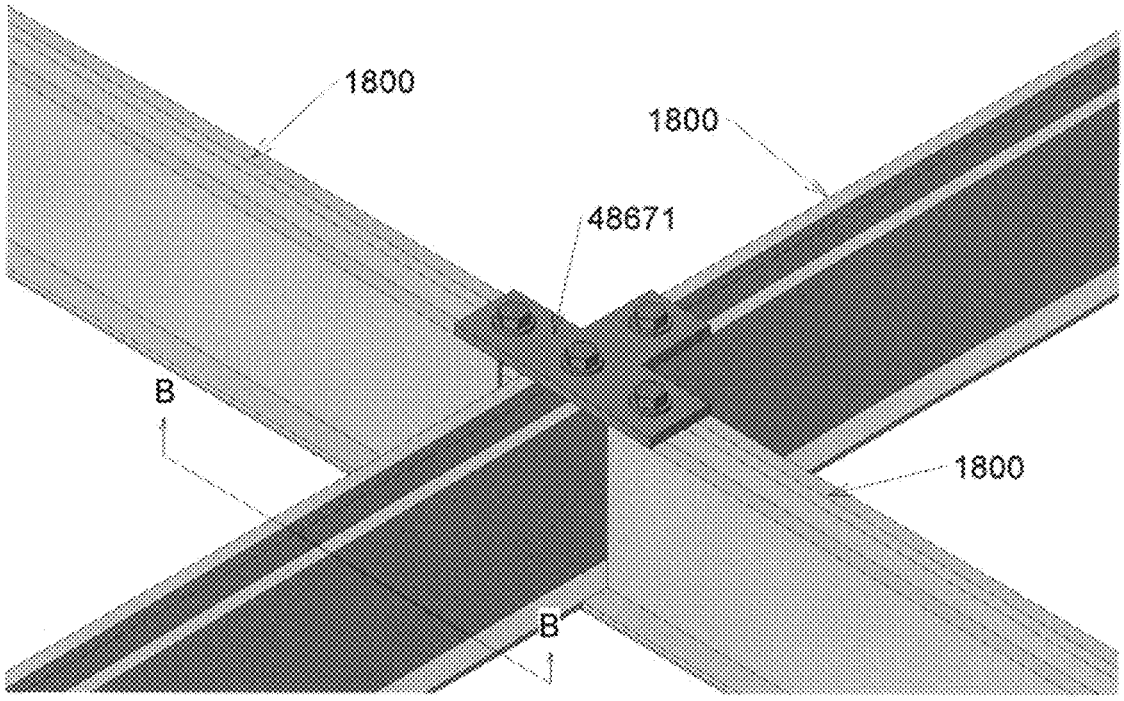
Figure 60B:
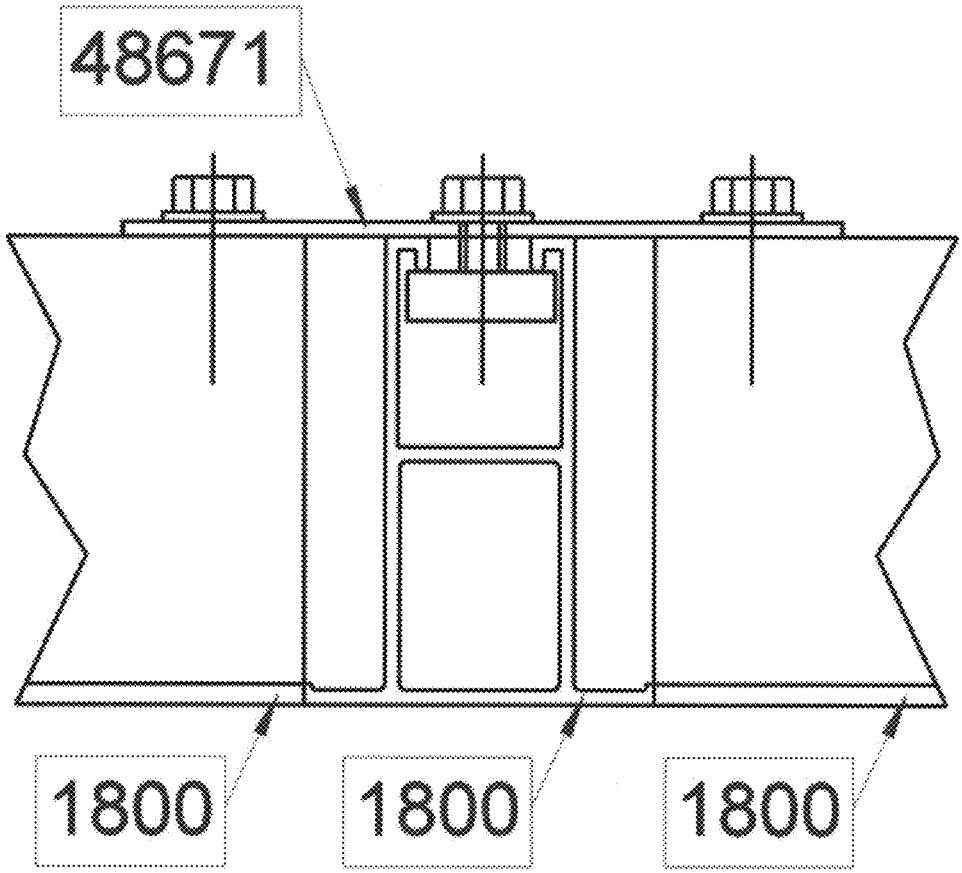
Figure 60C:
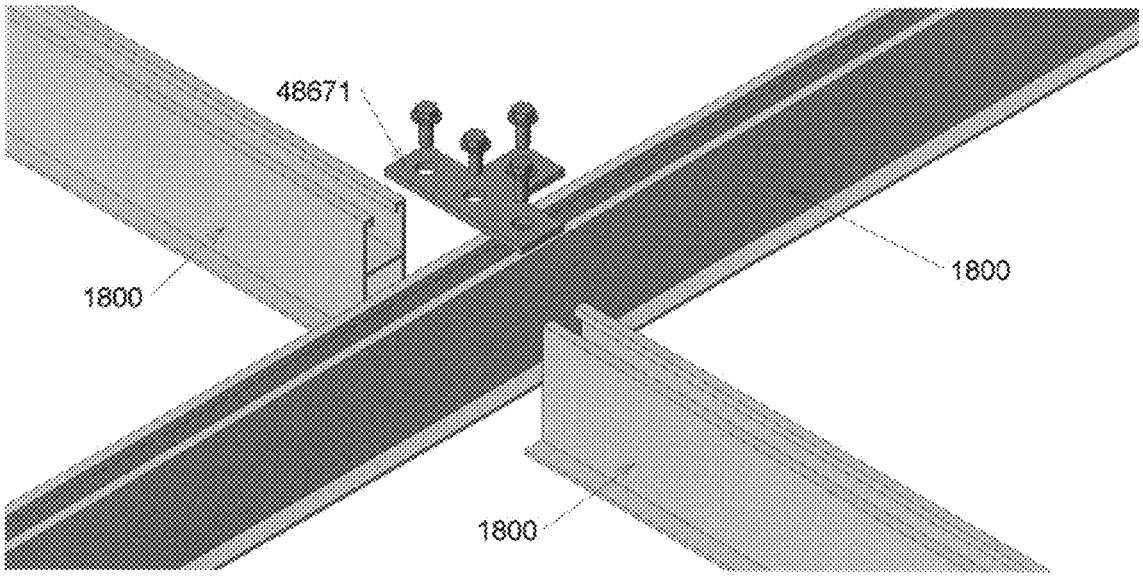
Figure 61A:
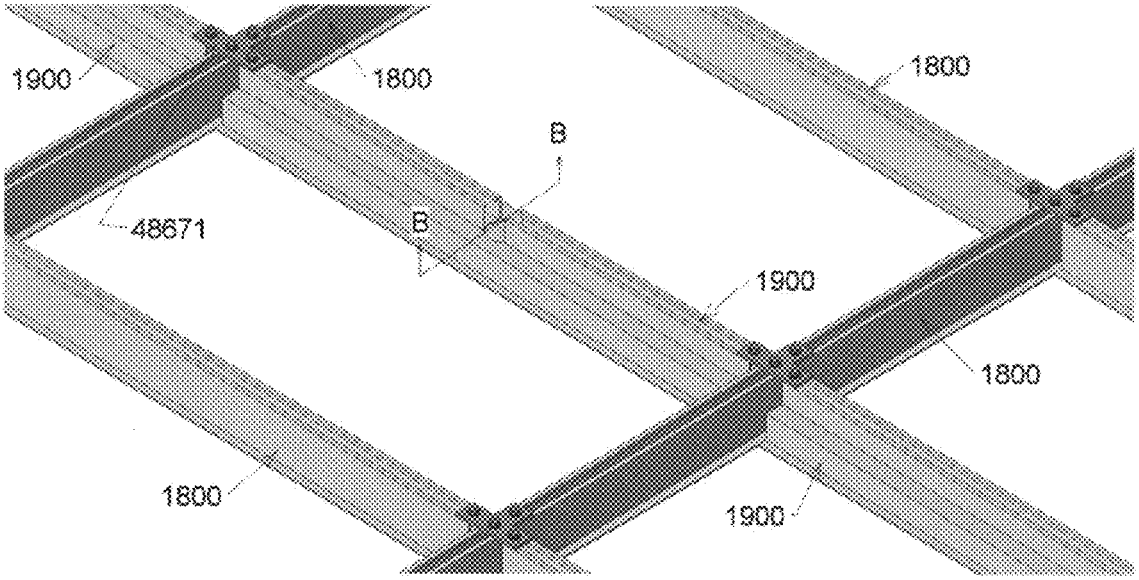
Figure 61B:
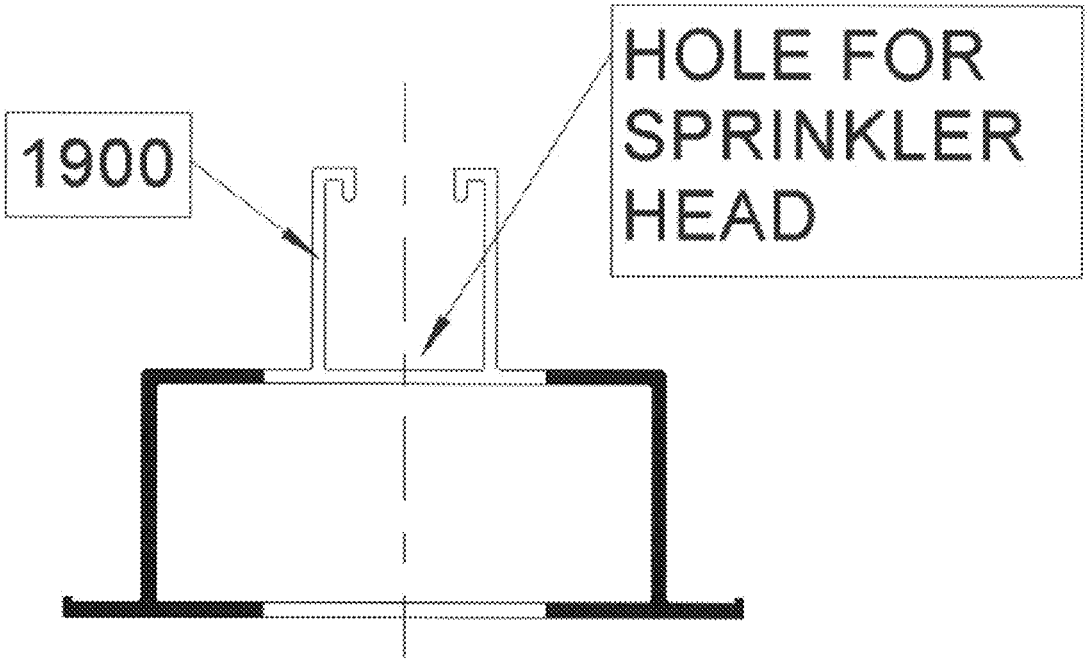
Figure 61C:
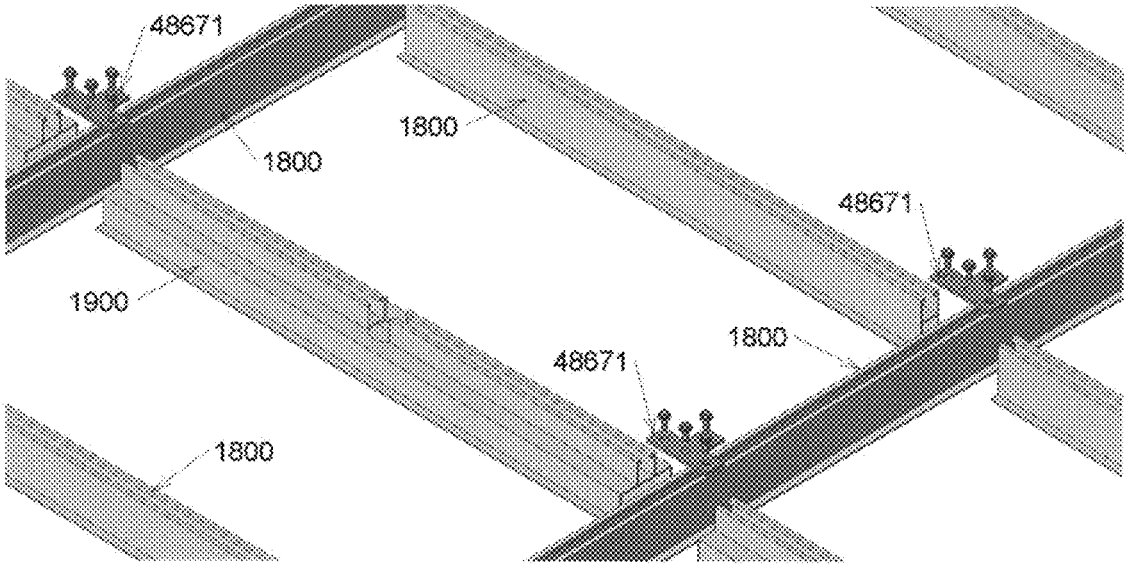

FIGS. 59A to 59C show a further preferred ceiling embodiment of the present invention. Ceiling support member 1800 may be used as a cross member to a ceiling support member 1800. Ceiling support members 1800 may be connected using a standard connector (e.g. 48670), secured in a known manner. FIGS. 60A to 60C show a further embodiment comprising ceiling support member 1800 may be used as a cross members to a supports 1800. FIGS. 61A to 61C shows a further embodiment with support 1900 used for piping or an industry standard recessed sprinkler head (see, for example, FIG. 61B)

By the utilization of the construction members of the present invention, demountable cleanrooms, laboratories or office partitions can be built. It will also be understood by a person skilled in the art that the construction members of the present invention can be assembled together to create any number of combinations of Cleanroom laboratories or office configurations. Using the configurations possible with the various construction members, it may be possible to construct a Cleanroom within a predefined space quickly and easily. It allows infinite configuration possibilities that allow existing Cleanrooms to adjust the initial design when the requirements change. It will also be understood by a person skilled in the relevant art that the invention is not limited to configurations set out herein. The present invention provides a system that does not require precise preplanning, as other wall systems, which once installed, do not allow modification or adjustment. The modular system of the present invention may be intrinsically a flexible system such that it may be possible to change the Cleanroom layout before, during, and after assembly. In the case of existing Cleanrooms, it may be possible to use the present invention in whole or in part. It will be understood by a person skilled in the relevant art that individual embodiments of the present invention can be used with pre-installed or preexisting systems and/or equipment.

The preferred installation method may be to start from a ceiling, preferably attaching track member 800, and preferably using a level to install a track member 700 at the floor. From there the installation could, in a preferred embodiment, progress to the walls studs, and then framing the installation of windows and doors. After the panels are installed, the battens members are selected and can be used to seal the wall system.

It will be apparent to those skilled in the art that the present disclosure is merely by way of example, and is not to be construed as limiting upon the following claims.

What is claimed is:

1. A demountable wall system adapted for use as part of a cleanroom structure, said system comprising:

(a) at least one structural member having a generally rectangular cross section defined by opposing wide sides that are wider than opposing narrow sides and adapted to receive a wall panel, at least one wide side having a first and second pair of releasable snap locking members;

(b) at least one track member having a pair of releasable snap locking members and a pair of flange members extending from a base, each flange member having a releasable snap locking member extending therefrom;

(c) at least one batten member having a base, the base having a first portion being adapted to engage the wall panel and a second portion of the base having a pair of releasable snap locking members extending therefrom, the pair of releasable snap locking members adapted for engaging the releasable snap locking members of the structural member or the track member along a first plane of linear movement to form a semi-rigid connection wherein the releasable snap locking members of at least one batten member and the structural member or the track member in the semi-rigid connection are opposingly oriented along the first linear plane of movement to resist movement of the first batten member and the structural member or track member along the first linear plane of movement; and (d) at least one bracket member having a base, the base having (i) a first pair of flanges having releasable snap locking members extending therefrom in a first direction, (ii) a second pair of flanges having releasable snap locking members extending from the base in a second direction, the second direction opposite to the first direction, and (iii) a first pair of releasable snap locking members extending from the base in the first direction, wherein each releasable snap locking member of the at least one bracket member is adapted for engaging the releasable snap locking members of the structural, track or batten member along a first plane of linear movement to form a semi-rigid connection wherein the releasable snap locking members of the at least one bracket member and the structural member, track member or batten member in the semi-rigid connection are opposingly oriented along the first linear plane of movement to resist movement of the first batten member and the structural member or track member along the first linear plane of movement.

2. The system of claim 1 wherein each semi-rigid connection allows movement of the members relative to each other along a second plane of linear movement which is perpendicular to the first plane of linear movement.

3. The system of claim 2 wherein the structural member is a hollow, generally rectangular stud.

4. The system of claim 2 wherein each releasable snap locking member comprises a pawl biased in a resting first position, the pawl movable upon the application of a forced between a resting position and a second extended position, wherein in the second extending position the pawl is engagable by a pawl an opposed releasable snap locking member.

5. The system of claim 4 wherein when the pawls of each releasable snap locking member moves along the first plane of linear movement of the opposingly oriented releasable snap locking member each pawl is biased towards the second extended position.

6. The system of claim 4 wherein the wall panel further comprises an exterior shell and interior core.

7. The system of claim 6 wherein the structural and track members are made from extruded aluminum or PVC.

8. The system of claim 6 wherein the batten members are made from extruded aluminum or co-extruded PVC.

9. The system of claim 4 wherein the at least one track member is releasably secured to a ceiling.

10. The system of claim 4 wherein the at least one track member is releasably secured to a floor.

* * * * *